US010012038B2

(12) United States Patent
Richardson et al.

(10) Patent No.: US 10,012,038 B2
(45) Date of Patent: Jul. 3, 2018

(54) PIPE HANDLING APPARATUS AND METHODS

(71) Applicant: Warrior Rig Technologies Limited, Calgary (CA)

(72) Inventors: Allan Stewart Richardson, The Woodlands, TX (US); Jeffery David Blacklock, Calgary (CA); Peter Ernest James Root, Calgary (CA)

(73) Assignee: Warrior Rig Technologies Limited, Calgary (CA)

( * ) Notice: Subject to any disclaimer, the term of this patent is extended or adjusted under 35 U.S.C. 154(b) by 205 days.

(21) Appl. No.: 14/800,624

(22) Filed: Jul. 15, 2015

(65) Prior Publication Data

US 2016/0017674 A1 Jan. 21, 2016

Related U.S. Application Data

(60) Provisional application No. 62/024,471, filed on Jul. 15, 2014.

(51) Int. Cl.
*E21B 19/15* (2006.01)

(52) U.S. Cl.
CPC ..... *E21B 19/155* (2013.01)

(58) Field of Classification Search
CPC ..... E21B 19/14; E21B 19/15; E21B 19/55; E21B 19/155
See application file for complete search history.

(56) References Cited

U.S. PATENT DOCUMENTS

| | | | |
|---|---|---|---|
| 2,958,430 | A | 11/1960 | Robishaw |
| 3,053,401 | A | 9/1962 | Jinkins, Jr. |
| 3,065,865 | A | 11/1962 | Barker |
| 3,655,071 | A | 4/1972 | Langowski et al. |
| 3,865,256 | A | 2/1975 | Freeman, Sr. |
| 4,040,524 | A | 8/1977 | Lamb et al. |
| 4,067,453 | A | 1/1978 | Moller |
| 4,235,566 | A | 11/1980 | Beeman et al. |
| 4,347,028 | A | 8/1982 | Dugan |
| 4,365,692 | A | 12/1982 | Craig et al. |

(Continued)

FOREIGN PATENT DOCUMENTS

| | | | |
|---|---|---|---|
| CA | 2510137 | A1 | 12/2005 |
| EP | 0061473 | B1 | 1/1986 |

(Continued)

*Primary Examiner* — Robert E Fuller
(74) *Attorney, Agent, or Firm* — Oyen Wiggs Green & Mutala LLP

(57) ABSTRACT

A pipe handling system comprises a carriage having an upper surface adapted to support a tubular. The carriage comprises a first section and a second section. The first and second sections are pivotally coupled together for rotation about a pivot axis. The carriage is movable relative to a base and configured such that the leading end of the carriage is elevated as the carriage is advanced. An actuator is coupled between the first and second sections. The actuator is operable to pivot the second section relative to the first section about the pivot axis. In some embodiments the carriage is configured with a positive kink to deliver tubulars to a rig floor and with a negative kink to deliver tubulars to an online or offline stand building system. In some embodiments a live surface on the carriage is controllable to reduce or eliminate swinging of tubulars as they are transferred to or from the drill rig.

29 Claims, 54 Drawing Sheets

(56) References Cited

U.S. PATENT DOCUMENTS

| | | | |
|---|---|---|---|
| 4,379,676 | A | 4/1983 | Frias |
| 4,382,738 | A | 5/1983 | Frias |
| 4,386,883 | A | 6/1983 | Hogan et al. |
| 4,403,898 | A | 9/1983 | Thompson |
| 4,462,182 | A | 1/1984 | Frias et al. |
| 4,439,091 | A | 3/1984 | Frias |
| 4,453,872 | A | 6/1984 | Frias et al. |
| 4,494,899 | A | 1/1985 | Hoang et al. |
| 5,122,023 | A | 6/1992 | Mochizuki |
| 5,107,940 | A | 8/1992 | Berry |
| 5,451,129 | A | 9/1995 | Boyadjieff et al. |
| 6,079,925 | A | 6/2000 | Morgan et al. |
| 6,220,807 | B1 | 4/2001 | Sorokan |
| 6,533,519 | B1 | 3/2003 | Tolmon et al. |
| 6,609,573 | B1 | 8/2003 | Day |
| 6,695,559 | B1 | 2/2004 | Pietras |
| 6,705,414 | B2 | 3/2004 | Simpson et al. |
| 6,719,515 | B2 | 4/2004 | Tolmon et al. |
| 6,976,540 | B2 | 12/2005 | Berry |
| 6,994,505 | B2 | 2/2006 | Hawkins, III |
| 6,997,265 | B2 | 2/2006 | Berry |
| 7,021,880 | B2 | 4/2006 | Morelli et al. |
| 7,163,367 | B2 | 1/2007 | Handley |
| 7,404,697 | B2 | 7/2008 | Thompson |
| 7,431,550 | B2 | 10/2008 | Thompson |
| 7,762,343 | B2 | 7/2010 | Sonneveld et al. |
| 7,802,636 | B2 | 9/2010 | Childers et al. |
| 7,832,974 | B2 | 11/2010 | Fikowski et al. |
| 7,918,636 | B1 | 4/2011 | Orgeron |
| 7,967,540 | B2 | 6/2011 | Wright et al. |
| 7,992,646 | B2 | 8/2011 | Wright et al. |
| 8,052,368 | B2 | 11/2011 | Littlewood et al. |
| 8,079,796 | B2 | 12/2011 | Pietras |
| 8,186,455 | B2 | 5/2012 | Childers et al. |
| 8,210,279 | B2 | 7/2012 | Tarique |
| 8,215,887 | B2 | 7/2012 | Fikowski et al. |
| 8,469,085 | B2 | 6/2013 | Orgeron |
| 8,584,773 | B2 | 11/2013 | Childers et al. |
| 8,632,111 | B2 | 1/2014 | Krijnen et al. |
| 8,764,368 | B2 | 7/2014 | Crossley et al. |
| 2003/0123955 | A1 | 7/2003 | Eastcott |
| 2003/0159854 | A1 | 8/2003 | Simpson et al. |
| 2004/0136813 | A1 | 7/2004 | Pietras |
| 2004/0197166 | A1 | 10/2004 | Tolman et al. |
| 2005/0079044 | A1 | 4/2005 | Handley |
| 2005/0238463 | A1 | 10/2005 | Smith |
| 2006/0104746 | A1 | 5/2006 | Thompson |
| 2006/0124356 | A1 | 6/2006 | Gust et al. |
| 2006/0285941 | A1 | 12/2006 | Fikowski et al. |
| 2007/0221385 | A1 | 9/2007 | Braun et al. |
| 2009/0053013 | A1 | 2/2009 | Maltby |
| 2009/0136326 | A1 | 5/2009 | Angman |
| 2010/0135750 | A1 | 6/2010 | Tarique |
| 2010/0254784 | A1 | 10/2010 | Orgeron et al. |
| 2011/0030942 | A1 | 2/2011 | Orgeron |
| 2011/0044787 | A1 | 2/2011 | Fikowski et al. |
| 2011/0200412 | A1 | 8/2011 | Orgeron |
| 2012/0039688 | A1 | 2/2012 | Vince et al. |
| 2012/0118639 | A1 | 5/2012 | Gerber |
| 2012/0130537 | A1 | 5/2012 | Gerber |
| 2013/0341096 | A1 | 12/2013 | Flusche |
| 2014/0126979 | A1 | 5/2014 | Hill et al. |
| 2015/0008038 | A1 | 1/2015 | Folk |
| 2015/0139773 | A1 | 5/2015 | Nikiforuk |
| 2015/0184472 | A1 | 7/2015 | Miranda et al. |

FOREIGN PATENT DOCUMENTS

| | | | |
|---|---|---|---|
| EP | 1038088 | B1 | 4/2004 |
| EP | 1723306 | B1 | 11/2007 |
| EP | 2425090 | B1 | 6/2013 |
| GB | 1303618 | A | 1/1973 |
| GB | 2085047 | A | 4/1982 |
| GB | 2125862 | A | 9/1983 |
| GB | 2152111 | B | 7/1985 |
| GB | 2152112 | B | 7/1985 |
| GB | 2152113 | A | 7/1985 |
| GB | 2152115 | A | 7/1985 |
| GB | 8513524 | | 7/1985 |
| GB | 2152561 | B | 8/1985 |
| GB | 2158131 | B | 11/1985 |
| GB | 2162485 | A | 2/1986 |
| GB | 2351985 | A | 1/2001 |
| GB | 2462390 | A | 2/2010 |
| GB | 2442430 | B | 9/2010 |
| WO | 9929999 | A1 | 6/1999 |
| WO | 2005059299 | A1 | 6/2005 |
| WO | 2006059910 | A1 | 6/2006 |
| WO | 2009026205 | A2 | 2/2009 |
| WO | 2009055590 | A2 | 4/2009 |
| WO | 2011017471 | A2 | 2/2011 |
| WO | 2013169700 | A1 | 11/2013 |
| WO | 2013173459 | A1 | 11/2013 |
| WO | 2013191733 | A1 | 12/2013 |

PIPE HANDLING APPARATUS AND METHODS

TECHNICAL FIELD

This invention relates to subsurface drilling and specifically to apparatus and methods for presenting sections of drill string at a well center. The application has application, for example, in drilling into the earth to recover hydrocarbons.

BACKGROUND

Drilling into the earth, for example, to recover hydrocarbons is typically done with a drill rig. The drill rig is located at a well center from which a wellbore is extended into the earth using a rotating drill bit at the downhole end of a drill string. The drill string is made up of tubular sections that are coupled together. These sections are typically called 'tubulars' or 'pipe' or 'joints'.

During drilling, drilling fluid, often called 'mud' is pumped through a bore of the drill string. The drilling fluid exits at the drill bit and returns to the surface carrying cuttings from the drilling operation in an annulus surrounding the drill string. In addition to carrying the cuttings the drilling fluid may assist in keeping the wellbore open against subsurface pressures.

As the wellbore is extended, more tubulars are added at the uphole end of the drill string. The tubulars are most typically coupled together by threaded couplings. The thread dimensions and geometry can vary but are usually selected to be one of a number of standard threads specified by the American Petroleum Institute (API) in API specification 7-2 (ISO 10424).

In drilling it is sometimes necessary to remove the drill string from the wellbore or to introduce a drill string into a wellbore that has already been partially completed. This is called 'tripping'. Tripping may be done, for example, to replace a worn drill bit. Tripping can be done much more quickly than drilling.

Most drill rigs have floors that are elevated. The patent literature describes various pipe handling systems that can present an end of a tubular at the rig floor from where the tubular can be hoisted by equipment on the drill rig or that can carry a tubular away from the rig floor. These include the following patent publications: US 2004/0136813; US 2005/0079044; US 2005/0238463; US 2006/0124356; US 2009/0053013; US 2006/0104746; US 2006/0285941; U.S. Pat. No. 7,404,697; U.S. Pat. No. 7,163,367; U.S. Pat. No. 7,021,880; U.S. Pat. No. 6,994,505; U.S. Pat. No. 6,533,519; U.S. Pat. No. 6,079,925; U.S. Pat. No. 5,122,023; U.S. Pat. No. 4,403,898; U.S. Pat. No. 4,386,883; U.S. Pat. No. 4,382,738; U.S. Pat. No. 4,379,676; U.S. Pat. No. 4,347,028; U.S. Pat. No. 4,494,899; U.S. Pat. No. 4,235,566; U.S. Pat. No. 4,067,453; U.S. Pat. No. 3,655,071; U.S. Pat. No. 3,053,401; CA 2510137; WO 99/29999; US 2013/0341096; WO 2005/059299; WO 2013/191733; WO 2013/173459; WO 2013/169700; WO 2011/017471; WO 2009/026205; WO 2006/059910; WO 2009/055590; US 2015/0184472; US 2015/0139773; US 2015/0008038; US 2014/0126979; US 2012/0039688; US 2011/0200412; US 2011/0044787; US 2011/0030942; US 2010/0254784; US 2010/0135750; US 2009/0136326; US 2012/0130537; US 2012/0118639; US 2004/0197166; US 2003/0159854; US 2003/0123955; US 2007/0221385; U.S. Pat. No. 8,469,085; U.S. Pat. No. 8,215,887; U.S. Pat. No. 8,210,279; U.S. Pat. No. 8,186,455; U.S. Pat. No. 8,052,368; U.S. Pat. No. 7,992,646; U.S. Pat. No. 7,967,540; U.S. Pat. No. 8,764,368; U.S. Pat. No. 8,632,111; U.S. Pat. No. 8,584,773; U.S. Pat. No. 8,079,796; U.S. Pat. No. 7,802,636; U.S. Pat. No. 7,762,343; U.S. Pat. No. 7,431,550; U.S. Pat. No. 6,997,265; U.S. Pat. No. 7,918,636; U.S. Pat. No. 7,832,974; U.S. Pat. No. 6,705,414; U.S. Pat. No. 6,695,559; U.S. Pat. No. 6,609,573; U.S. Pat. No. 6,220,807; U.S. Pat. No. 5,451,129; U.S. Pat. No. 5,107,940; U.S. Pat. No. 6,976,540; U.S. Pat. No. 6,719,515; U.S. Pat. No. 4,439,091; U.S. Pat. No. 4,426,182; U.S. Pat. No. 4,365,692; U.S. Pat. No. 4,453,872; GB 2462390; GB 2442430; U.S. Pat. No. 4,040,524; U.S. Pat. No. 3,865,256; U.S. Pat. No. 3,065,865; U.S. Pat. No. 2,958,430; GB 8513524; GB 2152113; GB 2152112; GB 2152111; GB 2125862; GB 2085047; GB 2351985; GB 2162485; GB 2158131; GB 2152561; GB 2152115; GB 1303618; EP 1038088; EP 0061473; EP 2425090; and, EP 1723306.

Many of the prior art systems present the ends of tubulars near the edge of the drill rig floor. When the tubulars are hoisted by the drill rig, the tubulars can pendulum after their trailing ends are lifted free. Drill rig personnel often have the task of steadying the tubulars. This is physically challenging. Tubulars are heavy. Small 2⅜ inch diameter tubulars typically weight about 7 pounds per foot (about 10 kg/m). Larger 5 inch diameter tubulars typically weigh about 25 pounds per foot (about 37 kg/m). Larger drill collars can weigh 300 pounds per foot (about 443 kg/m) or more. This work is also potentially dangerous. Personnel are forced to work near the well center. The floor can be slippery as a result of spilled drilling mud. Drilling is sometimes performed in poor weather which increases the risk to drill rig personnel.

Drill rigs are extremely expensive to operate. It is therefore important to be able to quickly bring in additional tubulars to extend a drill string or to remove tubulars from the well center, especially while tripping.

Tubulars can have various lengths. A typical length is approximately 30 feet (about 10 meters). 'Range II' tubulars have lengths of about 31 feet. 'Range III' tubulars have lengths of about 46 feet. Each range has a tolerance. For example, Range III tubulars should have a minimum length of 42 feet and a maximum length of 48 feet. Equipment for handling tubulars in a particular length range ought to accommodate tubulars having any length between the minimum and maximum lengths specified for the range. Many drill rigs can accommodate sections of drill string up to about 90 feet long. Sometimes a number of tubulars may be coupled together in advance to yield a 'stand'. For example, three Range II tubulars may be coupled together to yield a 'triple'. As another example, two Range III tubulars may be coupled together to make a stand. Handling stands instead of individual tubulars can make the drilling operation (especially tripping) faster. However, stands are generally too long to conveniently transport on land.

There is a need for safe and efficient apparatus and methods for delivering tubulars to or from a drill rig. There is also a need for safe and efficient apparatus for building and unbuilding stands of tubulars.

SUMMARY

This invention has a number of aspects. While it is possible to apply these aspects in combination and there are synergies from applying these aspects in combination, these aspects are also capable of independent application. One aspect provides pipe handling apparatus that includes a live surface at least at an end that projects over a portion of the rig floor. Motion of the live surface may be controlled while tubulars are being hoisted to reduce or eliminate pendulum motion of tubulars. Another aspect provides a catwalk having a carriage configured to provide a reversible kink. An angle of the kink may be actively controlled. In some embodiments, a conveyor extends along the carriage and is operable with the catwalk straight or kinked in either direction. Another aspect provides apparatus for offline stand building and unbuilding. Another aspect provides methods for presenting tubulars to a drill rig. Other aspects combine two or more of the above. Embodiments of each of these aspects may have a wide range of details of construction. Elements that would be readily understood by those of skill in the art based on general knowledge and the present description and drawings have not been shown or described in detail to avoid unnecessarily obscuring the invention.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

Figure 1:
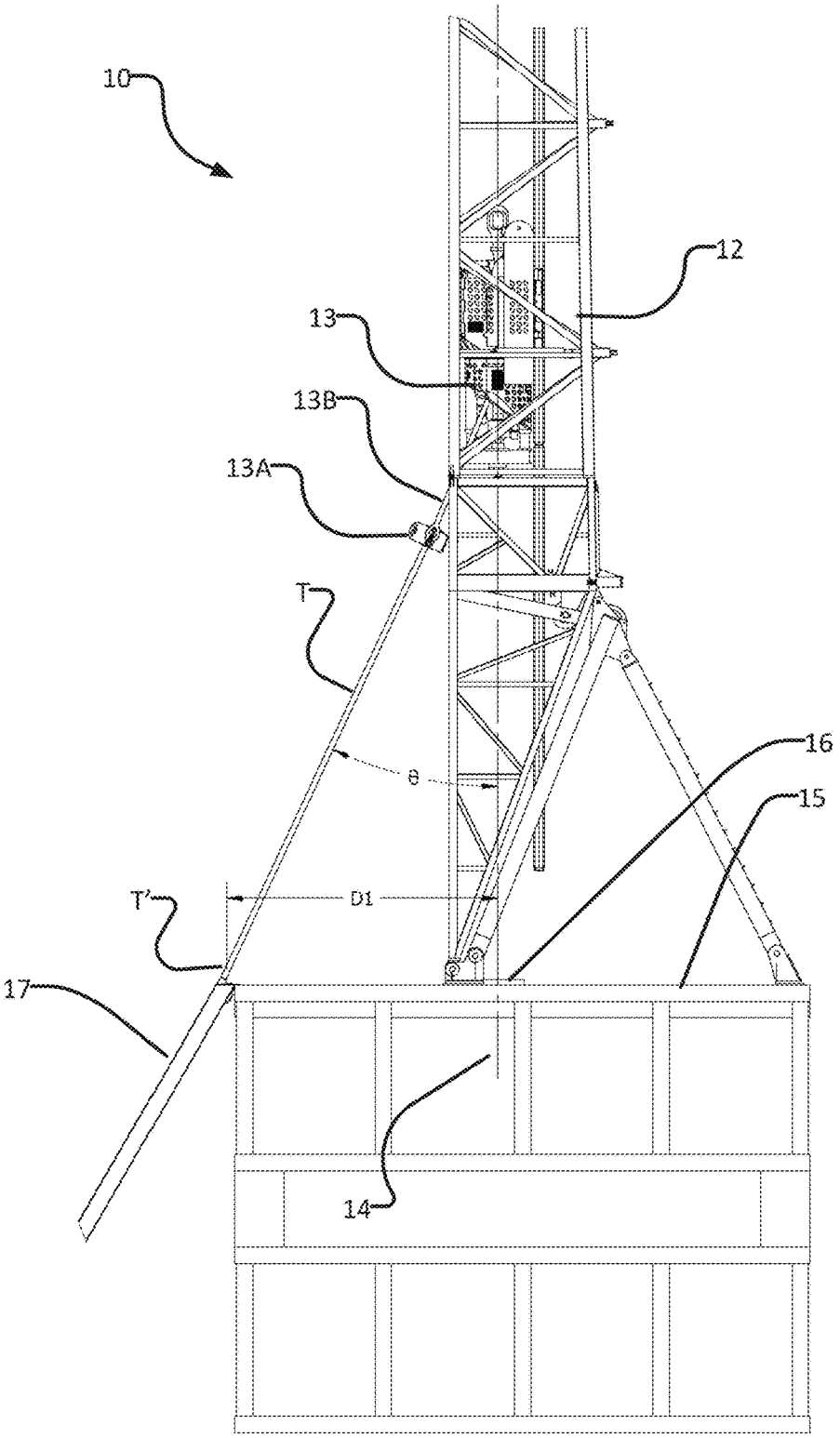
FIG. 1 (PRIOR ART)
FIG. 1 is a side elevation view of an example prior art drill rig and a prior art catwalk. This Figure illustrates the tendency of the tubular to pendulum as its trailing end leaves the catwalk.

LIST OF REFERENCES drill rig 10
diving board structure 10A
derrick 12
top drive 13
elevator 13A
elevator links 13B
well center 14.
drill rig floor 15
rotary table 16
pipe-handling catwalk system 17
tubulars T, T1, T2, T3
tail end of tubular T'
leading end of tubular T"
trough 17A
carriage 17B
apparatus 20
catwalk 21
catwalk base 22,
catwalk ramp 23
catwalk carriage 24
pipe rack 25
live surface 26
distance prior catwalk to well center D1
distance live surface to well center D2
carriage first section 24A
carriage second section 24B
pivotal joint 24C
carriage trough 24D
carriage front end 24E
backstop 26A
cantilevered backstop 26B
method for delivering tubular 40
block 41
block 42
block 43
block 44
block 44A
block 45
method for removing a tubular from a drill rig 50
block 51
block 52
block 52A
block 53
block 54
block 55
stand building/dismantling apparatus 60, 60A
make/break mechanism 61, 61A
mast 62
base 62A
stand building axis 63
backup jaw 64
opening in backup jaw 64A
gripping member 64B -continued secondary pipe retainer 64C
mechanism for bringing tubulars to backup jaws 65
carriage 66
carriage parts 66A and 66B
pivot axis 66C
chuck 67
pipe support structure 68
longitudinal opening 68A
top end of pipe support structure 68B
support 69
opening in support 69A
conveyor 70
conveyor segments 72
recessed central portion 72A
conveyor section edges 72B, 72C
conveyor chains 73
conveyor keels 74
transversely-projecting features 75
conveyor rails or guides 76
projections 77
apparatus 100
actuator for kink 166A, 166B
actuator for ramp 167
control system for stand builder 200
controller 201
control parameters/instructions 202
ramp tilt actuator 262
backup jaw grip actuator 264
secondary pipe retainer actuator 264C
kink actuator 266A
carriage position actuator 266B
tubular elevate actuator 266C
chuck rotation actuator 267A
pipe support rotate actuator 268
chuck position actuator 267B
live surface actuator 270
live surface control system 300
controller 301
control parameters and instructions 301
tail end camera 303
image processing 304
live surface pressure sensor(s) 306
tail end position sensors 308
top drive elevation signal 310
top drive link tilt signal 312
elevator load sensor 314
elevator camera 316
image processing 318
top end stick out sensor 320

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

FIG. 1 illustrates a drill rig 10. Drill rig 10 comprises a derrick 12 which supports a top drive 13 above a well center 14. Drill rig 10 comprises a floor 15 that is elevated above ground level. A rotary table 16 is commonly provided in floor 15 above well center 14.

FIG. 1 also shows a prior art pipe-handling catwalk system 17. Pipe handling system 17 is, for example, a Warrior™ extendable catwalk available from Warrior Manufacturing Services Ltd. of Calgary, Canada. Pipe handling system 17 elevates tubulars T and presents the ends of tubulars T near the edge of floor 15 of drill rig 10 from where the tubulars can be engaged by top drive 13 and elevated. Top drive 13 includes an elevator 13A that is configured to engage a tool joint on an end of tubular T. Elevator 13A is supported by links 13B. Links 13B may be tilted to the side, as shown so that elevator 13A can couple to the end of a tubular T that is off-axis with respect to well center 14.

In FIG. 1 a tubular T which has been lifted to the point that its tail end T' is just about able to slide clear of pipe handling system 17. It can be seen from FIG. 1 that tubular T is at an angle θ to the vertical because top drive 13 is located directly over well center 14 while the tail end of tubular T is a horizontal distance D1 from well center 14. D1 is often 10 to 15 feet (about 3 to 5 meters) or more. Tubular T will therefore tend to swing or 'pendulum' toward well center 14 as soon as it has been lifted high enough that its tail end can slide off of pipe handling system 17. This swinging must be controlled. At least for land-based drill rigs drilling with smaller diameters of tubulars it is generally the responsibility of personnel working on rig floor 15 to control the swinging of tubular T and to stabilize the tubular T over well center 14 so that it can be stabbed into a coupling at the top end of the drill string. This is physically demanding and potentially dangerous work, especially when weather is poor.

Figure 2:
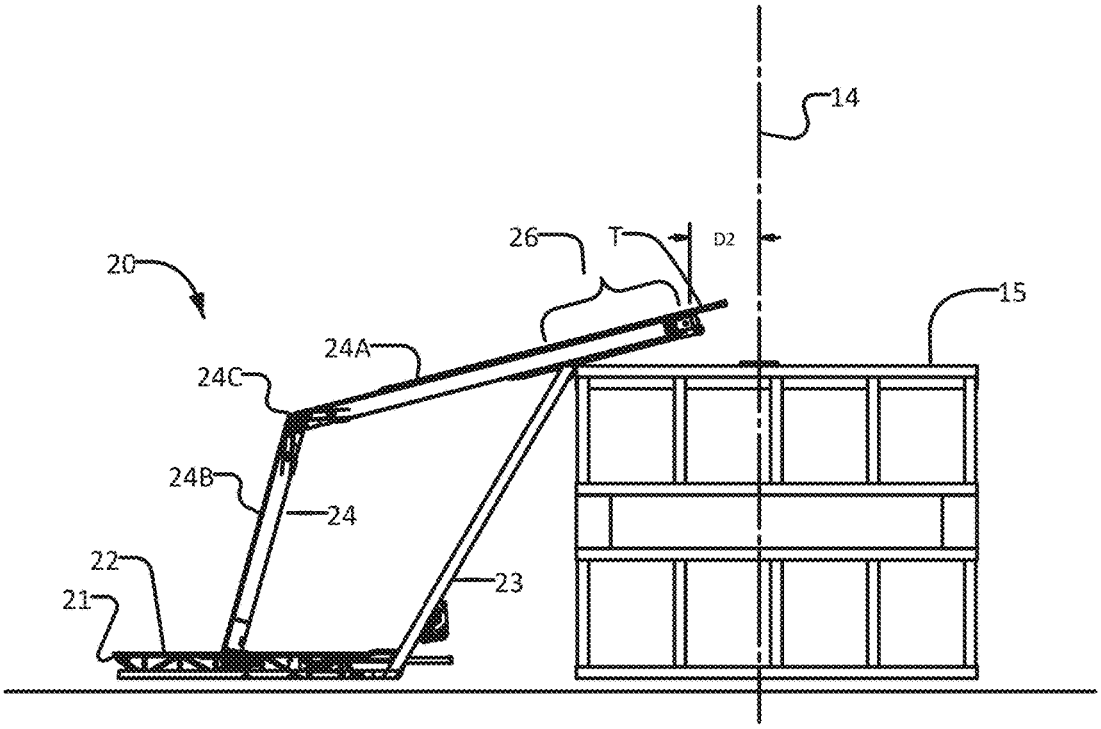
FIG. 2 is a schematic elevation view of a drill rig and a pipe handling apparatus according to an example embodiment of the invention.
Figure 2A:
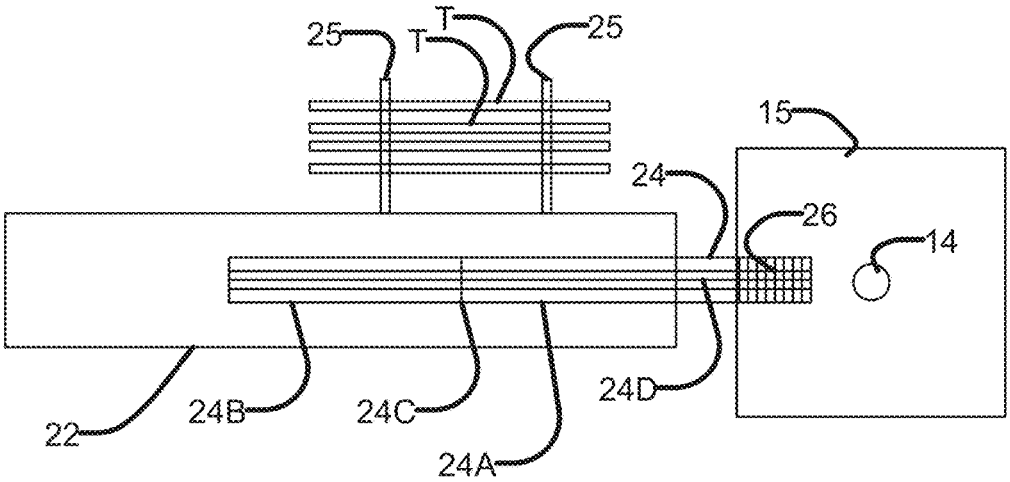
FIG. 2A is a top view of the drill rig and pipe handling apparatus of FIG. 2.

FIG. 2 shows the floor 15 of a drill rig 10 in combination with apparatus 20 according to one example embodiment of the invention. FIG. 2A provides a schematic top view of an example embodiment of apparatus 20. Apparatus 20 comprises a catwalk 21 comprising a carriage 24 that is configured to elevate tubulars T from a pipe rack 25 and to present the tubulars T at rig floor 15. A feature of apparatus 20 is the provision of a live surface 26 which supports the tail end of a tubular T at least in the period during which the tail end of tubular T is approaching the point at which it will leave pipe handling system 20.

Live surface 26 may, for example, be provided by a conveyor (which may be but is not necessarily provided by an endless loop), a sliding plate, a series of rollers, a pair of conveyors facing one another on either side of a gap through which the tail end of a tubular T can pass or the like. As described below, live surface 26 may be operated to control movement of the tail end of tubular T up to the point where the tail end of tubular T leaves pipe handling system 20. This control may be applied to reduce or substantially eliminate swinging of the tubular.

Live surface 26 may also or in the alternative be used to draw the tail ends of tubulars away from well center 14 as the tubulars are being removed from drill rig 10.

In the embodiment illustrated in FIGS. 2 and 2A, which is non-limiting, catwalk 21 comprises a base 22, a ramp 23 and a carriage 24. Carriage 24 comprises a first section 24A pivotally mounted to a second section 24B at a pivotal joint 24C.

In some embodiments, live surface 26 extends along a working length of carriage 24. For example, live surface 26 may be provided by a conveyor that extends all along the working length of the carriage (where the 'working length' of the carriage is that portion of a carriage that supports any part of a tubular in normal operation). In some embodiments live surface 26 is a shorter surface located near the point where the tail end of a tubular leaves pipe handling system 20 (i.e. at the end of the carriage that is closest to well center 14).

In some embodiments carriage 24 comprises two sections pivotally coupled to one another such that the carriage may be kinked. In some such embodiments live surface 26 extends along both sections of the carriage. In some such embodiments live surface 26 comprises an endless conveyor that extends along both sections of the carriage and is operable with the carriage kinked. In other embodiments live surface 26 may extend along all or a part of first section 24A only.

Another feature of apparatus 20 in the illustrated embodiment is that live surface 26 extends to a location that is spaced apart horizontally from well center 14 by a distance D2 which is smaller than is typical with prior art pipe handling systems of the type illustrated in FIG. 1. Presenting the tail end of tubulars T relatively close horizontally to well center 14 tends to further reduce the tendency of tubulars to swing when they are released from pipe handling system 20. In some embodiments, D2 is within a range of elevator link tilt of top drive 13 such that the top drive can hold tubular T vertical with the tail end of tubular T supported by live surface 26. In some embodiments, D2 is in the range of 3 feet to 6 feet (about 1 m to 2 m). In some example embodiments D2 is less than 8 feet (about 2½ meters). D2 may be made as small as desired as long as enough space is available to lower the tubular T past the end of live surface 26 when the tubular T is on well center. In some embodiments D2 is very small (e.g. less than 4 feet) such that the tendency of tubulars T to swing as the tail ends of the tubulars come off of live surface 26 may be substantially eliminated.

A pipe rack 25 (see FIG. 2A) extends alongside carriage 24 on one side of carriage 24. Pipe racks 25 may optionally be provided on both sides of carriage 24. Pipe rack 25 holds a number of tubulars T. An indexing mechanism (not shown in detail) can release one tubular T at a time from rack 25 onto carriage 24 or return a tubular T from carriage 24 to rack 25. The indexing mechanism may, for example, comprise a set of kickers and indexers.

Carriage 24 is configured in such a manner that tubulars placed on its upper surface do not tend to roll off of the upper surface. In the illustrated embodiment, carriage 24 has a trough 24D extending longitudinally along it. Tubulars T are located by trough 24D when they are loaded onto carriage 24. In some embodiments trough 24D is formed in a surface of a conveyor which also provides a live surface 26 extending along carriage 24.

Figures 3A, 3H:
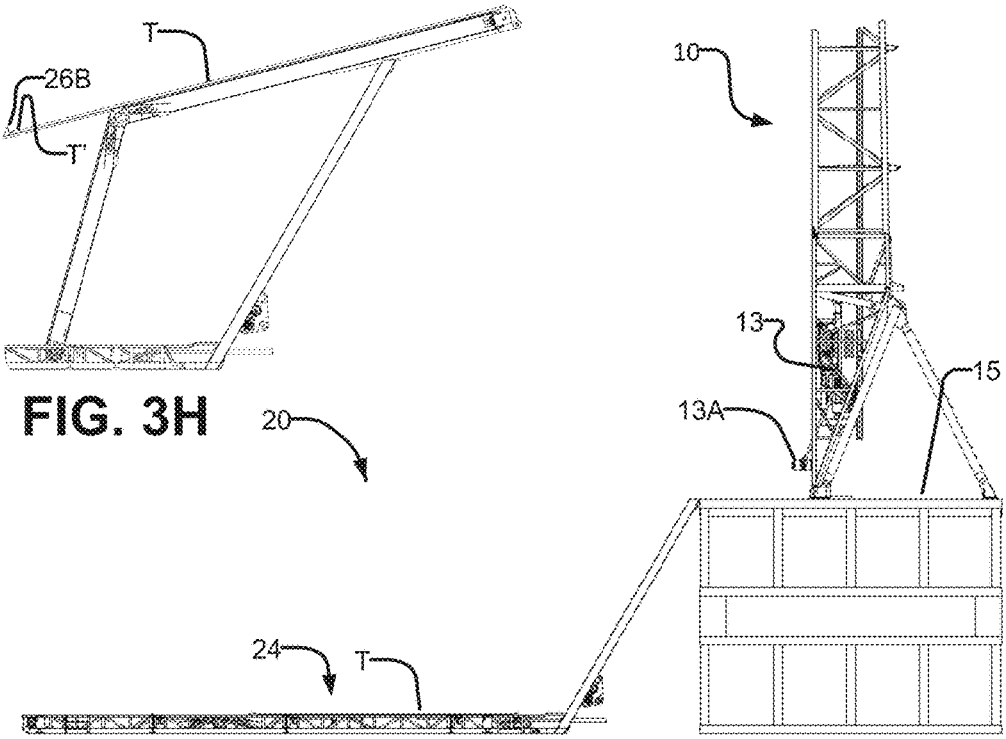
FIGS. 3A to 3G are schematic elevation views showing stages in the operation of pipe handling apparatus similar to that shown in FIGS. 2 and 2A as a tubular is lifted to the level of the rig floor and then hoisted.
FIG. 3H is a side elevation view of apparatus including a cantilevered backstop.

FIGS. 3A to 3G illustrate phases of operation of pipe handling system 20. In FIG. 3A, a tubular T is loaded onto carriage 24 (e.g. from pipe rack 25). Tubular T locates itself in trough 24D. Carriage 24 is then advanced along base 22. The front end 24E of carriage 24 rides up ramp 23 as carriage 24 is advanced (see FIG. 3B).

Figure 3B:
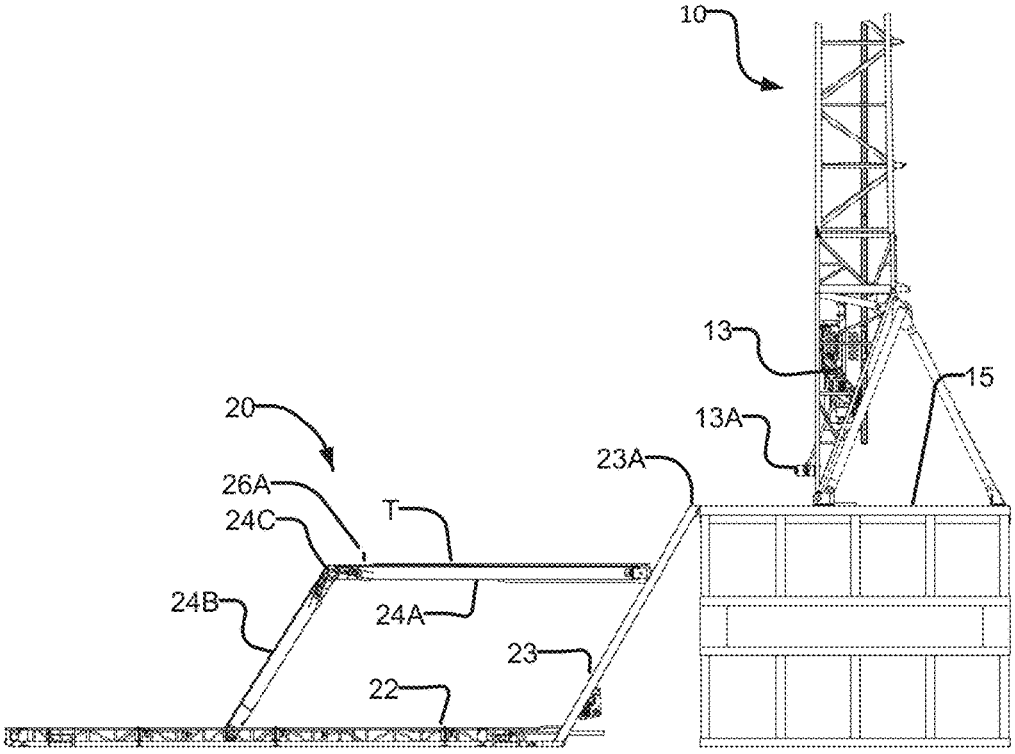

As illustrated in FIG. 3B, carriage 24 may be caused to bend at pivotal connection 24C as carriage 24 is advanced. This kinking of carriage 24 serves to elevate first section 24A of carriage 24 and also maintains first section 24A more nearly horizontal than it would otherwise be.

Figure 3C:
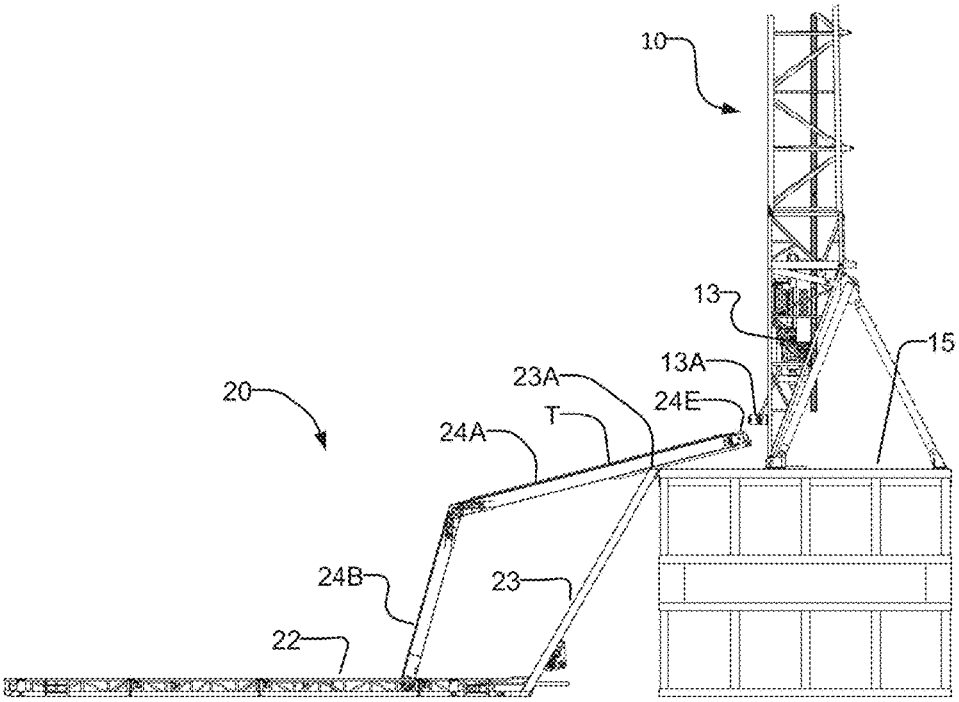

FIG. 3B shows the configuration of carriage 24 when its leading end 24E is nearing the top of ramp 23. FIG. 3C shows a configuration of carriage 24 when leading end 24E has passed over the top end 23A of ramp 23 and the top end 23A of ramp 23 supports first section 24A. The top end 23A of ramp 23 may act as a fulcrum or pivot for first section 24A.

If tubular T is initially supported in part on carriage section 24B then, at a suitable point, tubular T may be advanced until its tail end is past pivotal joint 24C as shown in FIG. 3B. In some embodiments, tubular T may be advanced by a backstop 26A which is driven by any suitable actuator to advance tubular T along carriage 24. In some embodiments, in which live surface 26 extends the entire working length of carriage 24, a backstop 26A may be provided on live surface 26. In some embodiments backstop 26A is supported on a skate which can be driven along carriage 24 at least far enough to position tubular T onto first section 24A. Where live surface 26 extends far enough along carriage 24, tubular T may be advanced by operating live surface 26.

In some embodiments a tubular is advanced by a backstop until a leading end of the tubular projects past leading end 24E of carriage 24 to hit a stop surface (which may, for example, comprise a surface fixed on ramp 23). This may be done with carriage 24 in the configuration shown in FIG. 3A. The stop surface may be used to repeatably position tubulars. Also, since the location of the top surface is known, some embodiments determine a position of a backstop relative to the stop surface and use this information to measure a length of the tubular.

In some embodiments a backstop is of a type that receives or otherwise engages an end of a tubular. A stop surface as described above may be used to hold the tubular still so that it can be fully engaged with a backstop. Various backstop embodiments are possible. In one embodiment a backstop comprises a simple plate that can engage an end of a tubular. In another embodiment a backstop comprises a projection that can be inserted into a bore of a tubular (see e.g. backstop 67A in FIG. 10F). In another embodiment a backstop comprises a mechanism such as a chuck for gripping an end of the tubular.

In some cases a tubular may be significantly longer than first section 24A of carriage 24. In such cases a backstop may be supported on an arm or arms which position the backstop rearward (i.e. toward second section 24B) from the trailing end of first section 24. For example, in a case where first section 24A has a length of approximately 35 feet (about 11 meters) and is being used to deliver Range III tubulars having lengths of about 45 feet (roughly 14 Meters) then a trailing end of the tubular may extend a few meters behind the trailing end of first section 24A. A cantilevered backstop may be provided to provide positive control over the trailing end of the tubular. FIG. 3H shows an example cantilevered backstop 26B.

In the configuration shown in FIG. 3C, leading end 24E of carriage 24 may project well inward toward well center 14 from the edge of floor 15 of drill rig 10. In some embodiments leading end 24E of carriage 24 is close enough to well center 14 that by operating a link tilt of top drive 13, elevator 13A may be horizontally aligned over an end portion of carriage 24 such that elevator 13A can hold a tubular T vertically with the trailing end of the tubular T resting on carriage 24 (as shown, for example in FIG. 3G).

Figure 3D:
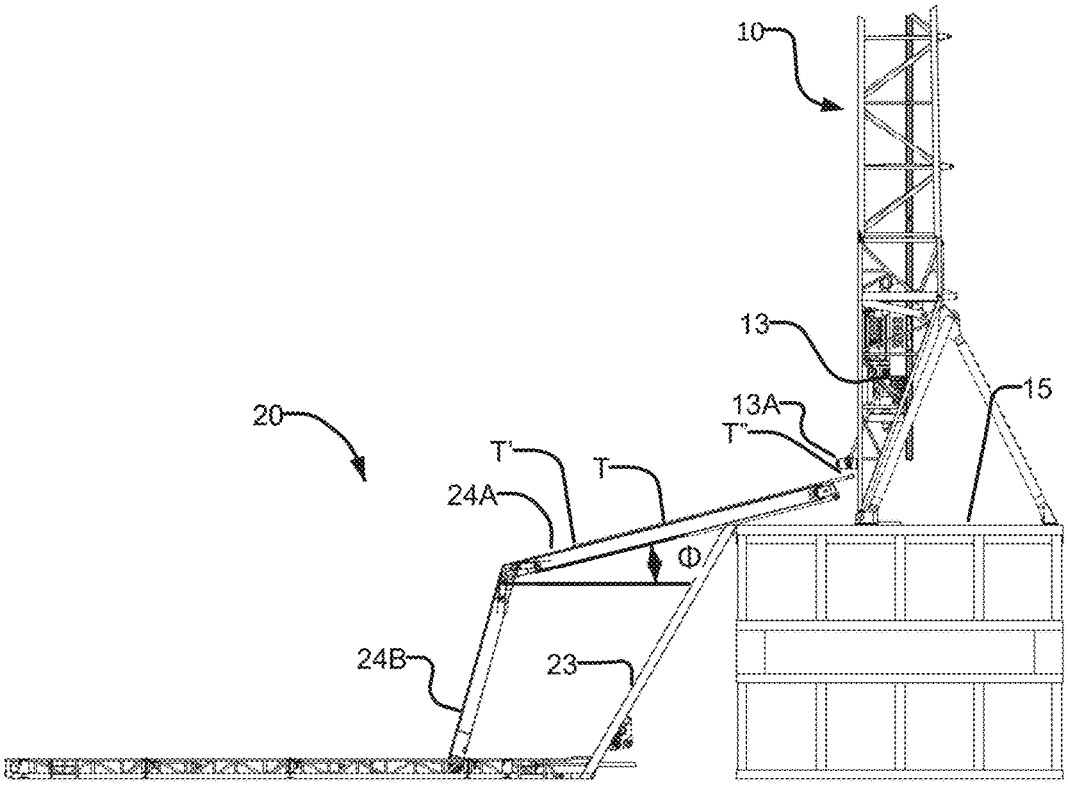

As shown in FIG. 3D, tubular T may be advanced (e.g. by operating live surface 26 and/or by pushing with a backstop 26A) so that the leading end T" of tubular T projects a bit past leading end 24E of carriage 24. This facilitates engaging the tool joint at the leading end T" of tubular T with elevator 13A as shown in FIG. 3E.

Advantageously, first section 24A may be horizontal or nearly horizontal when carriage 24 is in the configuration of FIGS. 3C to 3G. In some embodiments it is advantageous for first section 24A to be inclined at a shallow presentation angle (e.g. an angle of 20 degrees or less to horizontal such as an angle of 15 degrees to horizontal) when carriage 24 is in the configuration of FIGS. 3C to 3E as this can help to improve control of the tail end of a tubular as the tubular is being hoisted.

Figure 3E:
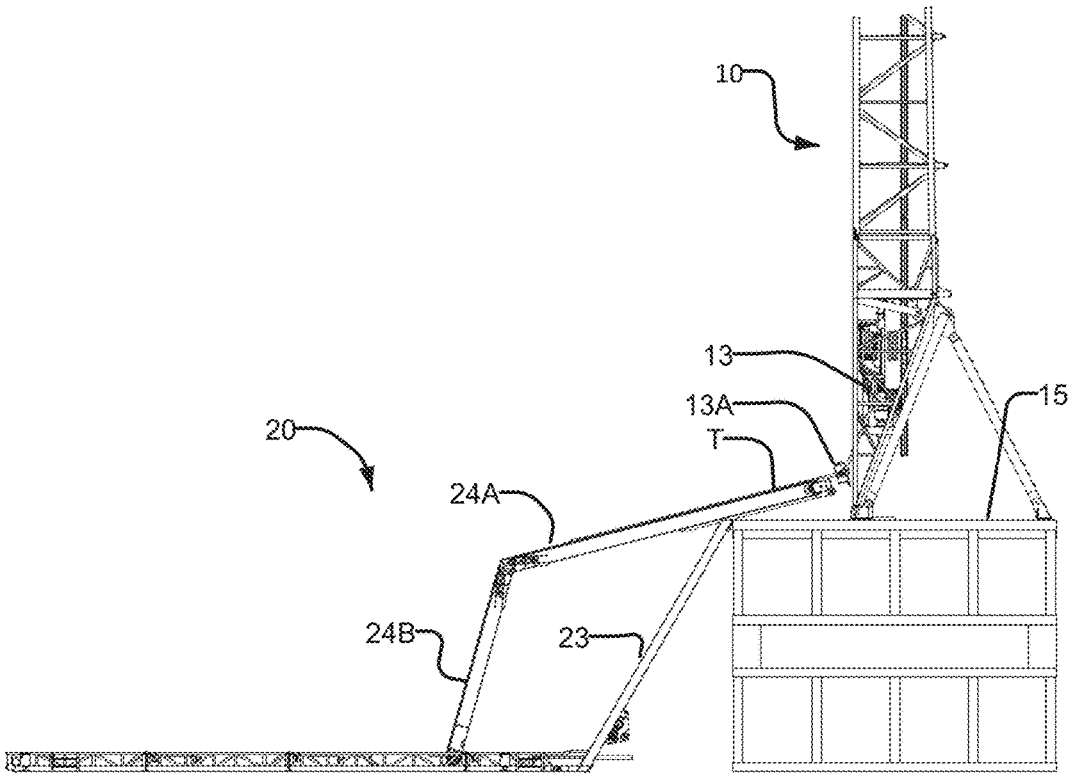
Figure 3F:
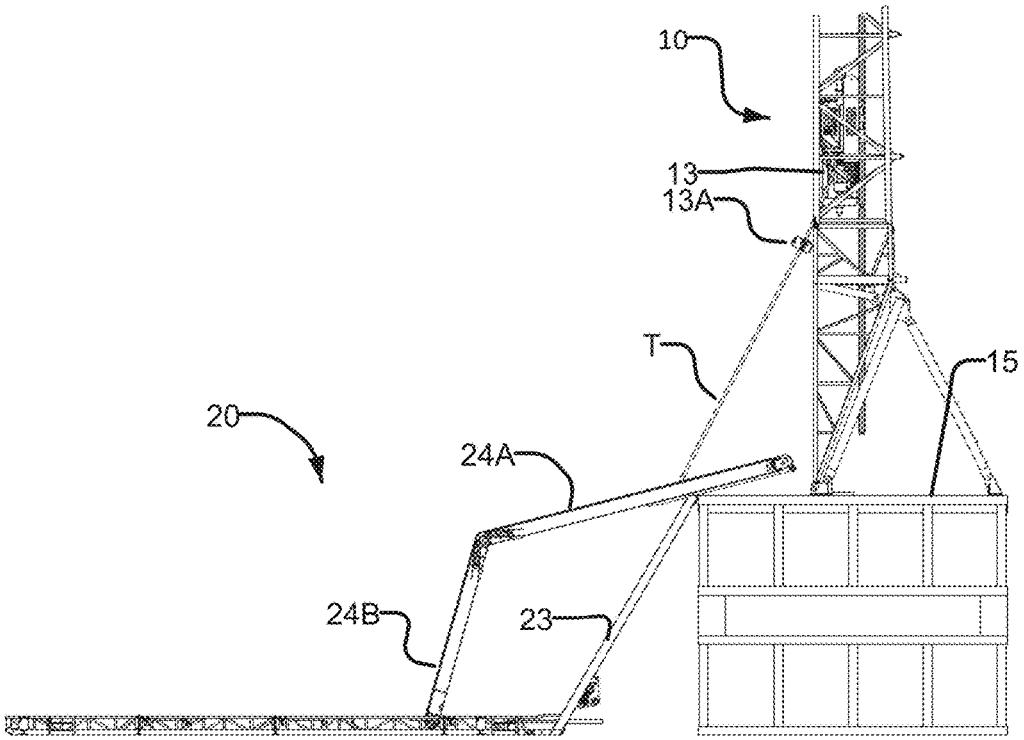
Figure 3G:
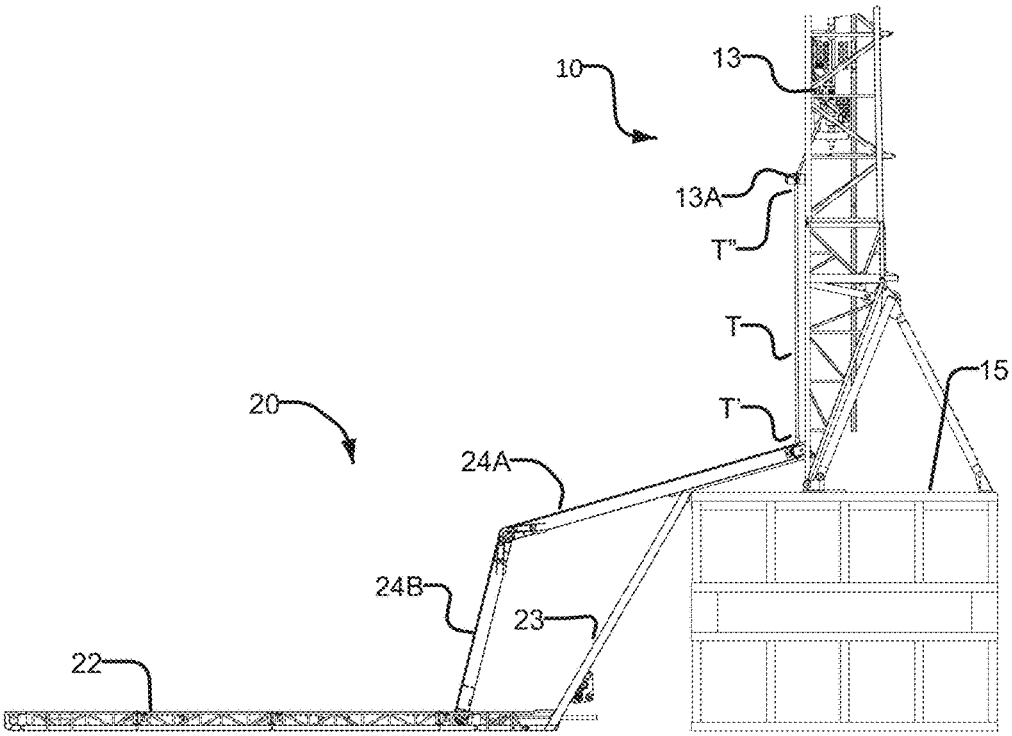

FIGS. 3E through 3G illustrate transfer of a tubular T from carriage 24 to drill rig 10. In FIG. 3E, the presented end of tubular T is grasped by top drive 13. With leading end T" engaged by elevator 13, tubular T can be hoisted as shown in FIG. 3F until it is vertical or nearly vertical as shown in FIG. 3G. FIG. 3F shows an intermediate stage in lifting. FIG. 3G shows the configuration of tubular T when it has been lifted nearly to the point where it is fully supported by top drive 13. In this stage, the tail end of tubular T rests on live surface 26.

The motion of live surface 26 toward the leading end 24E of carriage 24 is controlled as tubular T is hoisted. For example, live surface 26 may be driven by a variable-speed actuator such that an operator or an automated controller can control the motion of the tail end of tubular T. The tail end of tubular T is prevented from sliding off the leading end of carriage 24 until tubular T is either vertical or nearly vertical. The velocity of the tail end of tubular T may be controlled such that tubular T has either no horizontal velocity or only very small horizontal velocity at the time that it leaves carriage 24.

In some embodiments the angle formed between first and second sections 24A, 24B is directly controlled by an actuator and the presentation angle θ (see FIG. 3D) is directly controllable by adjusting the actuator. The actuator may, for example, comprise one or more of: motor with a suitable reduction system, linear actuators (e.g. hydraulic cylinder, pneumatic cylinder, screw drive or electrically powered linear actuator) coupled to act on sections 24A and 24B and operable to positively set an angle between first and second sections 24A, 24B within a desired angular range. In some embodiments the angular range includes both positive kink angles (the angle makes the top side of the carriage convex—e.g. form a reflex angle—at the connection 24C between sections 24A and 24B) and negative kink angles (the angle makes the top side of the carriage concave—e.g. form an obtuse angle—at the connection 24C between sections 24A and 24B).

In some alternative embodiments the angle formed between sections 24A and 24B of carriage 24 is controlled indirectly by controlling the positions of the outer ends of sections 24A and 24B.

To facilitate control over the position and speed of the tail end of a tubular, live surface 26 may include features to reduce or prevent slippage of the tail end T' of the tubular along live surface 26. For example, live surface 26 could include bars or other raised projections, recesses shaped to receive the tail end of tubular T, elastomeric coatings or pads, or the like. Live surface 26 may additionally or in the alternative carry a backstop of any of the types described herein.

Although the embodiment illustrated in FIGS. 2 and 3A to 3G support live surface 26 on a carriage 24 that has certain functionality as described above, a live surface 26 may be supported in other ways that position the live surface 26 in a position to control the motion of a tail end T' of a tubular that is being hoisted or lowered as described herein. For example, in alternative embodiments a live surface 26 may be supported by a structure attached to a drill rig floor 15 or otherwise supported on the drill rig 10. In such embodiments, separate apparatus may be provided to supply tubulars T to the drill rig.

Figure 4:
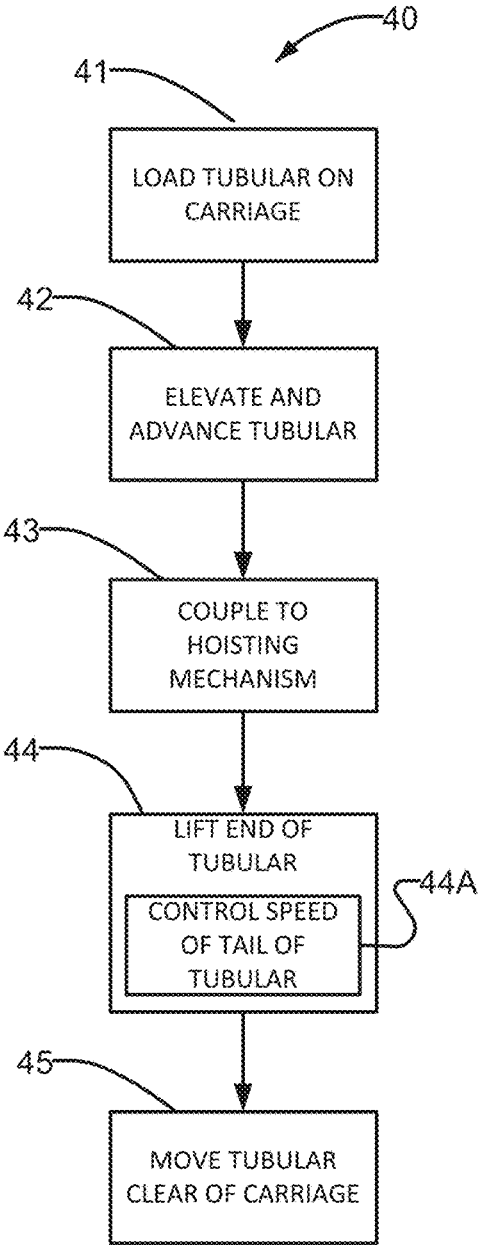
FIG. 4 is a flow chart showing steps in a method for delivering a tubular to a drill rig.

FIG. 4 is a flow chart showing steps in a method 40 according to an example embodiment of the invention. Method 40 delivers a tubular to a drill rig 10. In block 41, the tubular is loaded on to a carriage 24 (e.g. from a pipe rack 25). In block 42, the tubular is elevated and advanced until one end of the tubular projects over the floor of a drill rig (for example, floor 15 of drill rig 10). In block 43, the presented end of tubular T is coupled to a hoisting mechanism (for example, an elevator 13A on a top drive 13) of the drill rig.

In block 44, the leading end T" of the tubular T is lifted. As tubular T is lifted, the tail end of tubular T moves along carriage 24. For all or a portion of block 44, the tail end of tubular T is engaged by a live surface 26 which regulates the progress of the tail end of tubular T along carriage 24. For example, the tail end of tubular T may rest on a moving conveyor. In block 44A, the speed of the tail end of tubular T is controlled. In block 45, the tail end of tubular T is moved clear of the leading end 24E of carriage 24. At this point, tubular T may be coupled into the drill string projecting from well center 14.

In some embodiments block 44A comprises, during a first period moving the tail end T' of tubular T toward well center 14 faster than tail end T' would move if it were being dragged as a result of leading end T" being hoisted. This pushes tubular T upward and creates some slack between elevator 13A and the leading end T" of tubular T. Then, during a subsequent second period live surface may slow the motion of tail end T' of tubular T. The second period may occur when tubular T is nearly vertical. This sequence may result in tubular T having zero or only a very small angular velocity when elevator 13A catches up and lifts tubular T vertically off of carriage 24.

Method 40 may be reversed to remove a tubular T from the drill rig. In this case, the live surface of carriage 24 may be operated to draw the tail end of tubular T away from well center 14 as tubular T is lowered by a hoisting mechanism of the drill rig onto carriage 24. In some embodiments the live surface of carriage 24 comprises a backstop and the tail end of tubular T is placed on the live surface adjacent to the backstop. The backstop may prevent the tail end of tubular T from sliding along the live surface.

Figure 5:
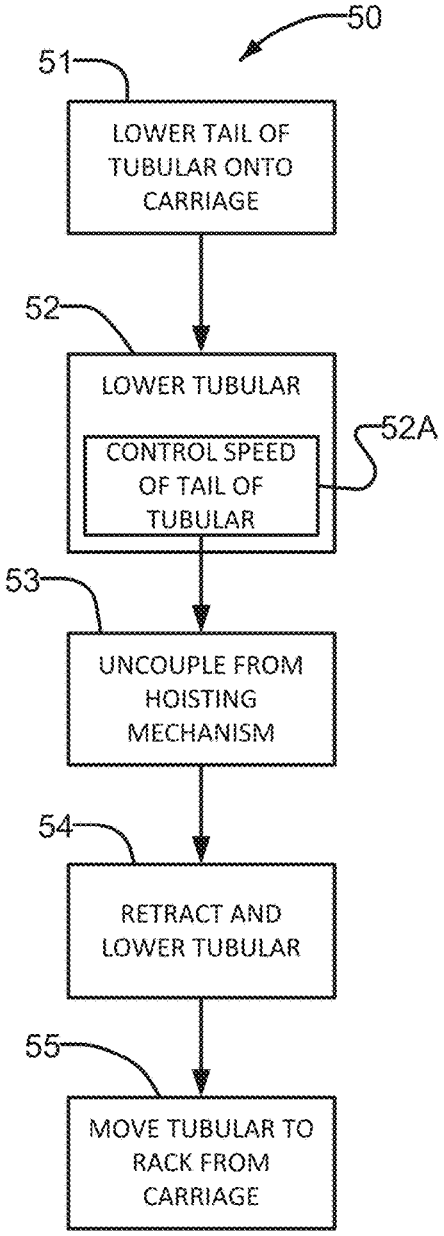
FIG. 5 is a flow chart showing steps in a method for removing tubulars from a drill rig.

FIG. 5 is a flowchart illustrating steps in an example method 50 for removing a tubular from a drill rig. Method 50 is essentially the reverse of method 40. One difference can be that the speed at which live surface 26 is operated may be selected to be higher when tubulars are being removed from a drill rig than when tubulars are being supplied to the drill rig.

A pipe handling system as described above may be used with single tubulars or with stands made of two or more tubulars. For example, the pipe handling system may operate to present triples to a drill rig. In some other embodiments, the pipe handling system may be used to present doubles made up of two tubulars to the drill rig. In some embodiments the doubles are doubles of Range III tubulars such that the doubles have a length of approximately 90 feet.

In cases where it is desired to provide pipe stands to a drill rig which are each made up of a number of tubulars, it can be desirable to store some or all of the tubulars individually (and not in the form of assembled stands). This is particularly the case in land-based drilling where stands may be too long to transport conveniently from one drill site to another. Furthermore, where a wellbore is very deep the number of stands required may exceed the storage capacity for assembled stands in a setback of the drill rig or other available racks for storing stands.

Whatever the motivation, if tubulars are to be stored individually, for example, in pipe racks, and yet presented to a drill rig in the form of stands, there is a need for a mechanism operable to combine two or more tubulars into a stand prior to presenting the stand to the drill rig and to dismantle the stand into individual tubulars when that stand is removed from the drill rig. Preferably, all couplings between tubulars in the stand are fully torqued when the stand is presented to the drill rig.

Ideally, stand building should be accomplished quickly enough that it can keep up or essentially keep up with operation of the drill rig while drilling. That is, the time taken to make up a stand should be no longer than the interval between the time that a drill rig accepts one stand and a time that the drill rig is ready to accept the next stand. Assembled stands may be stored in racks when tripping a drill string in or out. If the racks do not have enough capacity to contain the required number of stands then some stands may be assembled or dismantled to augment the capacity of the available storage for assembled stands. As an example, when tripping out every third stand (in general every $N^{th}$ stand) may be dismantled while the remaining stands are placed in a setback area of the drill rig. One out of each N stands may be assembled from individual tubulars while tripping in. This reduces the number of stands that require storage and yet does not require stands to be assembled or dismantled at a rate fast enough to keep up with tripping of the drill string.

It is advantageous for stands to be presented to a drill rig at an angle that is inclined to the vertical. Preferably the stands are presented at an angle in the range of 5 to 25 degrees, more preferably 8 to 20 degrees, most preferably 12 to 18 degrees from vertical. If the angle is too large (stand is more horizontal) then the stand may project too low over the drill rig floor while it is being assembled. This may interfere with operation of the drill rig. If the angle is too small (stand is more vertical) then it may be difficult to couple to the stand and also stand building may occur undesirably close to the activity at well center.

Figure 6:
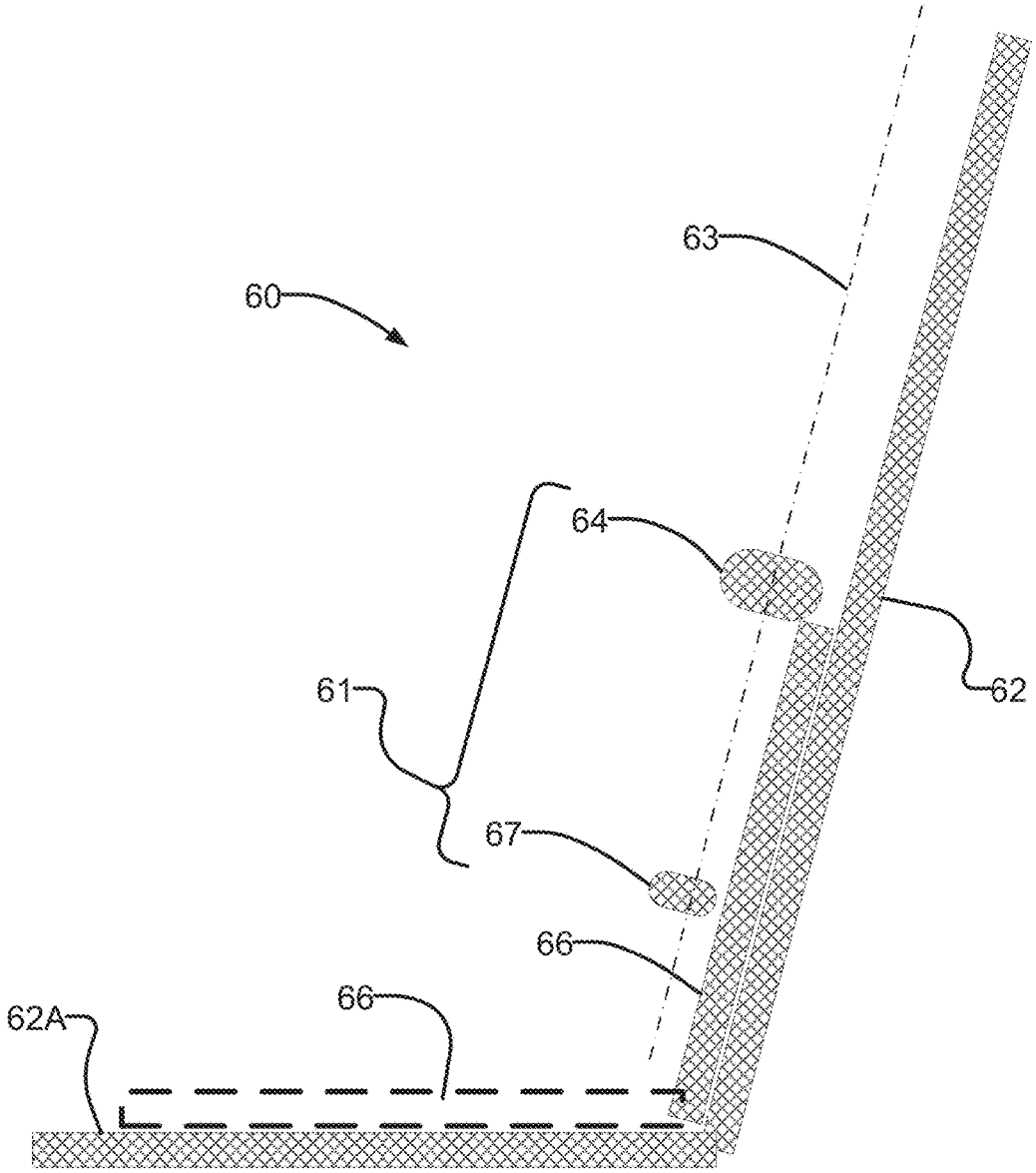
FIG. 6 is a schematic drawing showing a stand building apparatus according to an example embodiment.

FIG. 6 illustrates an apparatus 60 that may be applied to build pipe stands and to dismantle pipe stands. Apparatus 60 has a number of novel features that may be combined in a single apparatus, as illustrated. These features may be used individually or in subcombinations in other embodiments. A pipe stand building apparatus 60 as indicated schematically in FIG. 6 may be combined with a pipe handling apparatus as described above (e.g. a pipe handling apparatus like pipe handling system 20) but these apparatus also have separate application.

Stand building apparatus 60 comprises a mast 62 which provides an inclined axis 63 along which a pipe stand can be built. In this respect, apparatus 60 is similar to the pipe stand building apparatus described in U.S. patent application Ser. No. 13/573,878 filed on 11 Oct. 2012 and entitled PORTABLE PIPE HANDLING SYSTEM. In some embodiments axis 63 is inclined at an angle of 5 to 25 or 10 to 20 or 12 to 18 degrees to vertical.

Apparatus 60 includes a make/break mechanism 61 operable for coupling and uncoupling tubulars from one another while the tubulars are held aligned with stand building axis 63. In the illustrated embodiment make/break mechanism 61 comprises a backup jaw 64, which may be actuated to hold a tubular against rotation. Backup jaw 64 is located part way up mast 62. Backup jaw 64 may, for example, comprise a plurality of actuators which may be operated to firmly grip a tubular.

A mechanism 65 is provided for bringing tubulars to backup jaw 64. In the illustrated embodiment, mechanism 65 comprises a carriage 66. Carriage 66 is movable on a base 62A relative to mast 62 between a first position (shown in dotted lines) in which it can receive a tubular from a tubular storage area (not shown in FIG. 6—a pipe rack 25 may, for example be provided as described above) and a second position (as shown in solid lines in FIG. 6) in which it is aligned parallel to axis 63. A chuck 67 is mounted to carriage 66. Chuck 67 is movable along carriage 66 by means of an actuator. In some embodiments carriage 66 comprises a live surface (e.g. a conveyor) and chuck 67 is carried on the live surface. Chuck 67 and backup jaw 64 together provide an example make/break mechanism 61.

FIGS. 7A through 7H illustrate steps in the assembly of a stand comprising three tubulars using apparatus like apparatus 60. In the embodiment illustrated in FIGS. 7A to 7H, carriage 66 comprises first and sections 66A and 66B pivotally coupled to one another at coupling 66C. This is not mandatory however. Some embodiments use carriages that do not flex or other mechanisms for delivering tubulars to make/break mechanism 61.

Figure 7A:
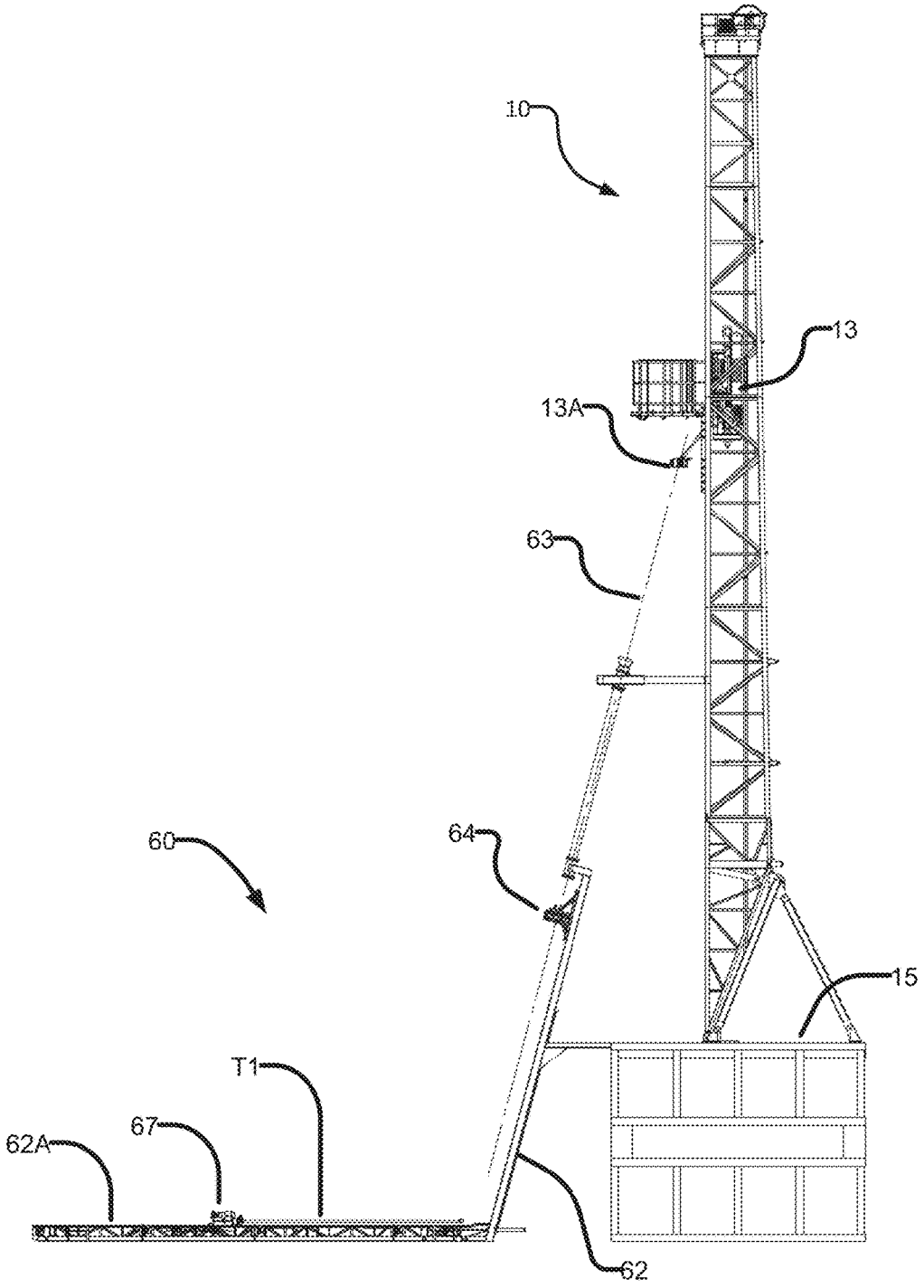
FIGS. 7A through 7H are schematic side elevation drawings illustrating stages in building a stand from a plurality of tubulars.
Figure 7B:
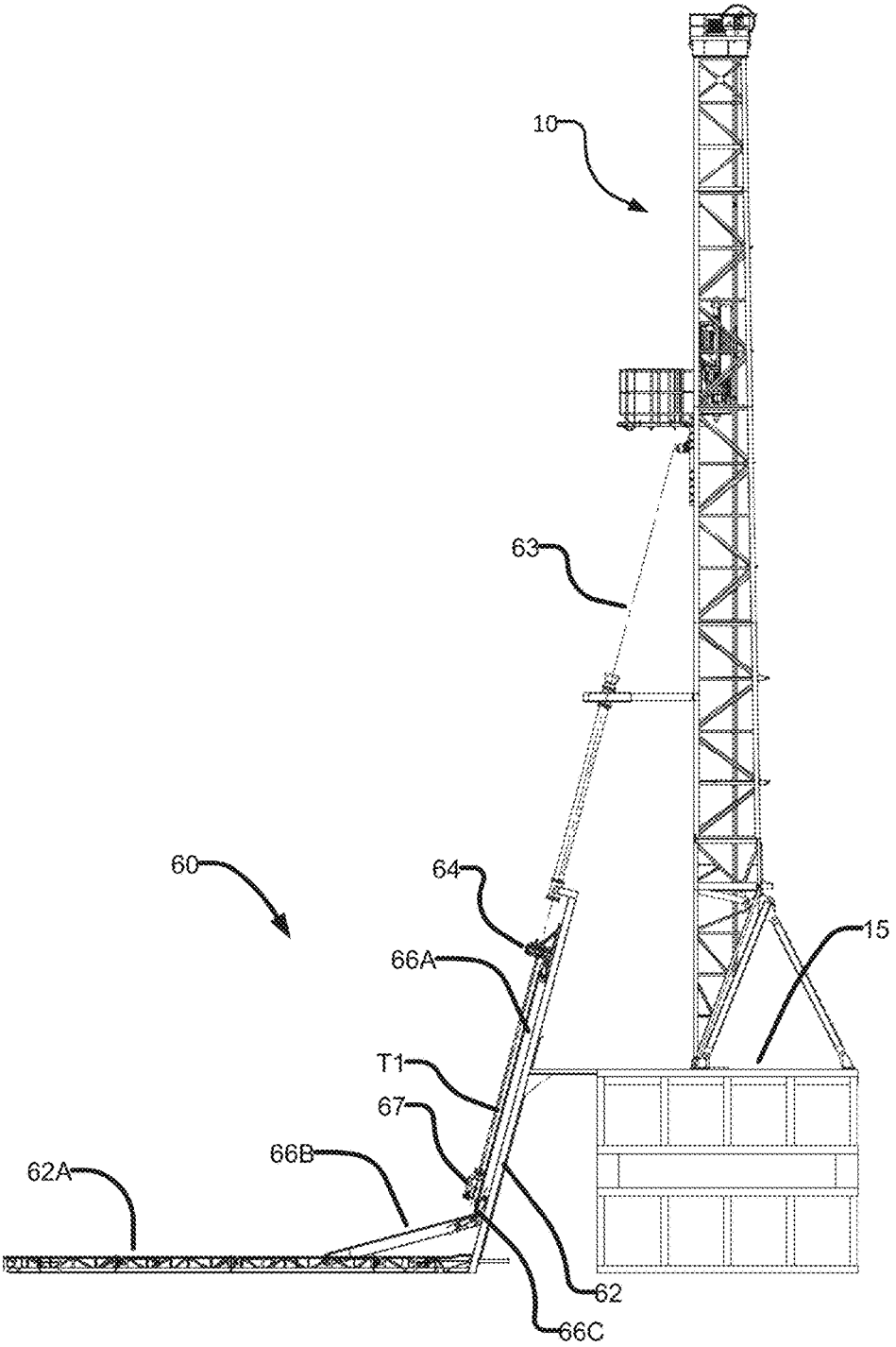
Figure 7C:
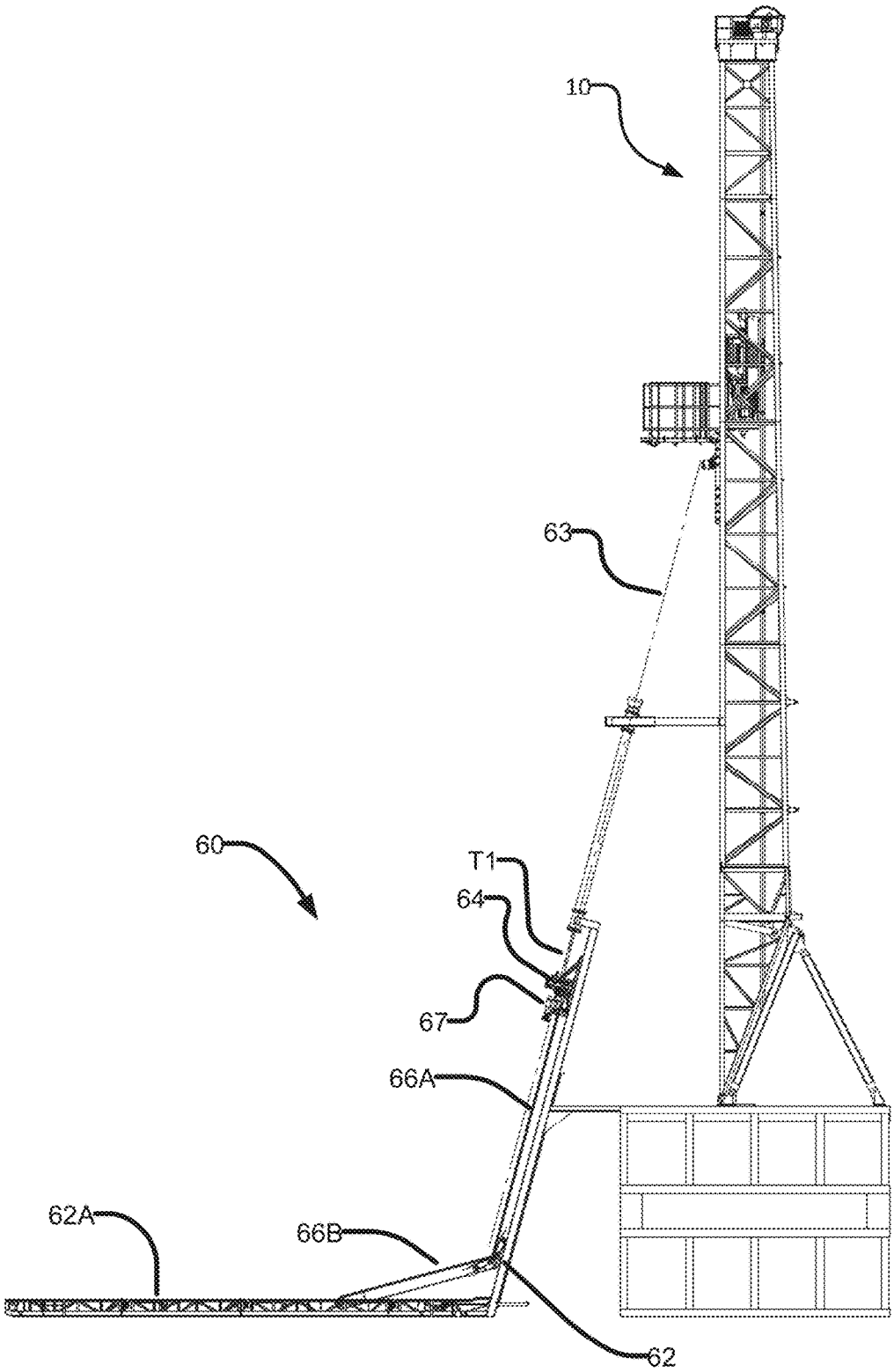

Carriage 66 may be placed into the first position at which it receives a first tubular T1 for assembly into a stand as shown in FIG. 7A. Carriage 66 may then be moved into a second position in which tubular T1 is aligned with stand-building axis 63. In FIG. 7A, carriage 66 is in its first position, which in the example embodiment illustrated here is horizontal. In this position, carriage 66 has received a tubular T1 from a pipe rack (not shown) which stores tubulars in a horizontal orientation. As shown in FIG. 7B, carriage 66 is moved to align with pipe stand building axis 63. In some embodiments, this is done simply by advancing carriage 66. Between FIGS. 7A and 7B tubular T1 has been engaged in chuck 67. The tubular may be elevated so that its centerline is aligned with the centerline of chuck 67 to facilitate engagement of the tubular in chuck 67. This may be achieved, for example, by elevating the surface that tubular T is supported on or otherwise lifting tubular T with one or more jacks, jaws, wedges, or the like. Chuck 67 may then be advanced relative to the tubular so that the tubular is received in the jaws of chuck 67. As shown in FIG. 7C, when tubular T is being gripped by chuck 67, tubular T1 may be advanced along axis 63 by advancing chuck 67 until it is possible to grip tubular T1 in backup jaws 64.

Most tubulars are designed to be gripped and rotated at tool joints at either end of the tubular. The tool joints have thicker walls and are more robust than remaining portions of the tubular. Chuck 67 has a deep enough opening in its jaws to receive the trailing end of a tubular T (usually, the pin end) and to grip the tubular on the tool joint.

Since the tool joint may be received within the jaws of chuck 67 as chuck 67 brings the trailing end of the tubular up toward backup jaws 64, there is a need for a way to pass off the tubular from chuck 67 to backup jaws 64 in such a manner that backup jaws 64 end up gripping the tubular on the tool joint. A wide range of transfer mechanisms are possible. Some of these are as follows.

One transfer mechanism, which is suitable for the case where a stand is being built only of two tubulars, is that the jaws of chuck 67 may be closed when bringing a first tubular T1 up to backup jaws 64. The closed jaws of chuck 67 may provide a pushing surface which pushes on the pin end of tubular T1. Chuck 67 may simply be advanced until tubular T1 has been pushed almost all of the way through backup jaw 64 and the tool joint is within the gripping range of backup jaw 64. In some embodiments a ramp, movable roller or the like may be actuated to align the centerline of tubular T1 with the centerline of backup jaw 64 closely enough for backup jaw 64 to grip tubular T1.

Another example transfer mechanism provides a set of feed rollers above backup jaws 64. The feed rollers may grip and advance a tubular until its lowermost tool joint is within the gripping range of backup jaws 64.

Another example transfer mechanism that may be applied if tubular T is received within the jaws of chuck 67 as it is being advanced, is to provide an actuator that can be advanced axially through the jaws of chuck 67 to push the tail end of tubular T1 upwardly until the lower tool joint of tubular T1 is within the gripping range of backup jaws 64.

Another example transfer mechanism is to make the jaws of chuck 67 double acting (so that the jaws of backup jaw 64 may be selectively moved radially outwardly or radially inwardly). Outward movement of the jaws may, for example, be caused by a spring or other bias mechanism, or by hydraulic or pneumatic pressure. The jaws may be coupled by a linkage to a basket which engages the tail end of tubular T1. Driving the jaws outwardly lifts the basket, thereby allowing the tool joint of tubular T1 to be engaged within the gripping range of backup jaw 64. When chuck 67 is closed, the basket may drop to a level low enough such that the tool joint of the tubular can be gripped by the jaws of chuck 67.

Another example transfer mechanism provides a resilient mounting for chuck 67. For example, chuck 67 may be spring loaded. Chuck 67 may be displaced downwardly against a bias mechanism until the upper end of a probe (which may optionally be a fixed probe) projects through the bore of chuck 67. The upper end of the probe may include a basket to receive the pin end of tubular T1. In this embodiment, as chuck 67 is advanced to bring the tubular upwards, chuck 67 can advance only until it is stopped by a stop or by hitting backup jaws 64. As the lifting is continued, the probe continues to lift the tubular as the bias mechanism is compressed until the tool joint at the tubular is within the gripping range of the backup jaw. Providing a spring-loaded chuck 67 also has the advantage that the bias mechanism may allow the chuck to move axially to compensate for thread advance when screwing the connections for tubulars together or apart. A resiliently-mounted chuck may be provided even in cases where another mechanism is used to transfer tubulars to backup jaws 64. The bias mechanism may comprise suitable springs. The springs may be gas springs, for example. Gas springs can provide a reasonably constant force over a large deflection range. Active or passive hydraulic or pneumatic cylinders could be used in place of the spring.

In a further example embodiment, chuck 67 may be advanced toward backup jaws 64. Backup jaws 64 may then be used to grip the exterior of the tubular T1 (even if this is not at a tool joint). The gripping needs to only be tight enough to prevent the tubular from falling down. Chuck 67 can then be retracted to below the pin end of tubular T1 and its jaws may be closed to provide a pushing surface. Chuck 67 may then be advanced so that the pushing surface of the closed jaws engages the tail end of tubular T1. Chuck 67 may then be advanced until the tool joint of tubular T1 is within the gripping range of backup jaws 64.

Figure 7D:
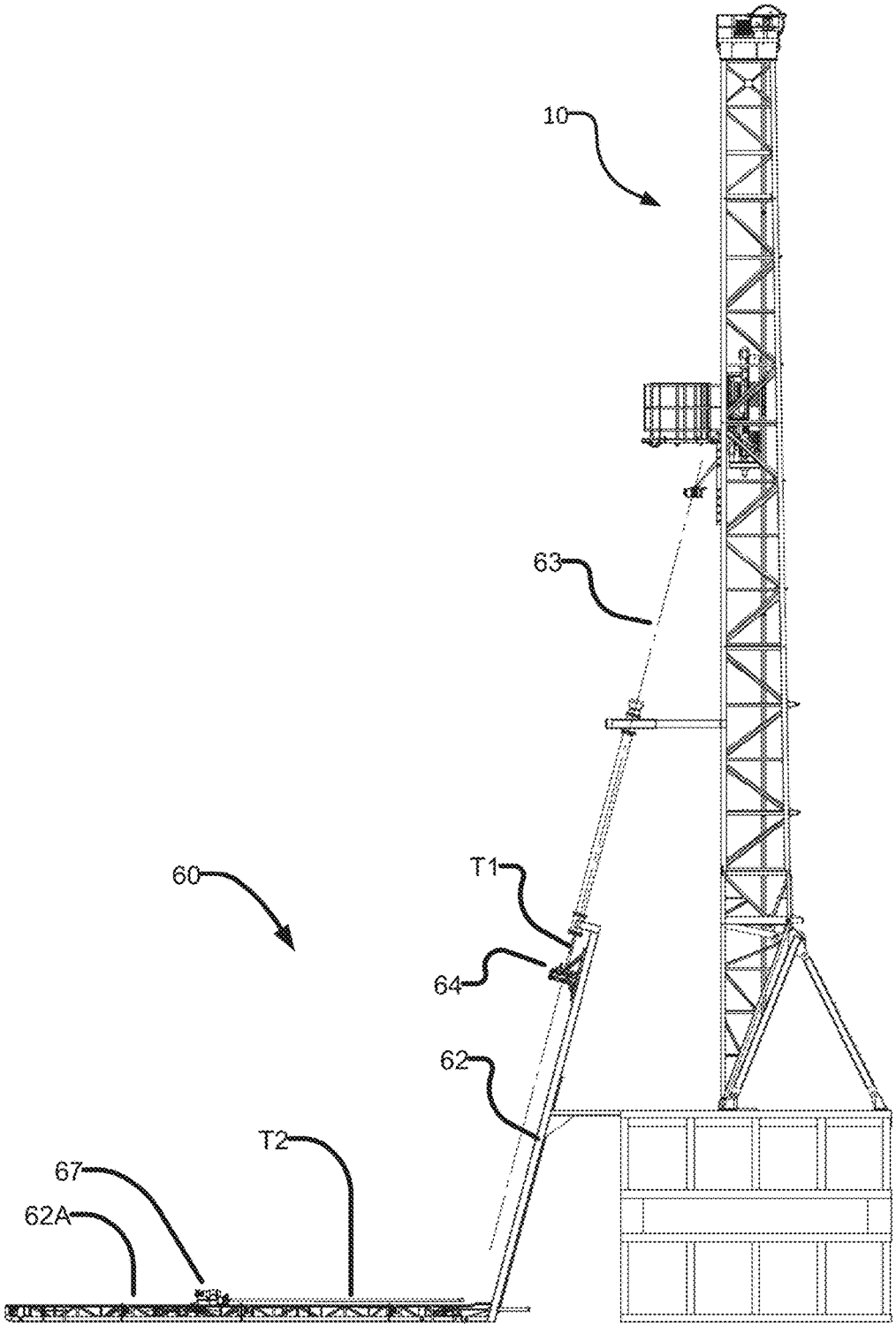
Figure 7E:
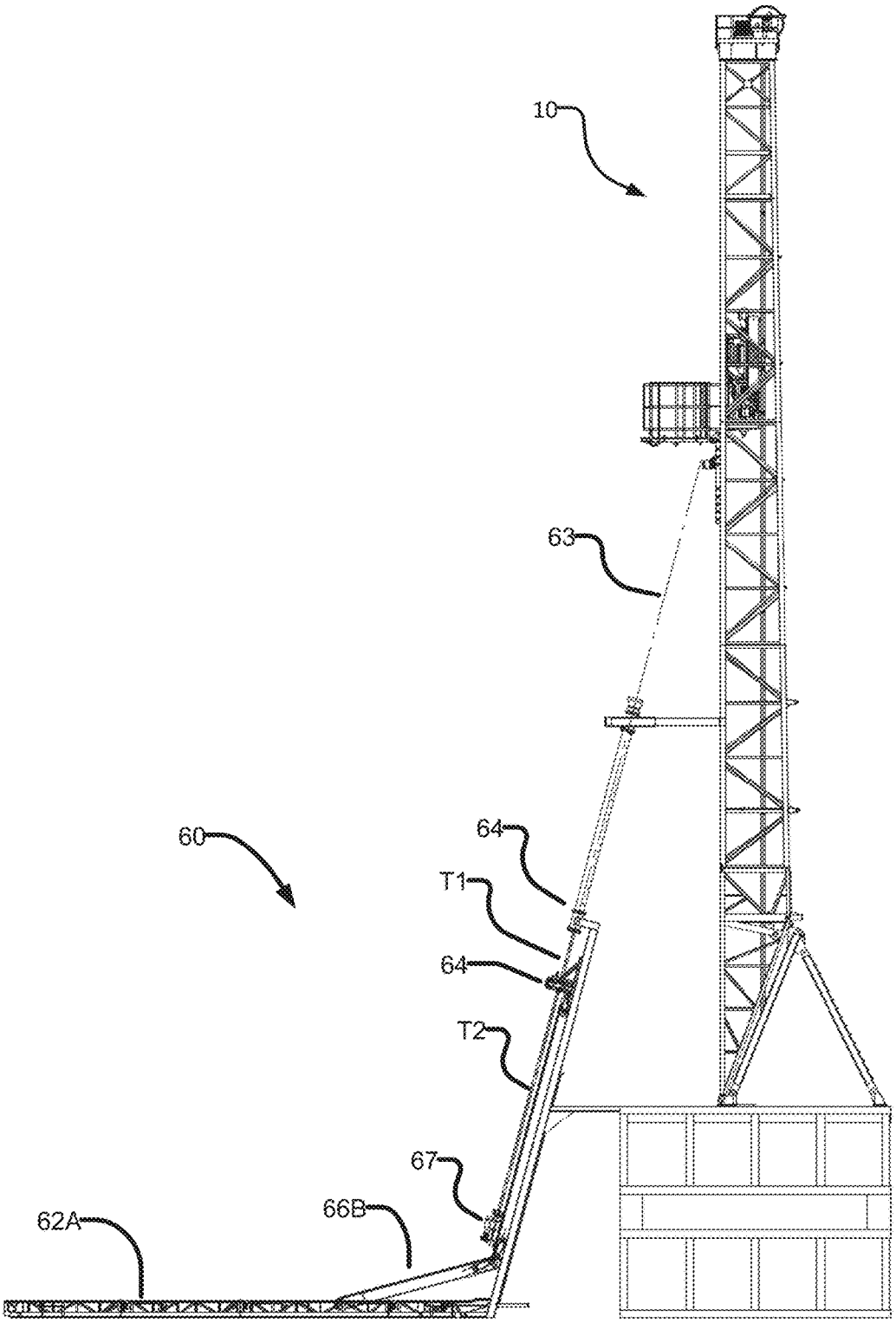
Figure 7F:
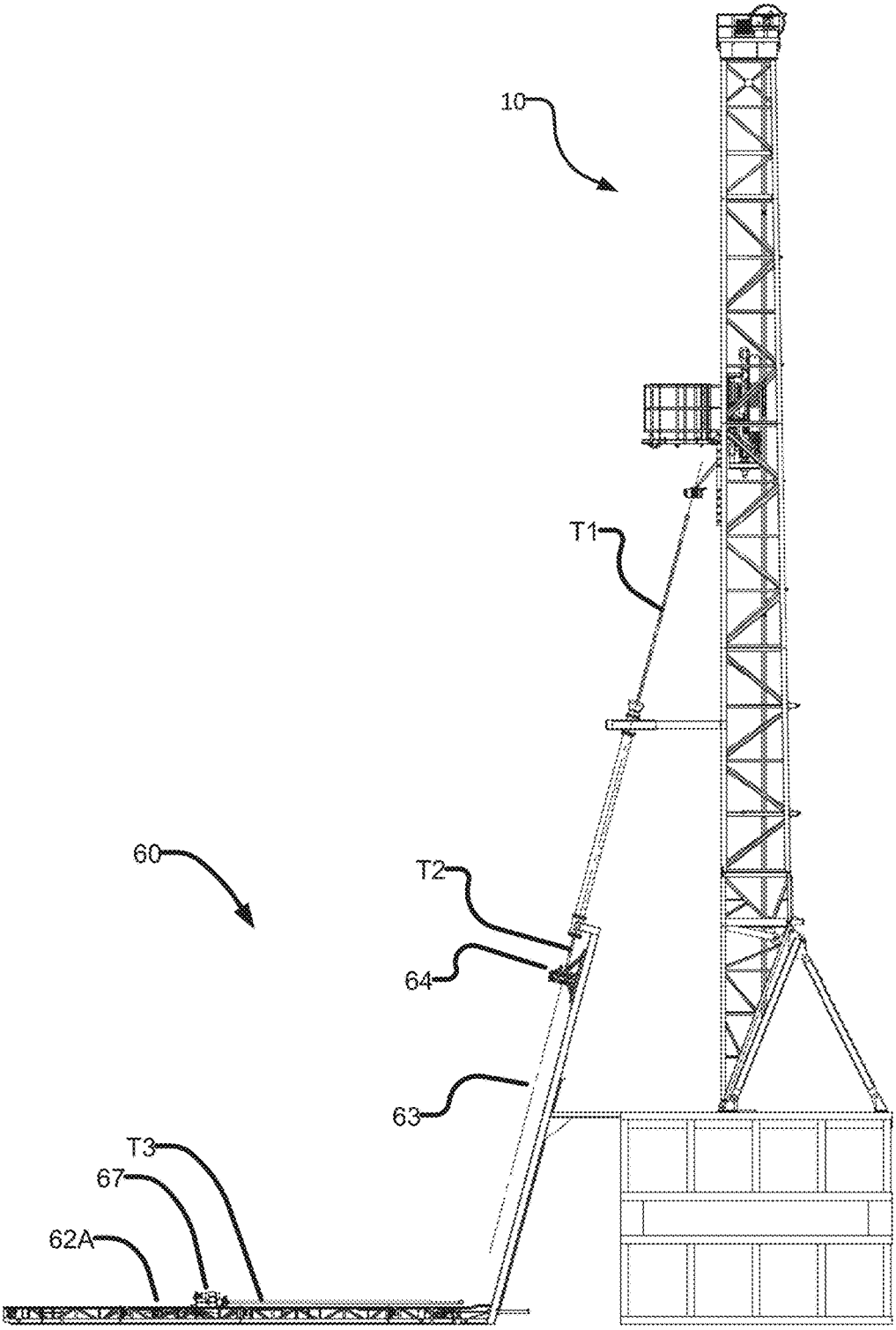

After a tubular T1 has been gripped by backup jaws 64, carriage 66 may be moved back to its first position to receive another tubular T2 (FIG. 7D). In FIG. 7E, carriage 66 has been moved to its second position, thereby aligning tubular T2 with stand building axis 63. As shown in FIG. 7E, chuck 67 may then be advanced to engage the coupling on the upper end of tubular T2 with the coupling on the lower end of tubular T1. Chuck 67 may then be rotated and advanced to make up the coupling between tubulars T1 and T2. If what is being built is a stand made up of two tubulars then the stand is complete at this point. In this example, however, the stand will be built of three tubulars. Therefore, chuck 67 is advanced until the lower end of tubular T2 is grasped by backup jaws 64 and carriage 66 is retracted to its first position where it receives a third tubular T3 as indicated in FIG. 7F.

Figure 7G:
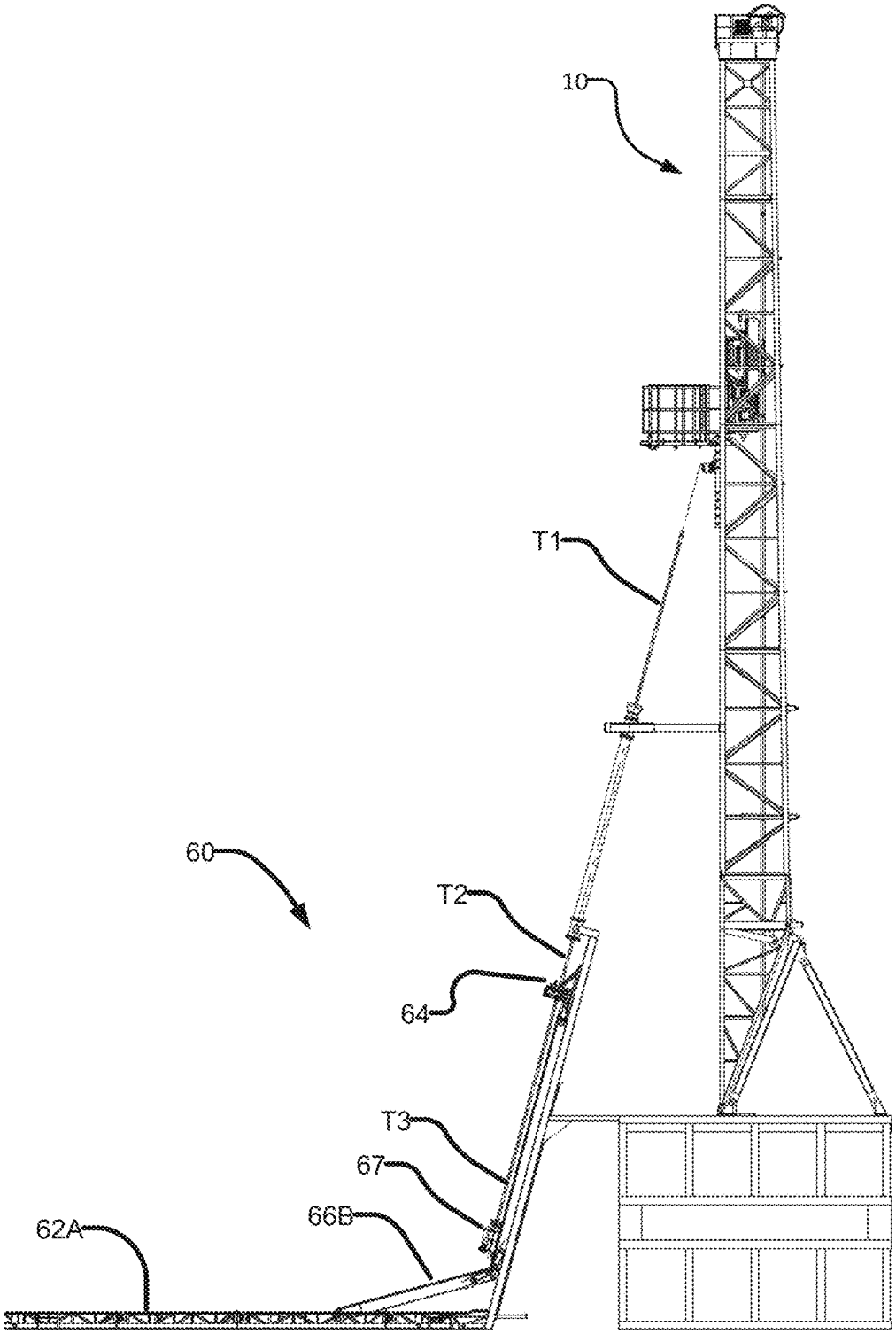
Figure 7H:
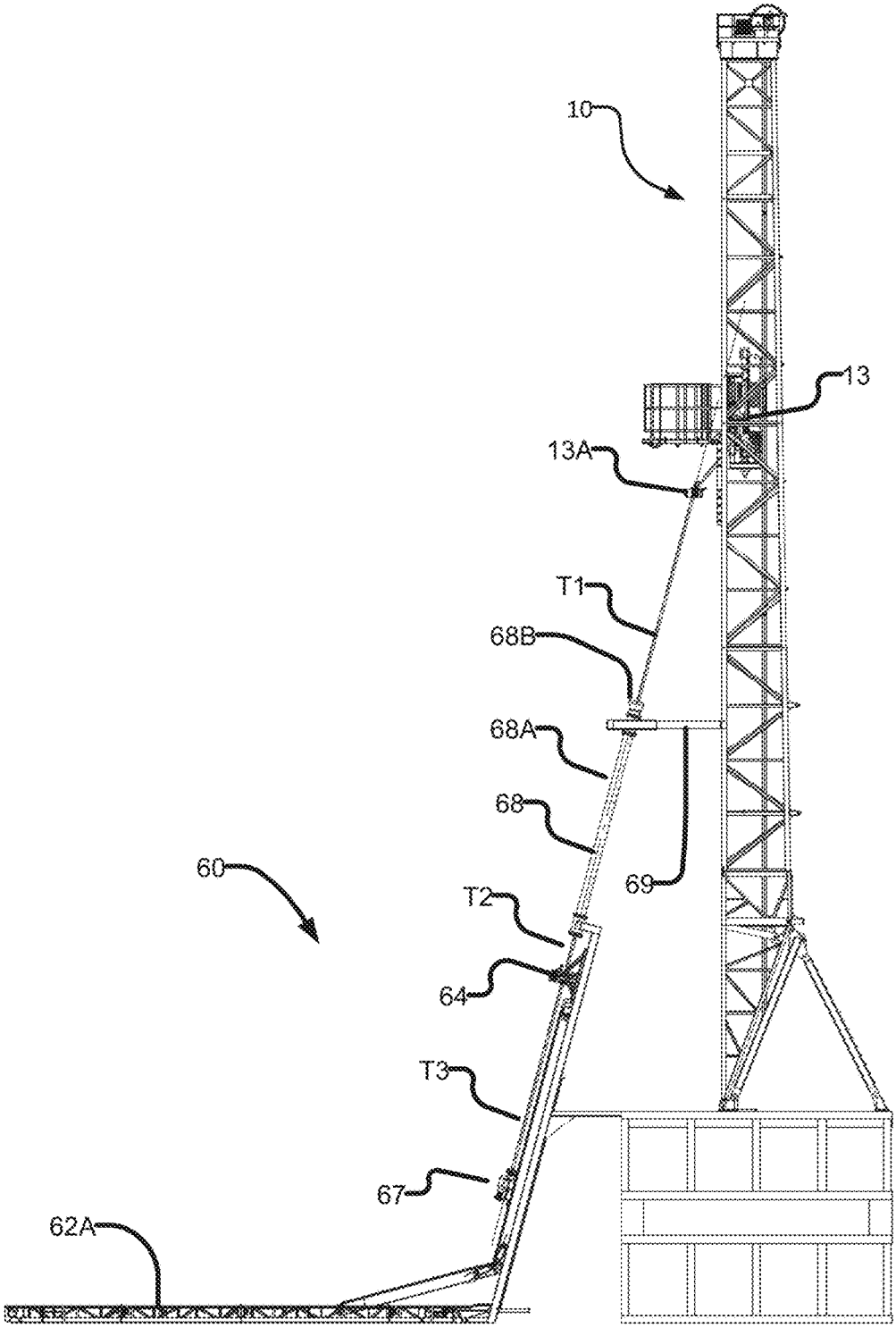

Carriage 66 carrying tubular T3 is then moved to its second position at which point chuck 67 may be advanced to engage the coupling on the upper end of tubular T3 with the coupling on the lower end of tubular T2 as illustrated in FIG. 7G. Finally, chuck 67 is driven in rotation to make up the coupling between tubular T2 and T3. FIG. 7H shows elevator 13A engaging the top of the stand. Chuck 67 can then be retracted so as not to interfere with transfer of the complete stand to the drill rig. Advantageously, chuck 67 does not need to provide a transverse opening or gap through which a stand can be removed by transverse motion.

Mast 62 may include a structure 68 (see FIG. 7H) above backup jaws 64 to hold the portion of a pipe stand that is being built or taken down that projects above backup jaws 64. In the illustrated embodiment, structure 68 comprises a trough. Structure 68 has a longitudinal opening 68A that is wide enough to allow a stand to be moved into or out of structure 68 through the longitudinal opening 68A. Opening 68A is somewhat wider than the tool joints of the largest tubulars to be handled by apparatus 60. Structure 68 may be fabricated, for example, by cutting a slot along one side of a pipe having a diameter sufficient to receive the pipe stand. It is not necessary for structure 68 to have continuous walls. In some embodiments, structure 68 comprises a framework or other structure that provides openings in addition to longitudinal opening 68A.

When a pipe stand is complete, the uppermost end of the pipe stand projects past the top 68B of structure 68. In some embodiments, structure 68 is positioned adjacent to a drill rig such that the uppermost end of a stand is at a location at which the stand can be grabbed by a hoisting equipment of the drill rig (e.g. elevator 13A). For example, in some embodiments, the upper end of structure 68 is placed adjacent to a window through which a pipe stand may be received into a drill rig. In some embodiments, the drill rig comprises a top drive 13 having an elevator 13A that can grab the upper end of a pipe stand which projects out past the top 68B of structure 68.

Structure 68 includes an actuator which can rotate structure 68 around an axis typically, an axis that is coincident with or at least parallel to axis 63, so that the open side 68A of structure 68 is either facing toward drill rig 10 so that a stand may be transferred to or from drill rig 10, or so that the open side 68A of structure 68 is facing in a different direction such that the pipe stand remains cradled by structure 68. It is possible but not mandatory that structure 68 is rotatable by 180 degrees. In some embodiments, rotation of structure 68 is actuated by a single hydraulic cylinder or other linear actuator. In some embodiments structure 68 is rotated by a rotary actuator such as a hydraulic or pneumatic or electric motor. In some embodiments a structure 68 has a range of angular rotation of 120 degrees or less.

If desired, structure 68 may include one or more supports 69 coupled to the drill rig to stabilize structure 68. For example, a support 69 may be provided near top end 68B of structure 68. Support 69 is configured to permit rotation of structure 68 as described above.

To transfer a pipe stand to a drill rig, the upper end of the pipe stand may be grabbed by hoisting equipment on the drill rig. When this has been done, structure 68 may be rotated about its axis of rotation to allow the pipe stand to exit from structure 68 through longitudinal opening 68A and be drawn into the drill rig.

Figure 7I:
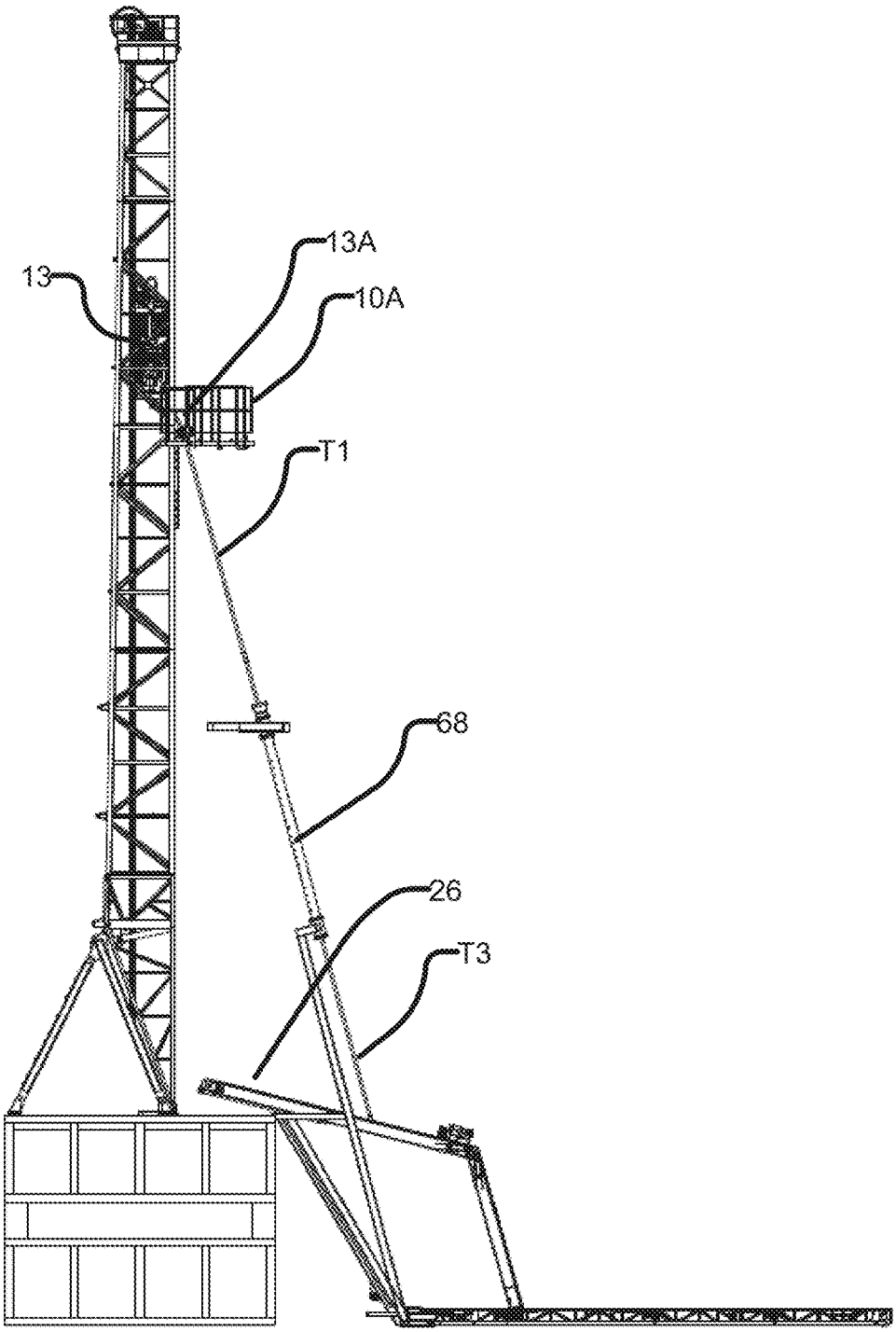
FIGS. 7I and 7J illustrate controlling motion of a tail end of a stand as the stand is transferred to a drill rig.
Figure 7J:
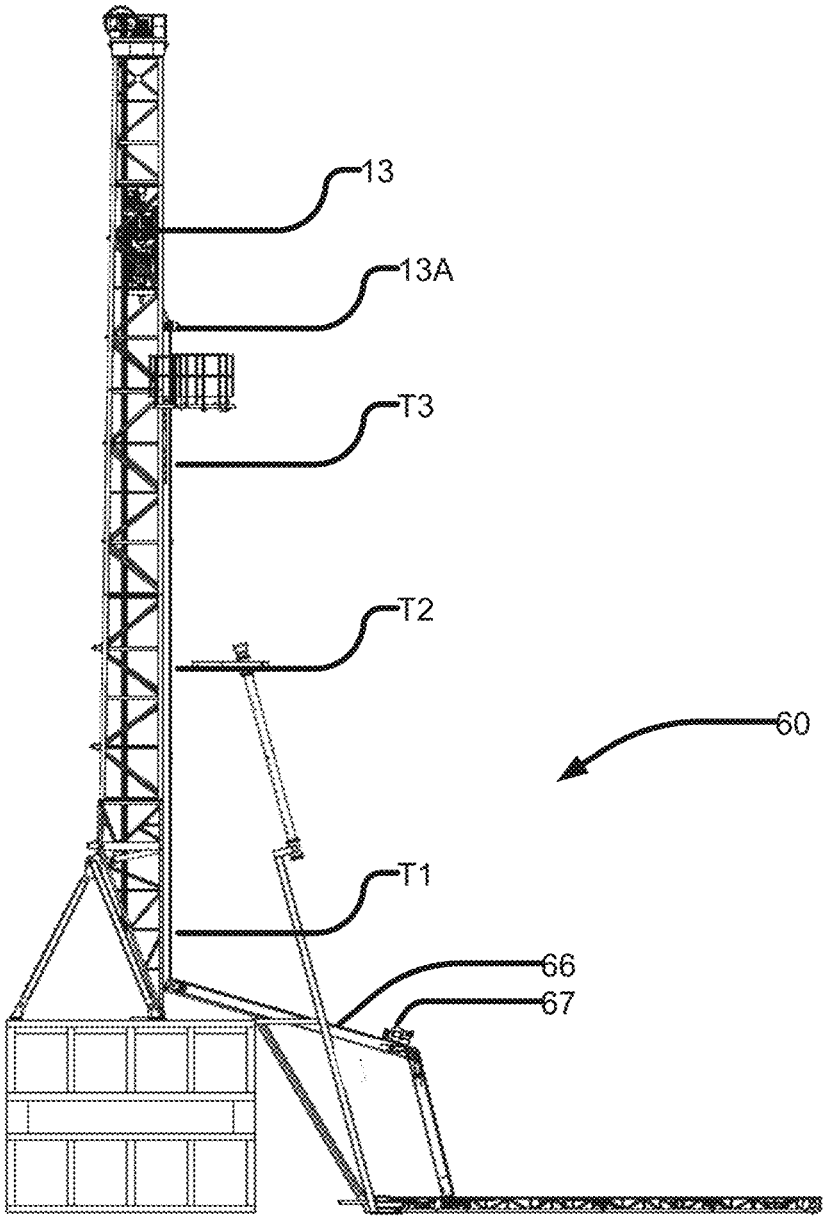
Figure 7K:
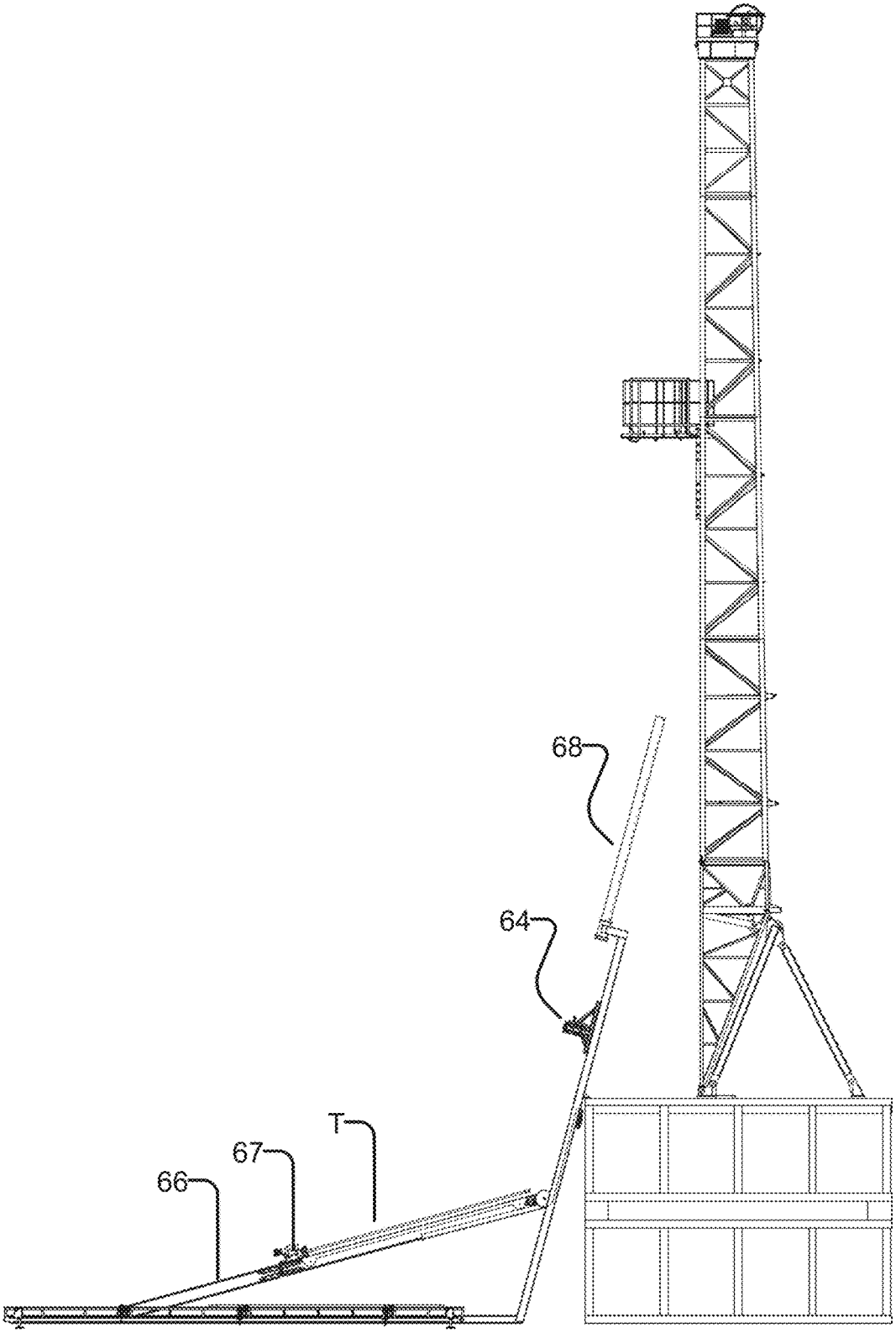
FIGS. 7K and 7L illustrate the use of a carriage to pass tubulars to the floor of a drill rig.
Figure 7L:
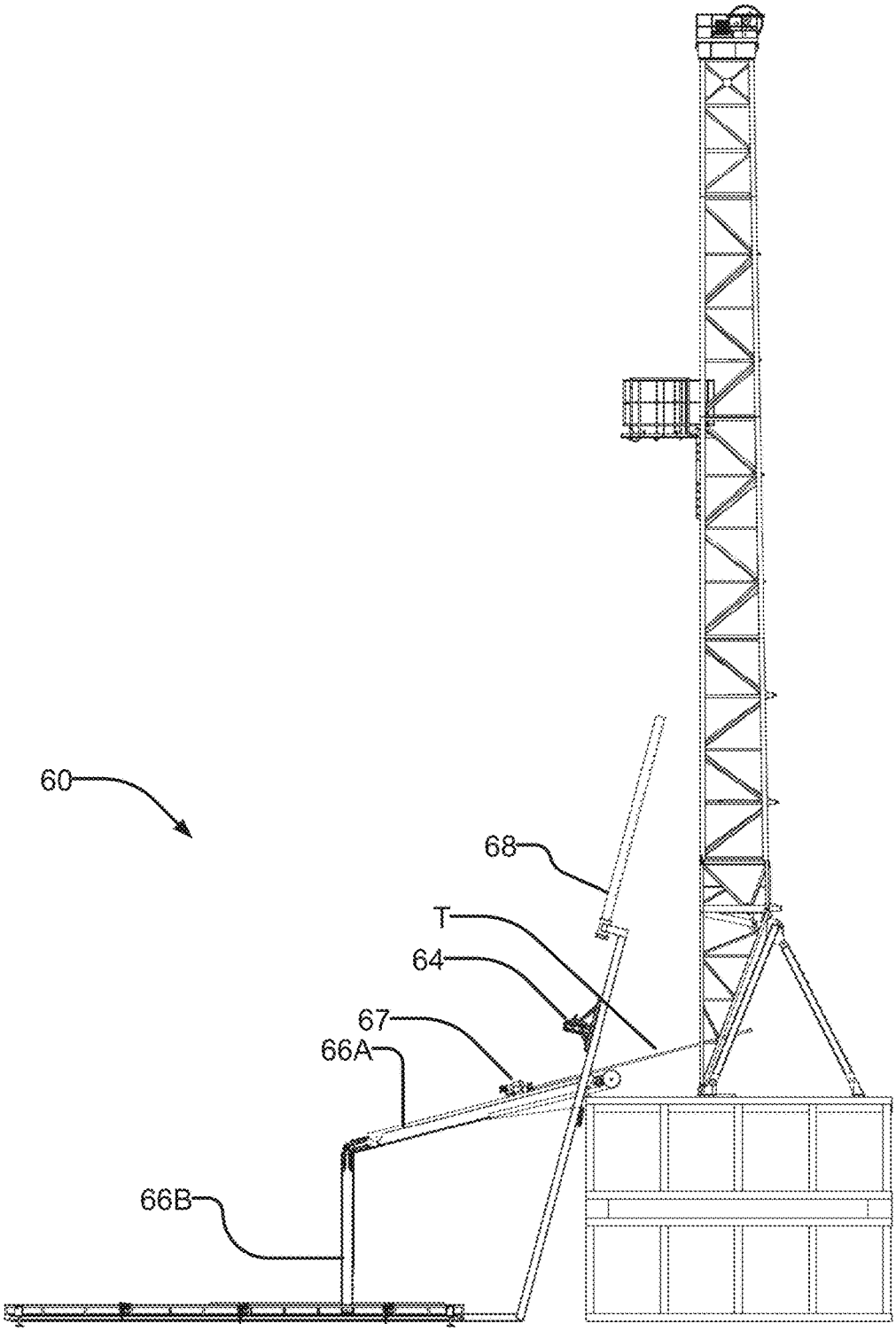

FIGS. 7I and 7J illustrate transferring a stand to drill rig 10. In these Figures, carriage 66 is equipped with a live surface and is configurable to place the live surface in position for controlling motion of a tail end of a stand as the stand is transferred to drill rig 10. In the illustrated embodiment, drill rig 10 includes a structure 10A where a derrickman may stand during certain drill rig operations. A floor of structure 10A may be folded out of the way so that it does not interfere with positioning elevator 13A to hold a top end of the stand. FIGS. 7K and 7L illustrate the use of carriage 66 of apparatus 60 to pass tubulars to the floor of a drill rig.

Figure 8A:
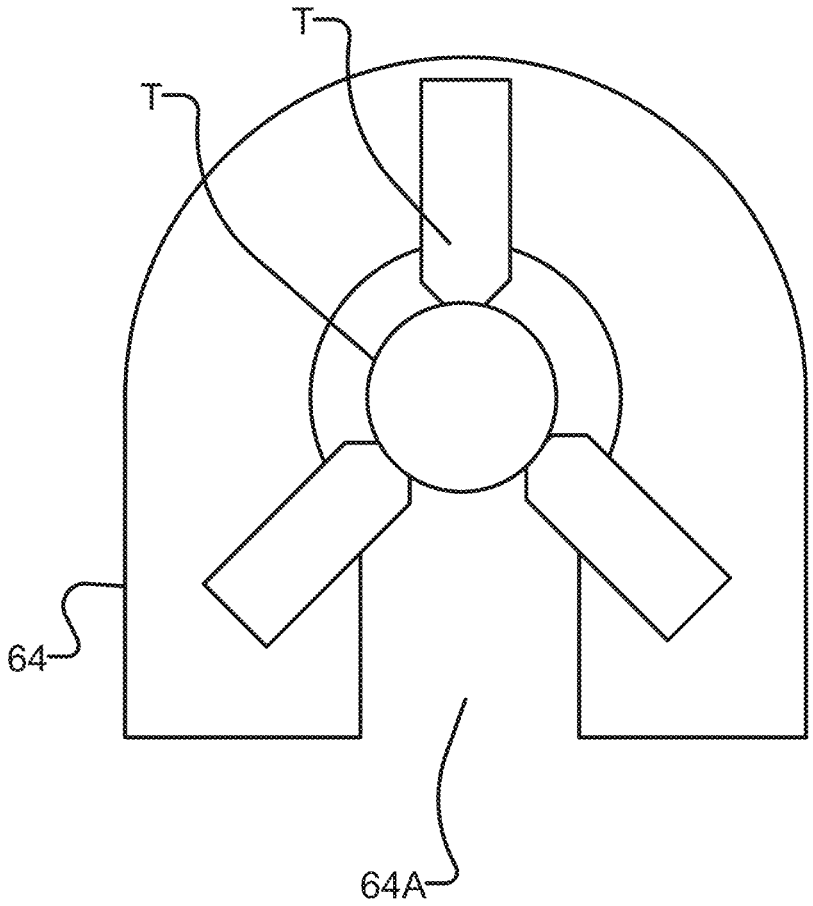
FIG. 8A shows an example set of backup jaws.

Backup jaw 64 and any support 69 for structure 68 may be constructed to have openings facing toward drill rig 10 so that tubulars extending through backup jaw 64 and/or a support structure, if present, can be passed to drill rig 10. FIG. 8A shows an example of backup jaws 64 having an opening 64A on one side. Opening 68A in structure 68 may be aligned with opening 64A by rotating structure 68. FIG. 8A also shows gripping members 64B that can be actuated to grip a tubular T.

Figure 8B:
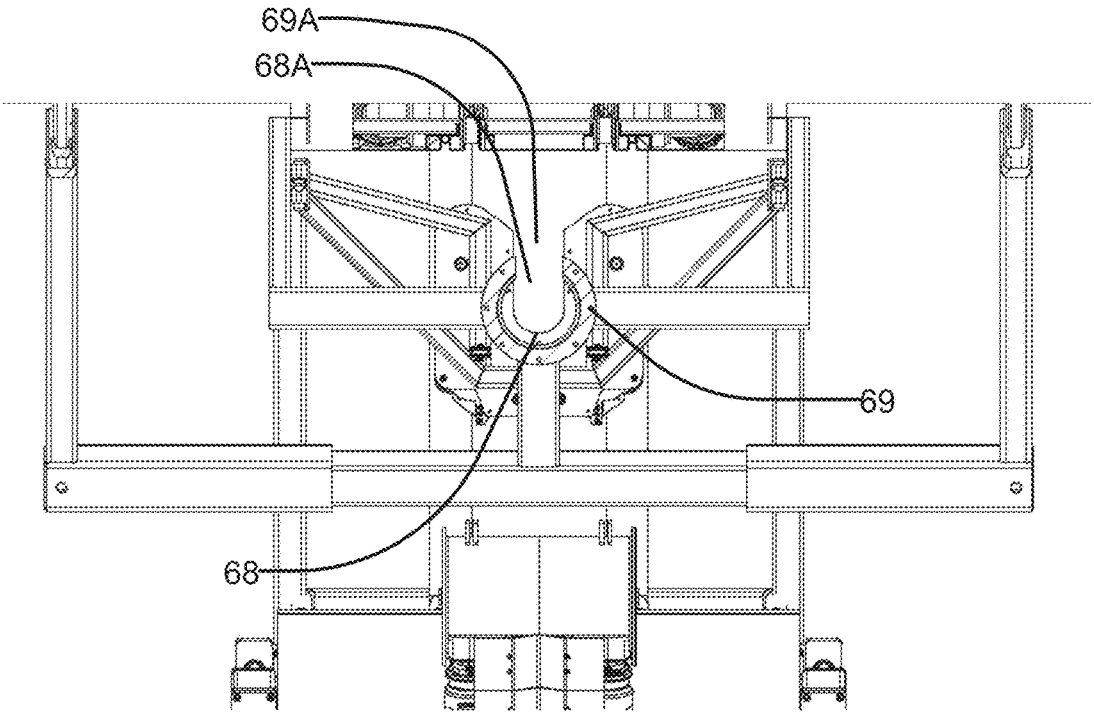
FIG. 8B shows an example support for a part of a stand building apparatus.

FIG. 8B shows an example support 69 configured to permit rotation of structure 68 and also having an opening 69A on one side. When structure 68 is rotated so that opening 68A is aligned with opening 69A as shown in FIG. 8B, a stand may be passed out of or into structure 68.

In some embodiments, when a pipe stand is being carried to the drill rig, motion of the tail end of the pipe stand is controlled by a live surface, as described above. In some embodiments, the live surface is provided on carriage 66 which may be constructed in a similar manner to the pipe handling apparatus 20 which is described above. In some embodiments, the live surface is provided by a separate structure from carriage 66.

In some embodiments carriage 66 comprises two parts 66A and 66B pivotally coupled together so that part 66A can be aligned with stand-building axis 63 while part 66B remains horizontal (or more nearly horizontal than part 66A). This allows the overall height of apparatus 60 to be minimized.

Figure 9A:
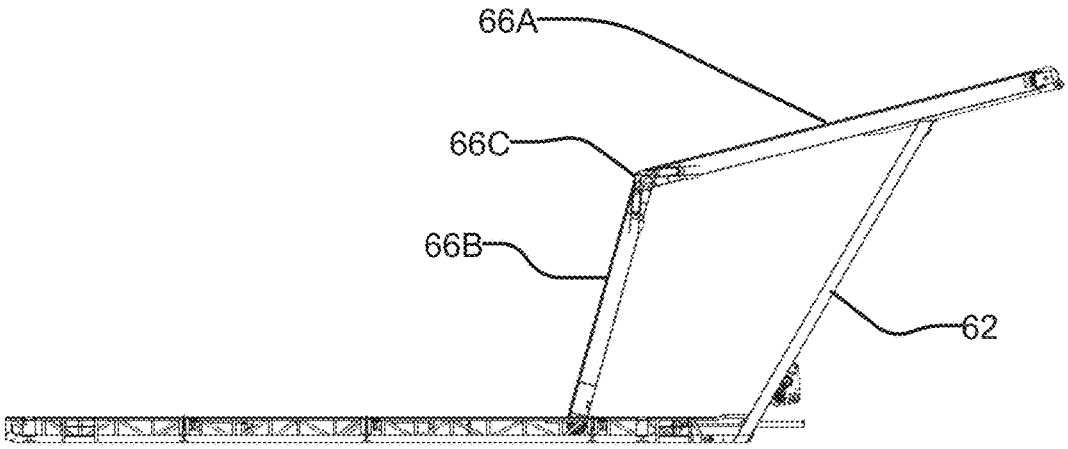
FIGS. 9A and 9B are schematic drawings illustrating positive and negative kinking in a carriage having a reversible kink.
Figure 9B:
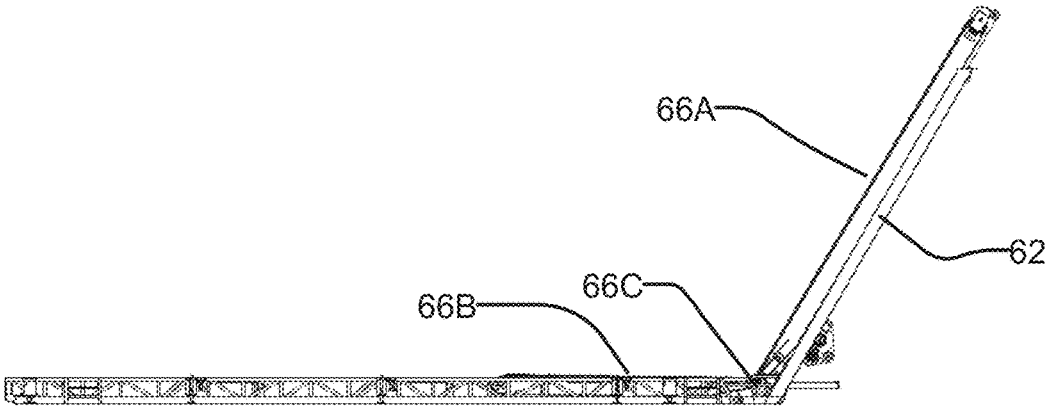

Apparatus according to some embodiments comprises a carriage having two parts that are pivotally connected to one another and an actuator arranged to cause the carriage to kink selectively in either of two directions about a pivot axis. With a positive kink, the first part of the carriage is more nearly horizontal than the second part of the carriage, as illustrated in FIG. 9A. With a negative kink, the first part of the carriage is more nearly vertical than the second part of the carriage as indicated in FIG. 9B. In an apparatus equipped with such a carriage, the kink may be made positive for the purpose of delivering individual tubulars to a rig floor (for example, as described above in relation to apparatus 20) and the kink may be made negative for the purpose of delivering individual tubulars to a stand building axis (for example, as shown in apparatus 60 of FIG. 6). The carriage may also be kinked with a positive kink and equipped with a live surface for the purpose of regulating the motion of the tail end of a stand as the stand is being transferred to or from a drill rig (for example, as described above with reference to FIGS. 2 to 3G).

Figure 9C:
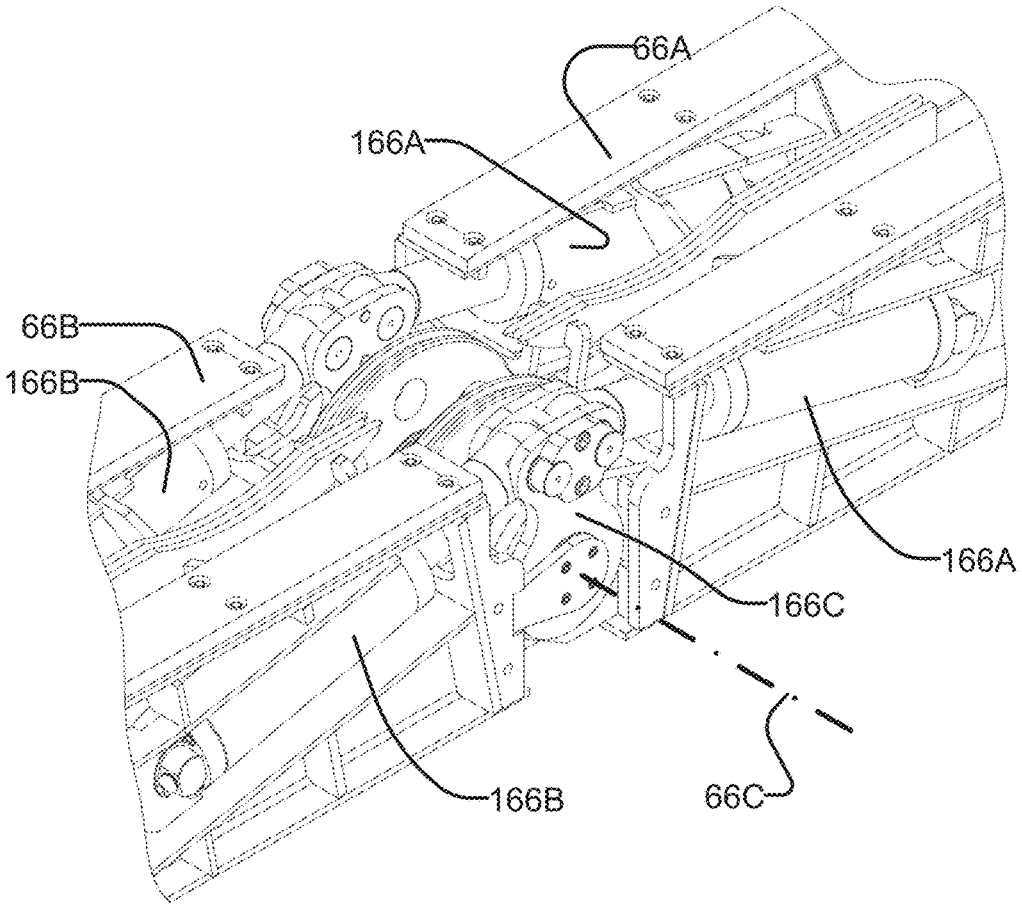
FIG. 9C is an example actuator mechanism for setting the angle between carriage sections.

FIG. 9C shows an example actuator that may be applied to set a kink angle of a carriage like carriage 66 or carriage 24. Carriage sections 66A and 66B are pivotally coupled for rotation about an axis 66C. Pairs of linear actuators 166A and 166B are respectively coupled between sections 66A and 66B and opposing sides of a floating link 166C. Link 166C is rotatable about axis 66C.

In some embodiments, a carriage has a live surface provided by a conveyor that extends along both the first and second sections 66A and 66B of a carriage 66. The conveyor may be operated when the carriage is a straight configuration, has a positive kink, or has a negative kink.

Figure 9D:
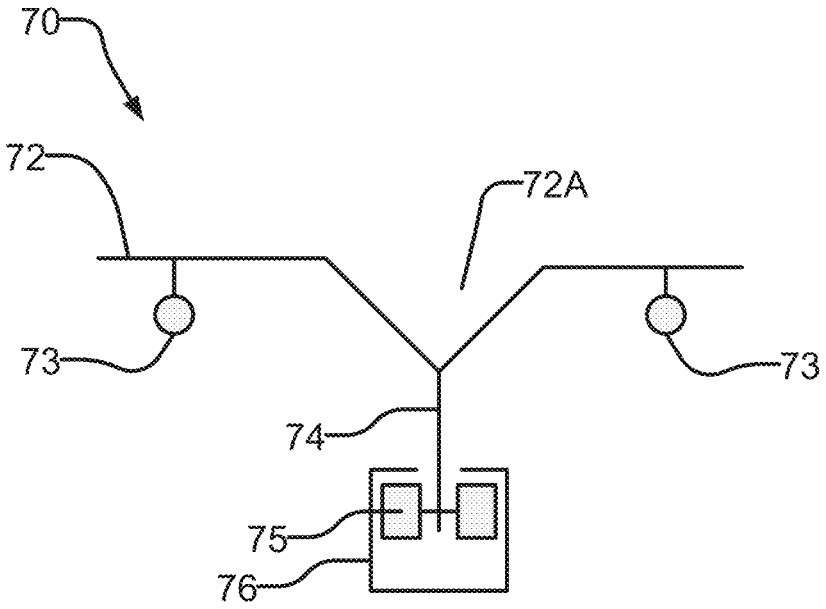
FIG. 9D is a schematic cross section of a carriage having a conveyor according to an example embodiment.
Figure 9E:
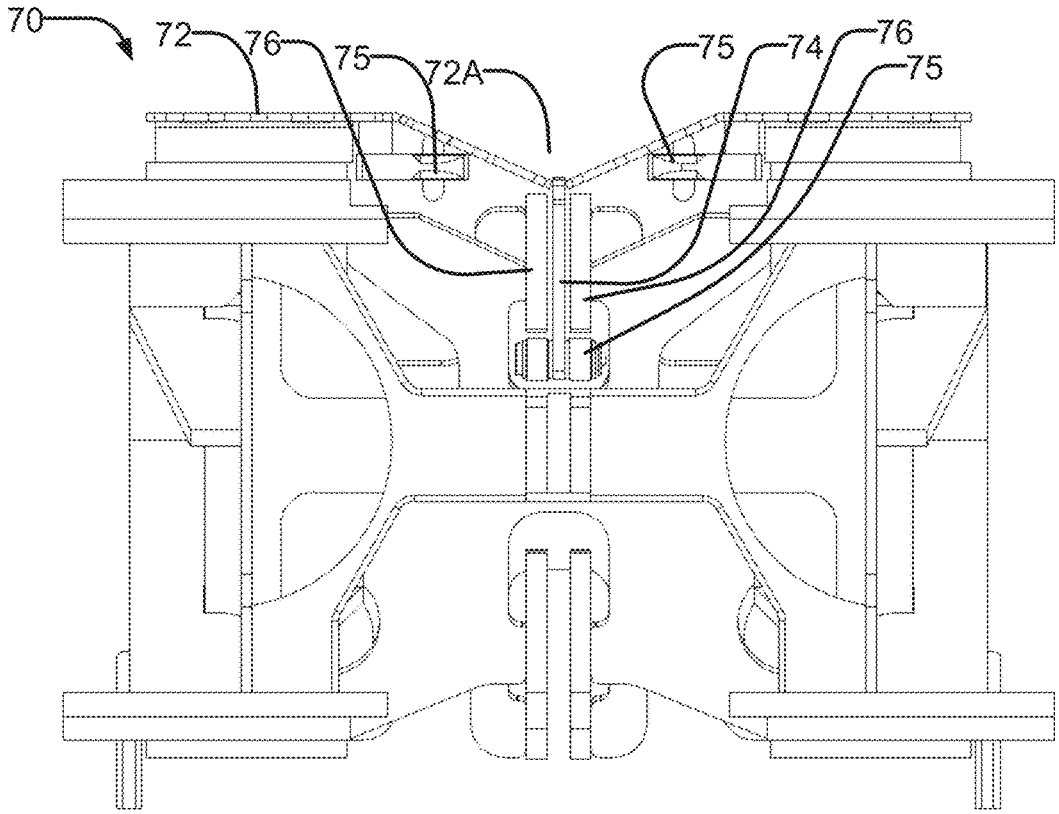
FIG. 9E is a more detailed cross section of an example conveyor.

FIG. 9D is a schematic cross-section showing an example conveyor 70 suitable for use in a carriage. FIG. 9E shows a more detailed example embodiment. Conveyor 70 comprises segments 72 which extend across the width of the conveyor. In the illustrated embodiment, each segment 72 comprises a recessed central portion 72A. Portions 72A of segments 72 provide a trough or recess extending along the length of the conveyor. Adjacent conveyor sections 72 are pivotally coupled to one another to allow relative pivoting about an axis extending transverse to the conveyor. In the illustrated embodiment, conveyor segments 72 are attached to parallel chains 73. Chains 73 allow pivotal motion of segments relative to one another. Chains 73 may be driven by a drive, for example by way of drive sprockets. The drive controls the motion of conveyor 70.

Figure 9F:
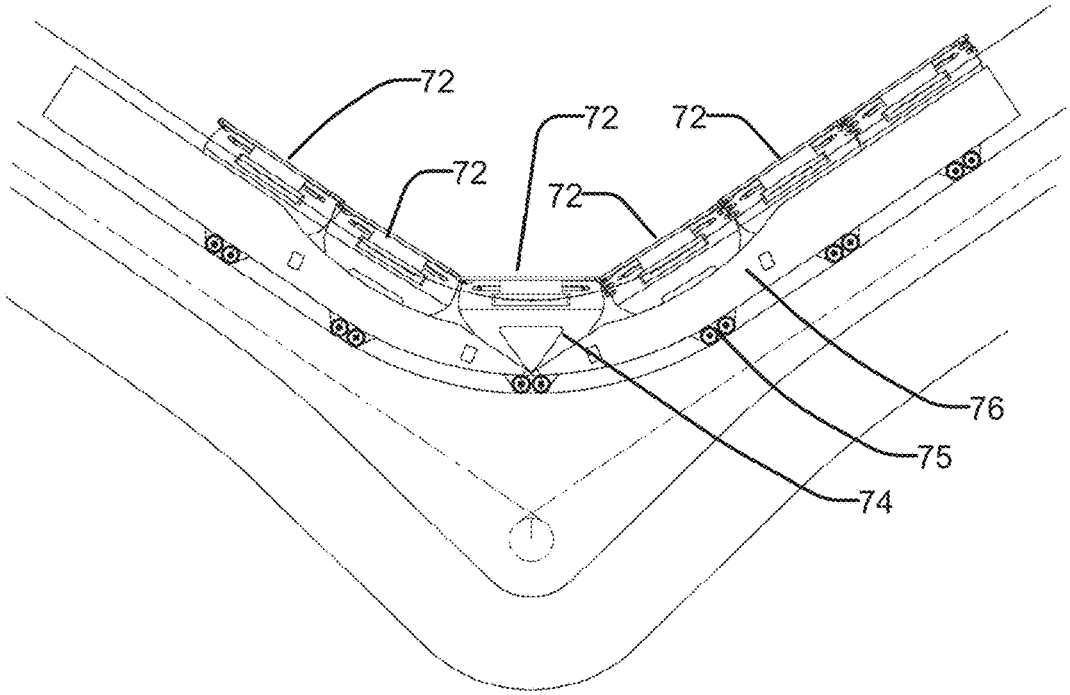
FIGS. 9F and 9G are partial cross sectional view illustrating sections of a conveyor passing around a concave curve.
Figure 9G:
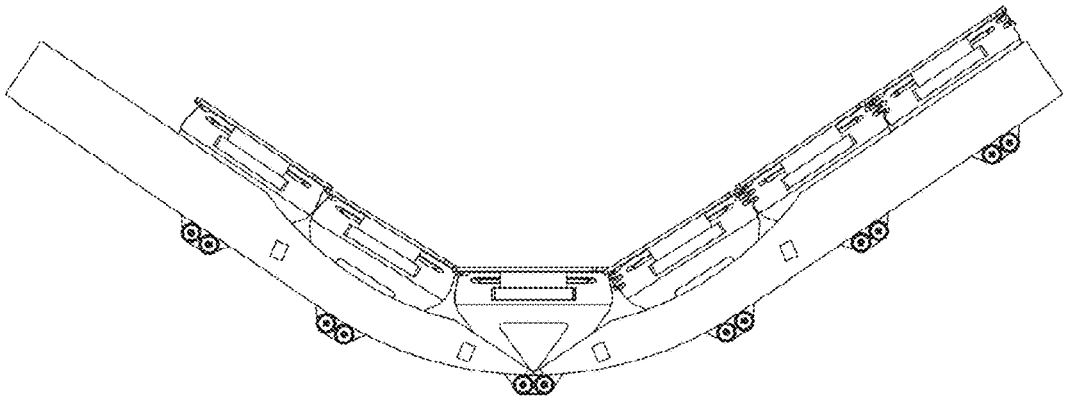

Each conveyor segment 72 includes one or more members or keels 74 that project inwardly. Keels 74 include transversely-projecting features 75 that engage rails or guides 76. In the illustrated embodiment, the transversely-projecting features comprise rollers. The engagement of the transversely-projecting features with rails or guides 76 allows segments 72 to follow a concave path on the concave side of a kink when a carriage is kinked. FIGS. 9F and 9G show an example conveyor 70 travelling around a concave bend.

Figure 9H:
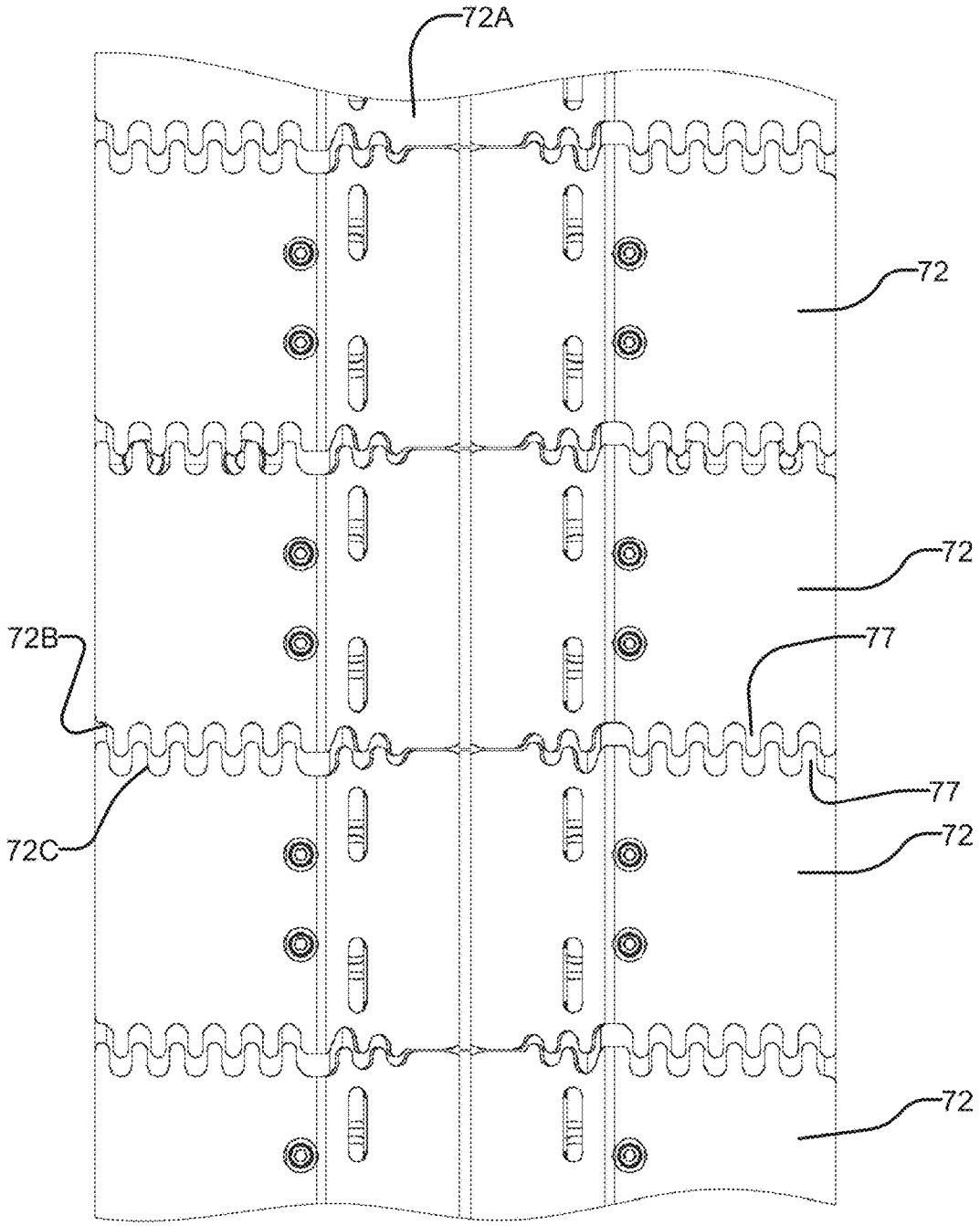
FIG. 9H is a plan view illustrating conveyor sections with interdigitating edges.

As conveyor sections 72 travel around concave or convex curves, the edges of adjacent sections 72 move together or apart. In some embodiments, an example of which is shown in FIG. 9H, edges 72B, 72C of adjacent sections 72 are formed to interdigitate with one another (i.e. the edge 72B of one section is shaped to provide projections 77 that extend between projections 77 formed on the edge of an adjacent section 72C). This allows for relative motion between adjacent sections 72 without leaving large gaps between the adjacent sections 72.

As changing the angle of kink between carriage sections 66A and 66B can change the length of the path of conveyor 70 somewhat it is desirable to provide a dynamic tensioning mechanism (e.g. a resiliently-biased sprocket) to maintain appropriate tension in conveyor 70. In an example embodiment, conveyor 70 is driven by drive sprockets located at a leading end of carriage 66 and idler sprockets at a trailing end of carriage 66 are resiliently biased (e.g. by gas springs) to maintain a desired tension in conveyor 70.

Figure 10A:
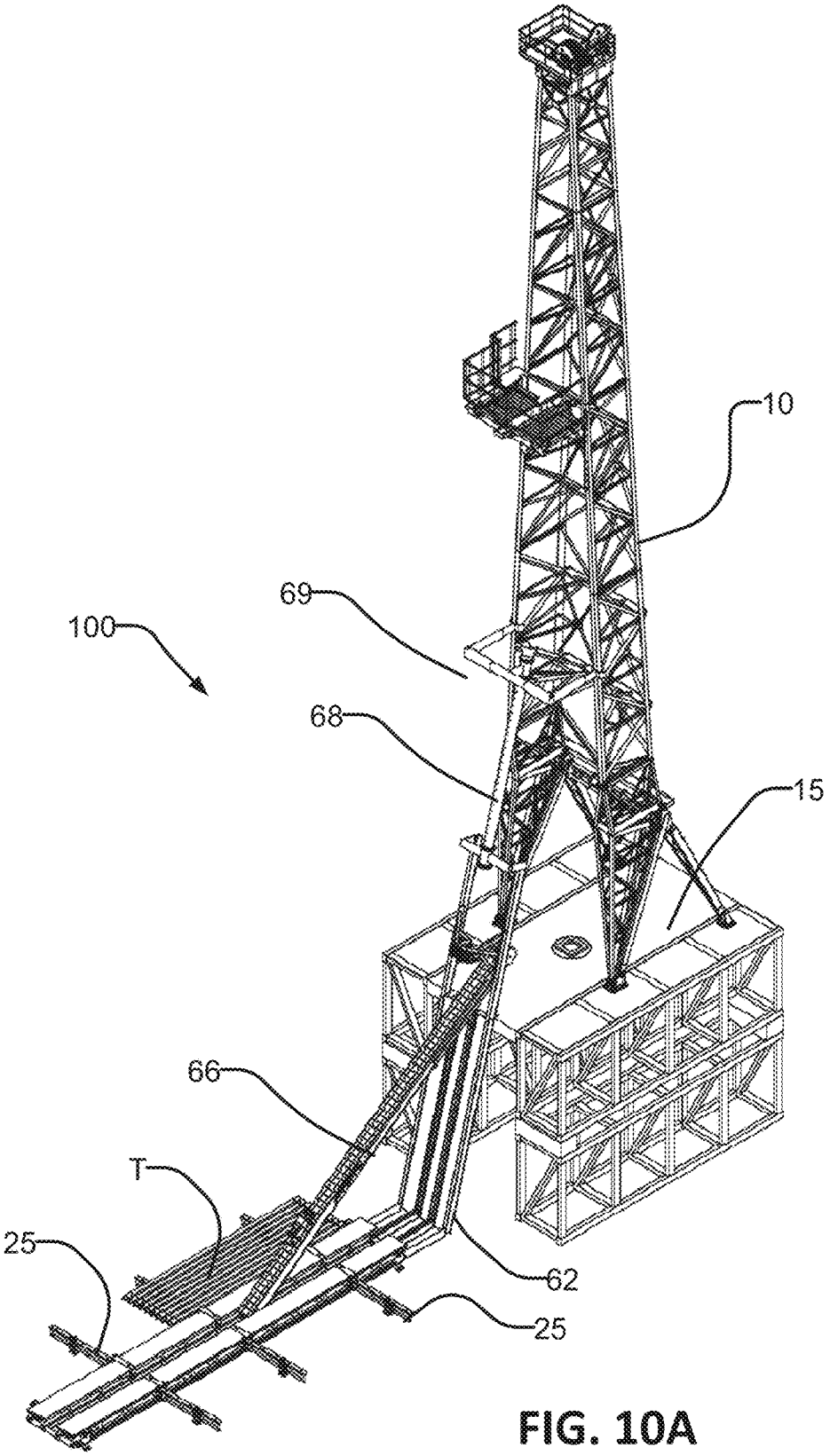
FIGS. 10A and 10B are respectively, perspective and top views of a drill rig with pipe handling apparatus 100 according to an example embodiment.
Figure 10B:
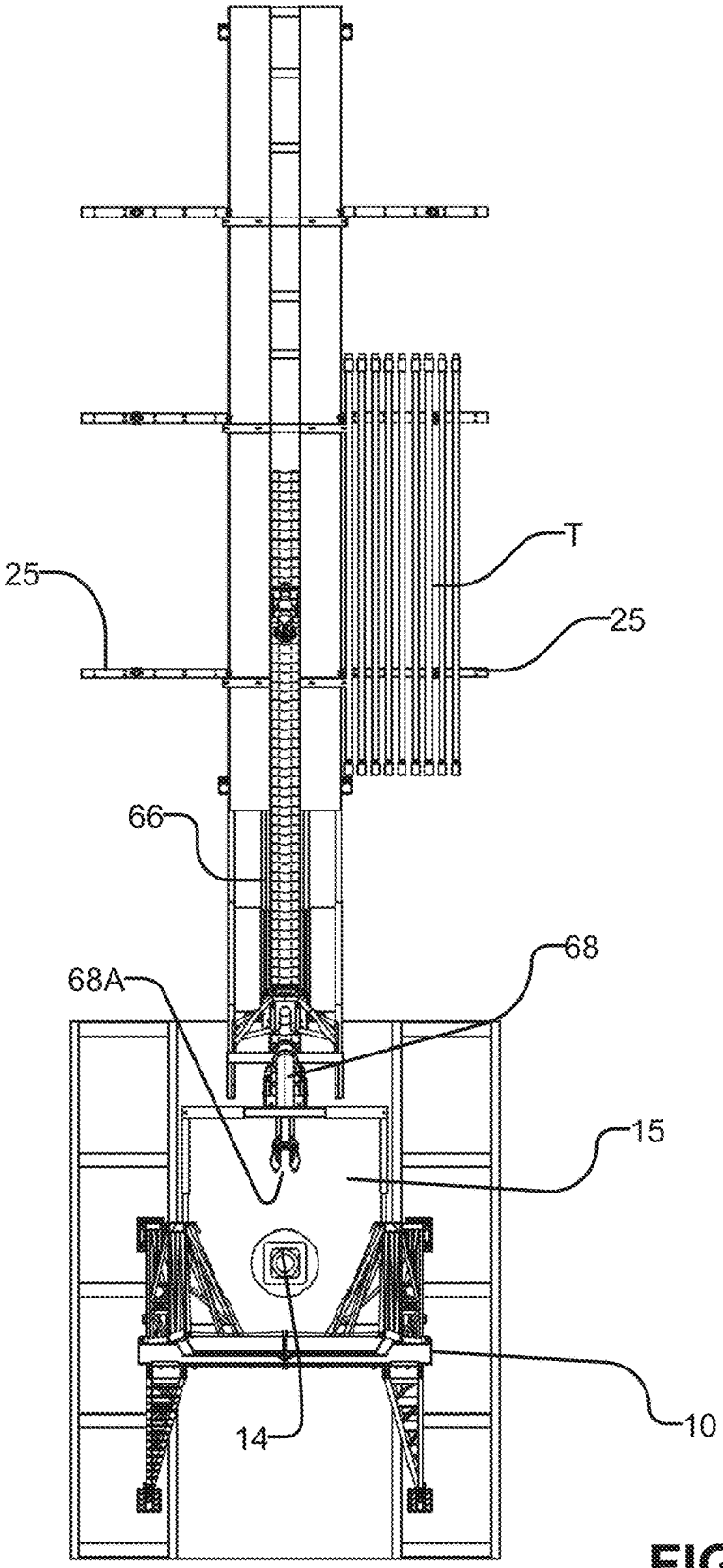

FIGS. 10A and 10B are respectively perspective and top views of a drill rig 10 with an example apparatus 100 that combines a stand-building system similar to apparatus 60 and a catwalk having a carriage 66 with a reversible kink. In apparatus 100, catwalk carriage 66 may be given a negative kink for delivery of tubulars to a stand building axis as shown in FIG. 10C and may be given a positive kink as shown, for example, in FIG. 10D for delivery of tubulars directly to a rig floor or for controlling the tail ends of stands being passed to the drill rig.

Figure 10C:
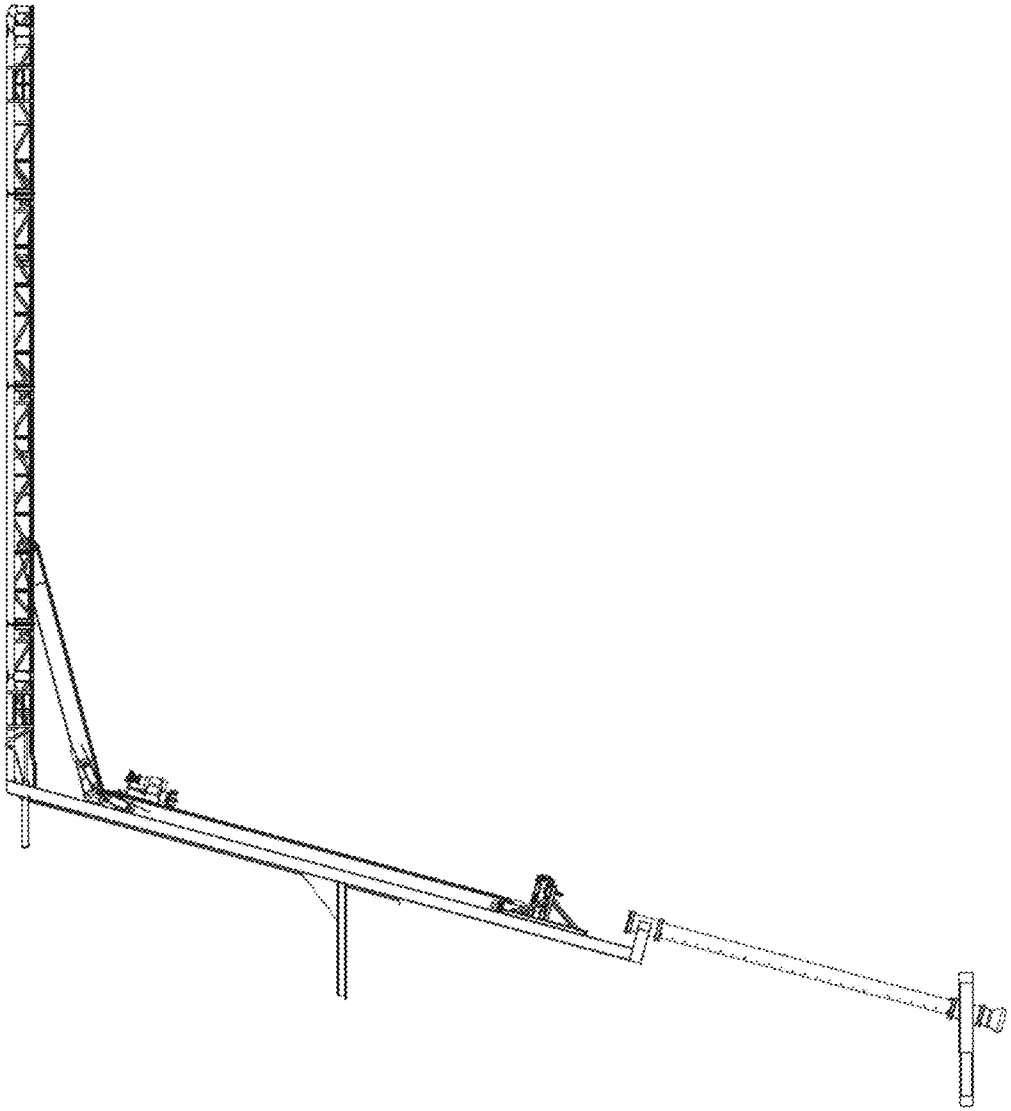
FIGS. 10C, 10D and 10E are additional side elevation views of example apparatus having a variable angle ramp and showing a carriage in different configurations.
Figure 10D:
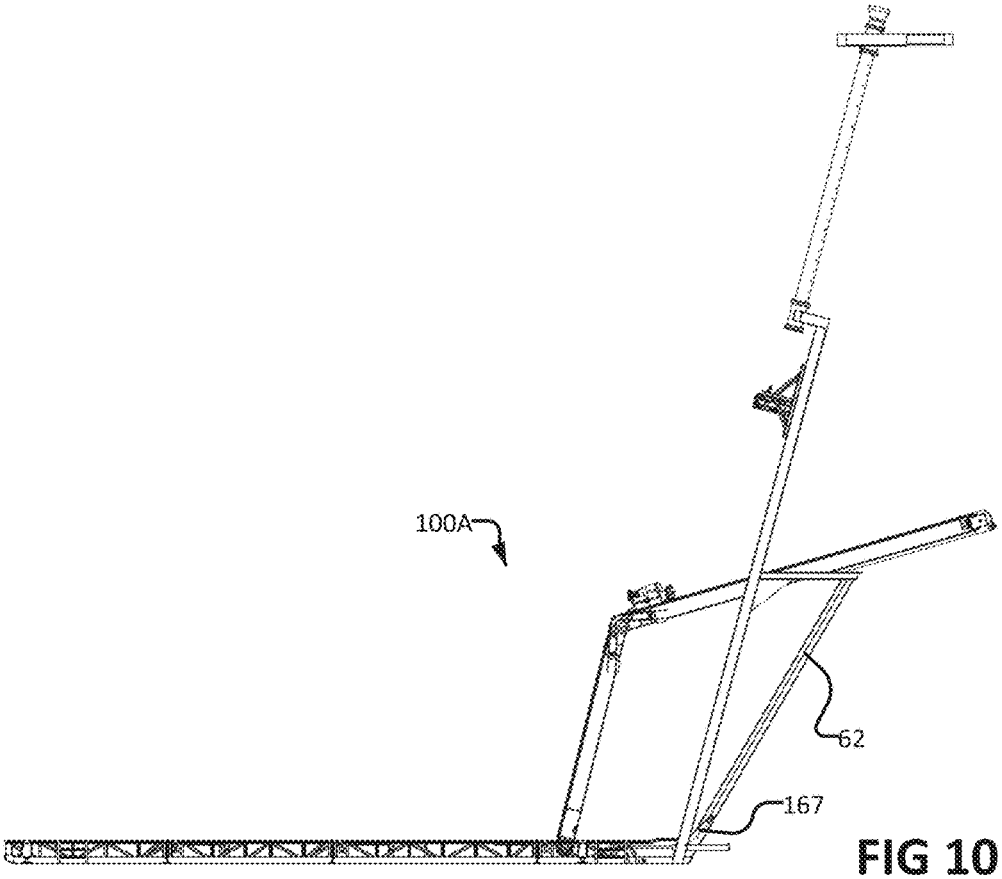
Figure 10E:
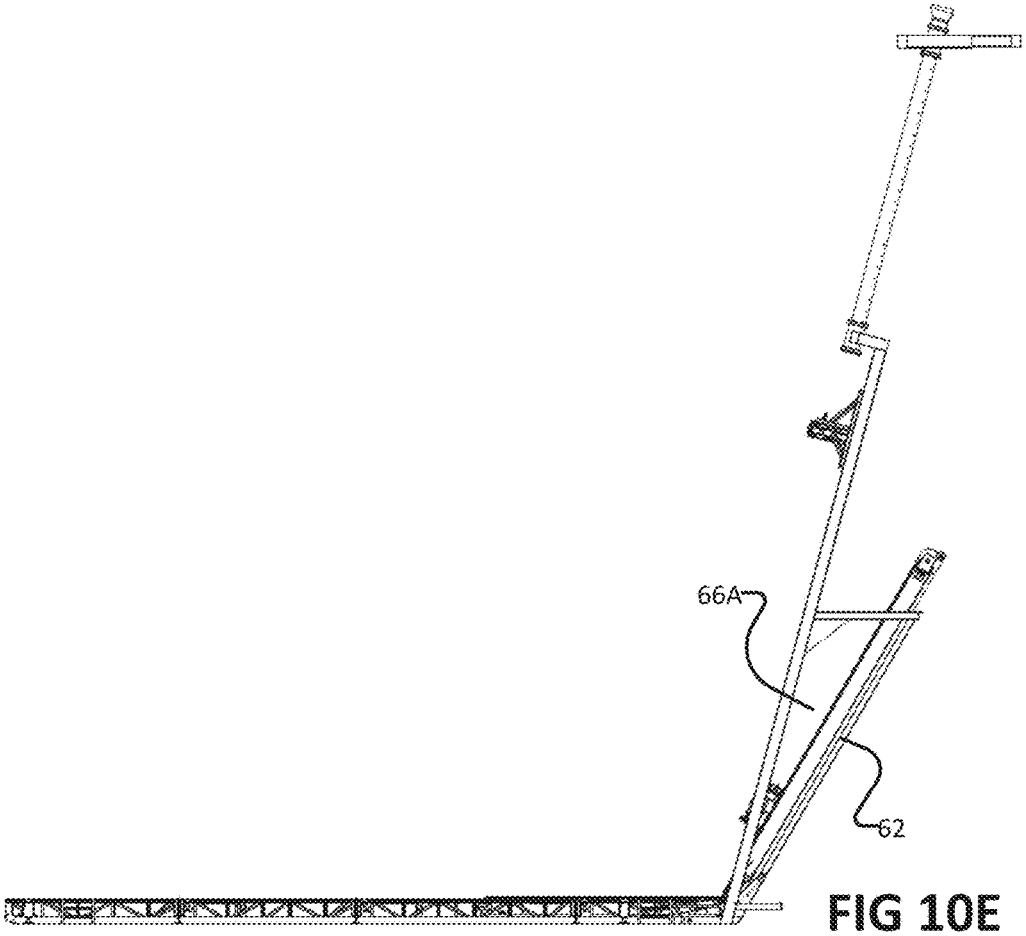

FIGS. 10C and 10D and 10E also illustrate the optional possibility of providing a ramp 62 having a variable angle. As shown in FIG. 10D, ramp 62 may be pivotally movable (for example by actuator 167) between a steeper angle aligned with the stand building axis (as in FIG. 10C) and a shallower angle. Ramp 62 may be set to the shallower angle when carriage 66 is to be projected over the floor of a drill rig (for example to deliver single tubulars to the rig floor or to control motion of the tail end of a stand or a tubular).

Apparatus having a variable angle ramp advantageously provides improved access to under-floor parts of a drill rig when ramp 62 is moved to its steeper configuration.

Figure 10F:
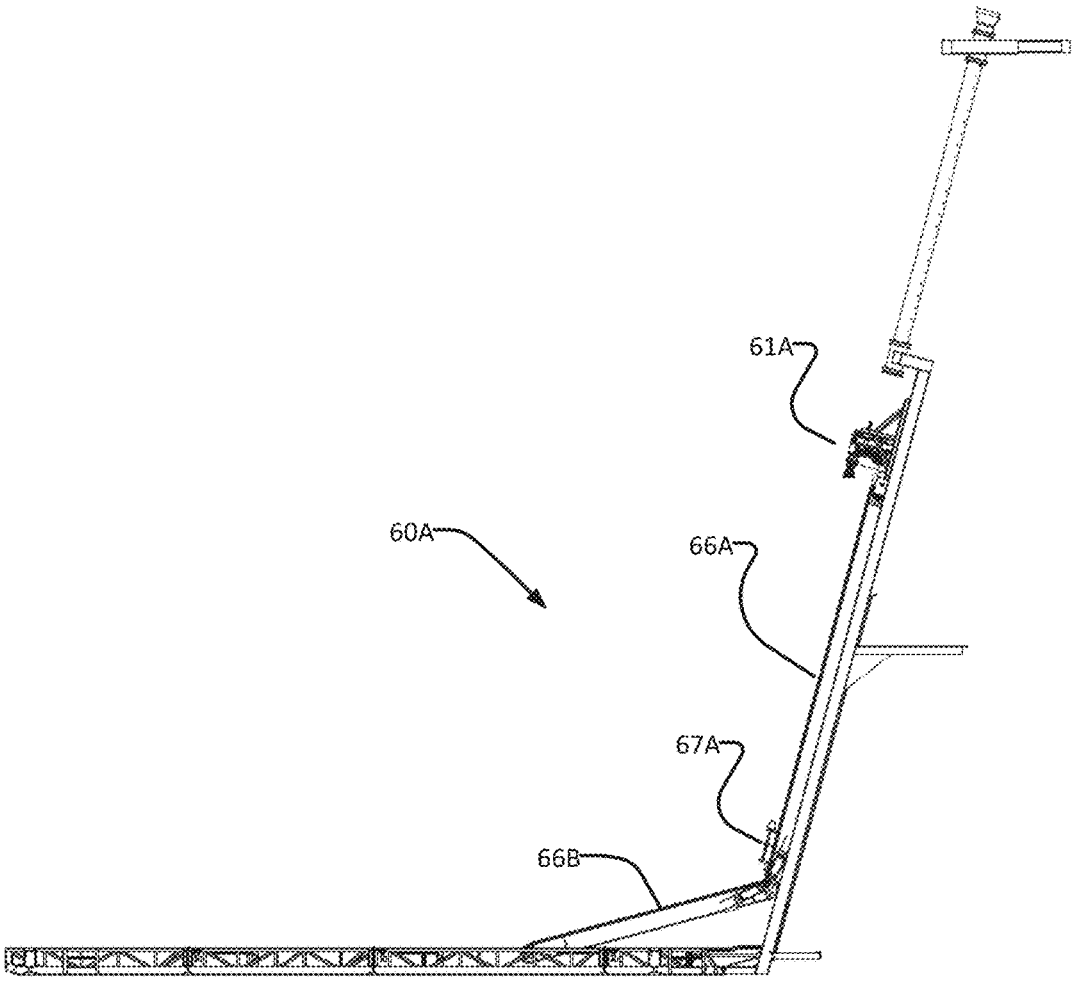
FIG. 10F is a side elevation view of apparatus having an alternative make/break mechanism.

FIG. 10F illustrates apparatus 60A according to an alternative embodiment in which the functions of chuck 67 and backup jaw 64 are combined in an alternative make/break unit 61A. Make break unit 61A may comprise, for example, a power tong as described in U.S. Pat. No. 8,109,179 which is hereby incorporated herein by reference for all purposes. A Turbo Tong TT88™ from, Warrior Manufacturing of Calgary, Canada is an example of a type of equipment that may be used for the make break unit. 61A. Preferably make break unit 61A includes a rotatable jaw and a non-rotating back up jaw. In some embodiments the non-rotating backup jaw is located above the rotatable jaw. Both the backup jaw and the rotatable jaw include a slot or gap to allow a tubular to pass into or out of the make/break unit 61A. A backstop 67A may be provided to position tubulars in make/break unit or to lower tubulars away from make/break unit. Backstop 67A may have any of the backstop configurations described above.

Features of the various embodiments described herein may be mixed and matched in any sensible combinations to yield further embodiments. Apparatus according to embodiments as described herein can handle drilling tubulars between a horizontal storage and staging position and a rig floor single-joint presentation position and a high-angle stand presentation position. Apparatus 60, 60A or 100 can assemble single tubular joints into fully-torqued stands and disassemble the stands. This may be performed independently of normal rig drilling or tripping operations and with no manual interaction with the tubulars. Apparatus as described herein may facilitate efficient hands-free tripping with Range III double stands or Range II triple stands in a manner compatible with horizontal single racking.

In an example embodiment, apparatus includes the following major components: a pipe deck, ramp, conveyor and stand frame. The pipe deck provides a horizontal surface adjacent to the rig vee-door side of a drill rig. The pipe deck may be close to the ground in some embodiments. For example, the pipe deck may be at a 26 inch elevation (approximately 65 cm) above ground level. The pipe deck may include tubular handling provisions such as: a conveyor top vee-trough surface; rocker beams for selective rolling of tubulars into or out of the conveyor; index pins for loading individual tubulars onto the conveyor; kickers for ejection of tubulars out of the conveyor vee-trough; tilting integrated pipe racks for storage or staging of tubulars. Elevating pipe tubs or traditional pipe racks may be positioned adjacent to the integrated pipe racks. Optional equipment such as a tailing winch, bucking machine, self-propelled moving system, and/or pony sub for well center clearance may also be provided.

The ramp provides an inclined surface or guide from the pipe deck to the rig floor, for manual sliding of tubulars and equipment. The ramp includes guidance and lifting provisions for the conveyor. Lift of the conveyor on the ramp may be controlled by suitable drives such as electrical drives. Redundant drives may be provided. The drives may provide variable speed and torque. Conveyor frame support rollers at the top of the ramp facilitate moving the conveyor into cantilevered positions. The ramp is optionally integral and coaxial with the stand frame, if so equipped. The conveyor may comprise a continuous chain conveyor. In an example embodiment the conveyor is approximately L56 ft (about 17 meters), W28 in (about 70 cm) and D19 in (about 50 cm) with steel vee-trough segments for axial movement of tubulars and/or the tailing in/out of tubulars.

In some example embodiments the conveyor is electrically (e.g. using a VFD—variable frequency drive) driven with infinite speed and torque control. The conveyor may include a bi-directional active hinged frame (kink function) for optimum tubular presentation geometry to high rig floors (positive kink) and to enable stand building (negative kink). The kink may be hydraulically actuated, for example. Retractable sidewalls may be provided for lateral tubular safety retention. The sidewalls may be hydraulically actuated, for example. A backstop may be fixed to the conveyor surface, for reaction of tubular axial loads. The backstop may have any of the configurations described above, for example.

Some embodiments provide a drive chuck or other make/break apparatus for tubular rotation for stand building. The drive chuck may, for example, have torque for making up or breaking open tubulars in excess of 30,000 foot-lb. (about 40,000 N·m) in some embodiments. For example, the chuck drive may be able to torque tubulars to 45,000 ft-lb (about 60,000 N·m), 60,000 ft/-lb (about 80,000 N·m), or the like. Grip and rotation of the chuck may for example be hydraulically actuated. A coaxial drive chuck probe may be provided for axial tubular support and positioning.

An elevate function to align the tubular with the drive chuck may be hydraulically actuated, for example. The elevate function may, for example, lift a section of a conveyor sufficiently so that a tubular located in a trough of the conveyor is made to be coaxial with a chuck or other make-break apparatus.

A stand frame may be provided for supporting a stand being built or taken apart. The stand frame may, for example comprise an open frame above rig floor elevation, for support of a slit tube and the back-up jaw. The rotatable slit tube is provided for support of the upper portion of the stand. The slit tube may be actuated hydraulically to rotate. The tube may be telescoping for transport and service (e.g. via a positioning winch which may also be used to position the backup jaw). The back-up jaw (BUJ) is provided for reaction of the drive chuck torque on the adjacent tool joint. Hydraulic grip and hydraulic winch positioning may be provided along the stand-building axis. The stand frame or its components may be configured so that they can be lowered to the pipe deck for service.

A secondary pipe retainer may be mounted to the bottom of the backup jaw. The secondary pipe retainer may be hydraulically actuated. Adjustable feet may be provided for stabilization of the stand frame against the mast of a drill rig. The adjustable feet do not need to be pinned to the mast legs. Apparatus as described may optionally be used together with a vertical pipe racking system. Apparatus as described may accommodate manual ramp operations, including top drive drag-up.

Apparatus like apparatus 60 or 100 or 100A may be used in various operating modes: For example, in a manual pipe handling mode the ramp facilitates conventional manual pick-up of tubulars and equipment with a tugger winch or the travelling equipment. The ramp may, for example, be used to accommodate rig-up of a top drive using either the drag-up or crane method. Apparatus like apparatus 60 or 100 may be used as a high-floor catwalk: The apparatus may be used, for example to transfer Range II or III tubulars to/from the rig floor, for presentation to top drive elevators. A kink function optimizes the tubular angle of presentation on high rig floors. An optional live surface (e.g. conveyor) tailing feature minimizes tubular pendulum action, eliminating the need for manual interaction with the tubular.

Apparatus 60 or 100 or 100A may be used for offline stand building (and/or unbuilding). In this mode, apparatus 100 may assemble and/or disassemble triple Range II or double Range III stands. Apparatus 100 may provide full connection torque capability. Apparatus 100 may present stands to top drive elevators below (or at) racking board elevation. In this mode, manual interaction with the tubulars is not required.

The conveyor tailing feature minimizes tubular pendulum action for hands-free transfer of the stand to/from the vertical, top-drive-suspended position. An online stand-handling mode provides functionality similar to stand building but faster to enable on-line tripping operations. Enhanced actuation speeds may be provided throughout plus semi-automated control sequencing and coordination to minimize cycle time. Double Range III stands are preferred for efficiency. This mode eliminates the derrickman function. Efficient hands-free tripping may be achieved without a vertical racking system.

The following is an example of an offline stand building operation sequence:

a. Load a first tubular T1 onto the conveyor from a pipe handling system. The pipe handling system may, for example, comprise tilting pipe racks, index pins and rocker beams actuated by suitable controls.
b. Elevate the conveyor to align the tubular with the drive chuck axis.
c. Convey the live surface forward, pushing the tubular against the ramp, until the trailing end of the tubular is inserted into the drive chuck and loaded against the drive chuck probe.
d. Lift the leading end of the carriage and negative kink the joint between the carriage sections (lifting and negative kinking may be done simultaneously), until the upper section of the carriage is parallel with the stand building axis.
e. Convey tubular T1 upward along the stand building axis, into the slit tube (slit turned forward, away from well center). Continue to advance tubular T1 until the top of the drive chuck contacts the bottom of the backup jaw and the drive chuck float springs are compressed. At that point the pin end tool joint upset of tubular T1 will be aligned with the backup jaw. Grip the pin end tool joint in the backup jaw.
f. Return the carriage to the starting deck position by lowering the carriage and unkinking the joint between the carriage sections until it is in a neutral position (with the carriage sections aligned). These actions may be performed simultaneously. Activate the secondary pipe retainer (e.g. 64A) to hold tubular T1 in place once the drive chuck is clear.
g. Repeat Steps a, b and c with a second tubular, T2.
h. Grip the pin end of tubular T2 with the drive chuck.
i. Repeat Step d.
j. De-activate the secondary pipe retainer.
k. Convey the second tubular T2 upward along the stand builder axis, until the pin end of tubular T1 stabs into the box end of tubular T2. Continue to advance a few inches more to allow for thread advance; the backup jaw can float upward.
l. Rotate the drive chuck forward to spin & torque the connection.
m. Ungrip the backup jaw and the drive chuck.
n. If the stand being made is a double (e.g. a Range III double), proceed to step o. If the stand being made is a triple (e.g. a Range II triple), repeat step e with tubulars T1 & T2 and perform steps f to m with a third tubular, T3.
o. The assembled stand can remain in this position until drilling operations need it. The top end of the stand will remain comfortably clear of the top drive travel.
p. To transfer the stand to the top drive, use the link tilt of the top drive to position the elevators onto the top portion of the stand (handles toward well center) and close the elevators. The stand can optionally be conveyed upward to minimize the link tilt reach requirement.
q. Rotate the slit tube so that the slit is facing toward well center.
r. Hoist the top drive with the link tilt in float mode.
s. When the bottom of the stand nears floor level elevation, reverse the kink (from negative to positive kink) so that the upper end of the conveyor is cantilevered over the rig floor.
t. With the top drive link tilt in 'maintain' mode hoist and simultaneously convey the stand upward to control the tailing in of the stand, minimizing pendulum action.

An offline stand unbuilding operation sequence can be essentially the reverse of the stand building sequence above.

Figure 11A:
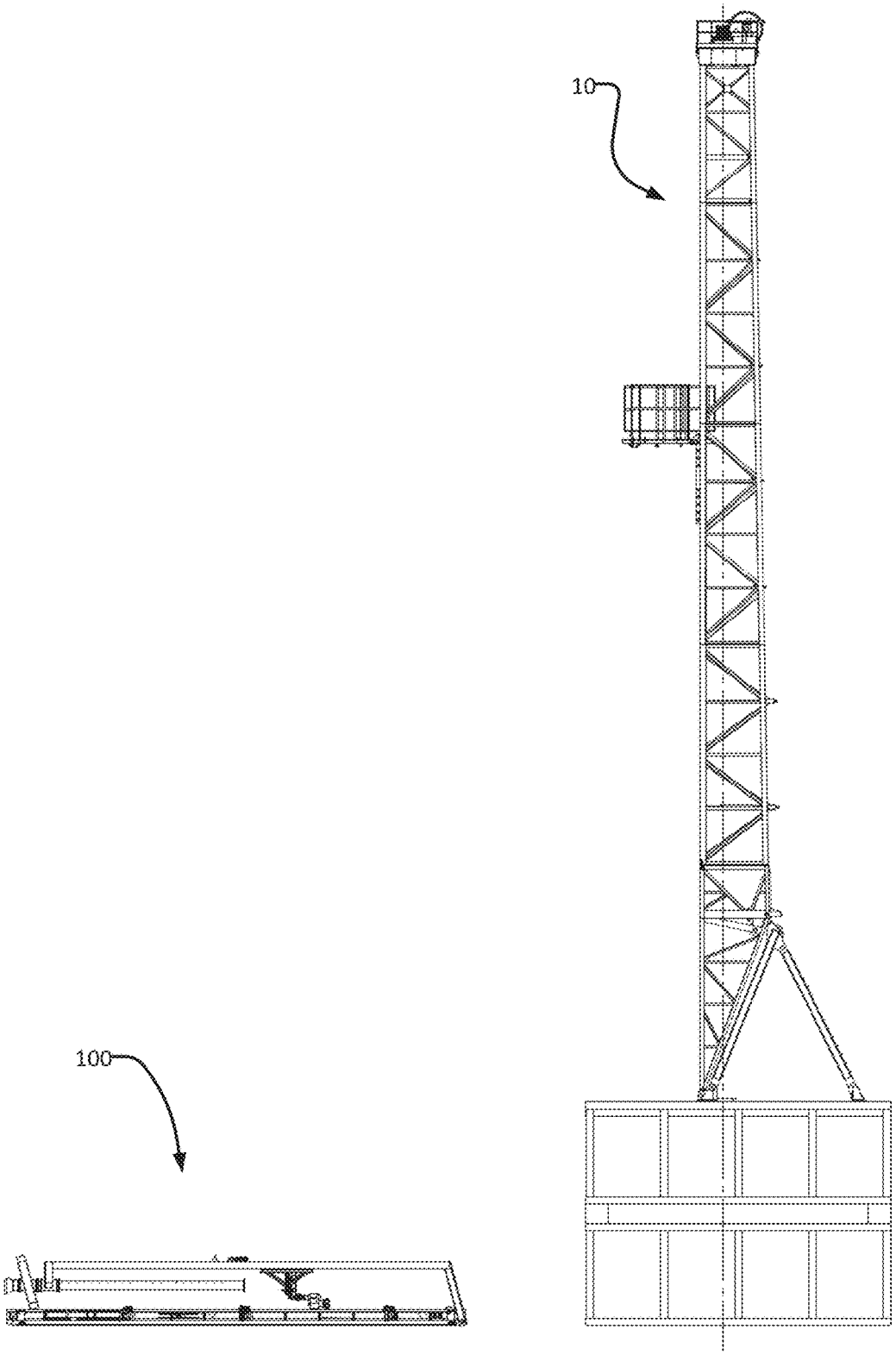
FIGS. 11A to 11J show the apparatus like that of FIGS. 10A and 10B at various stages in the process of building and delivering a stand to a drill rig.
Figure 11B:
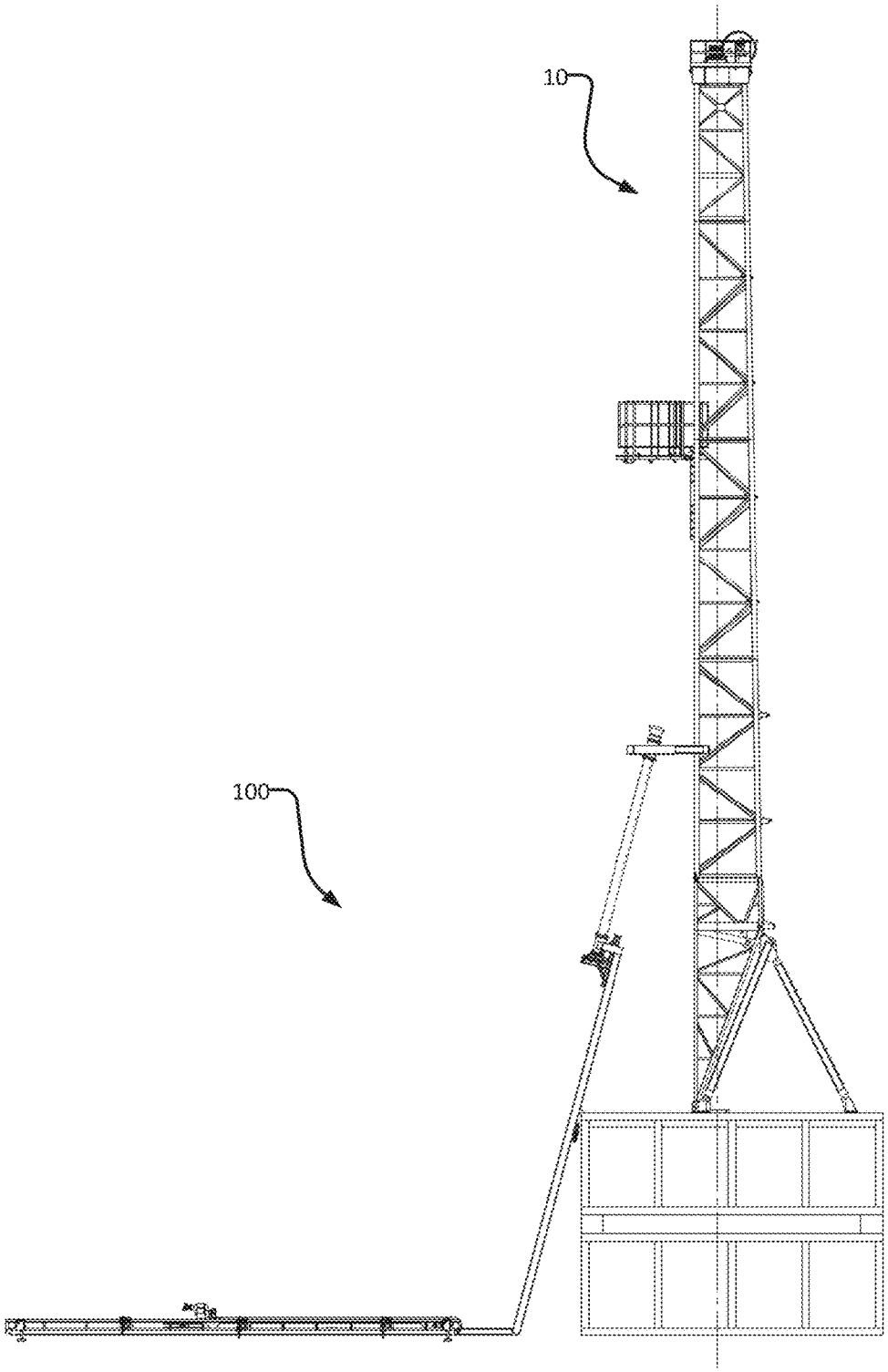
Figure 11C:
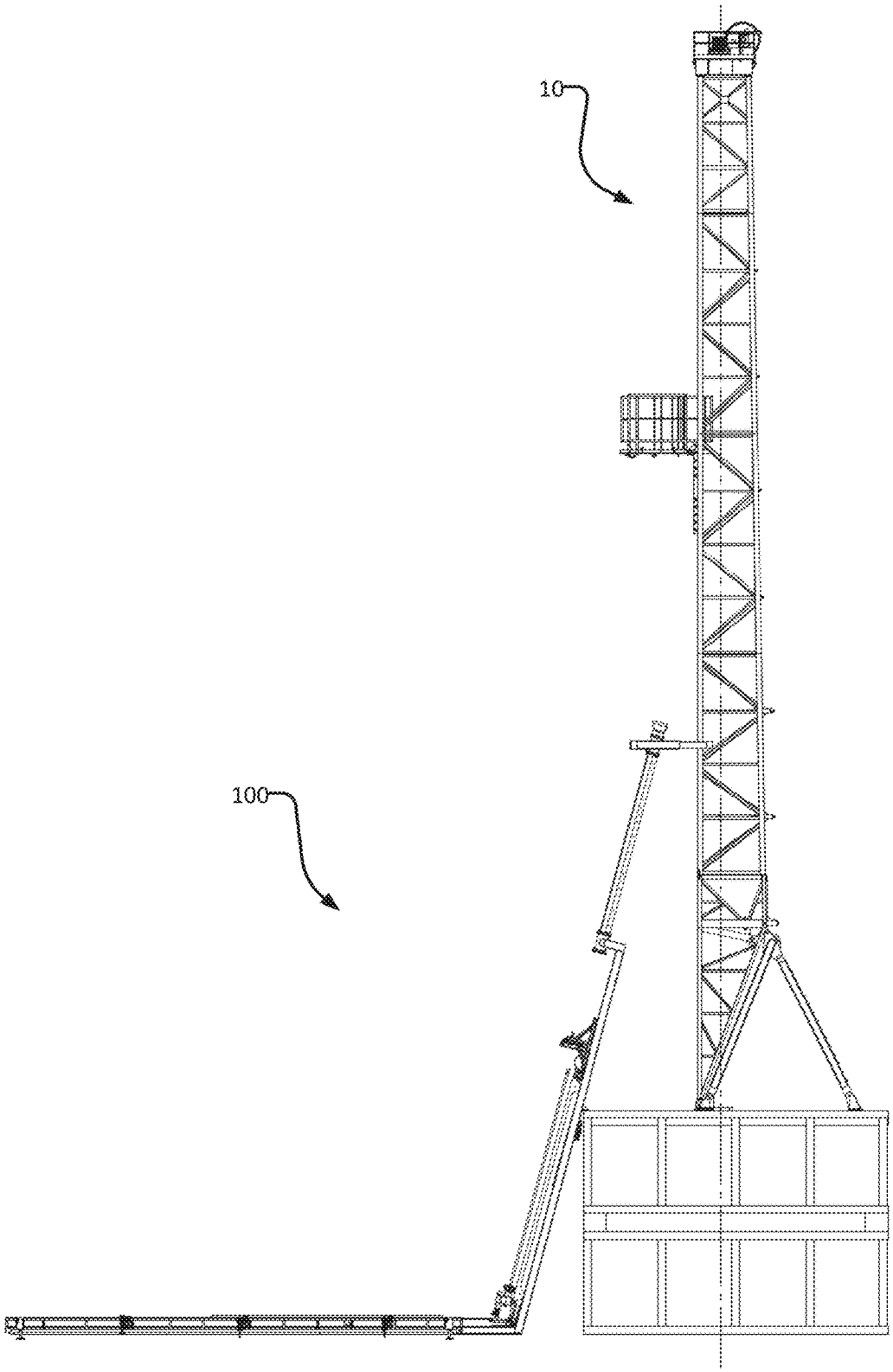
Figure 11D:
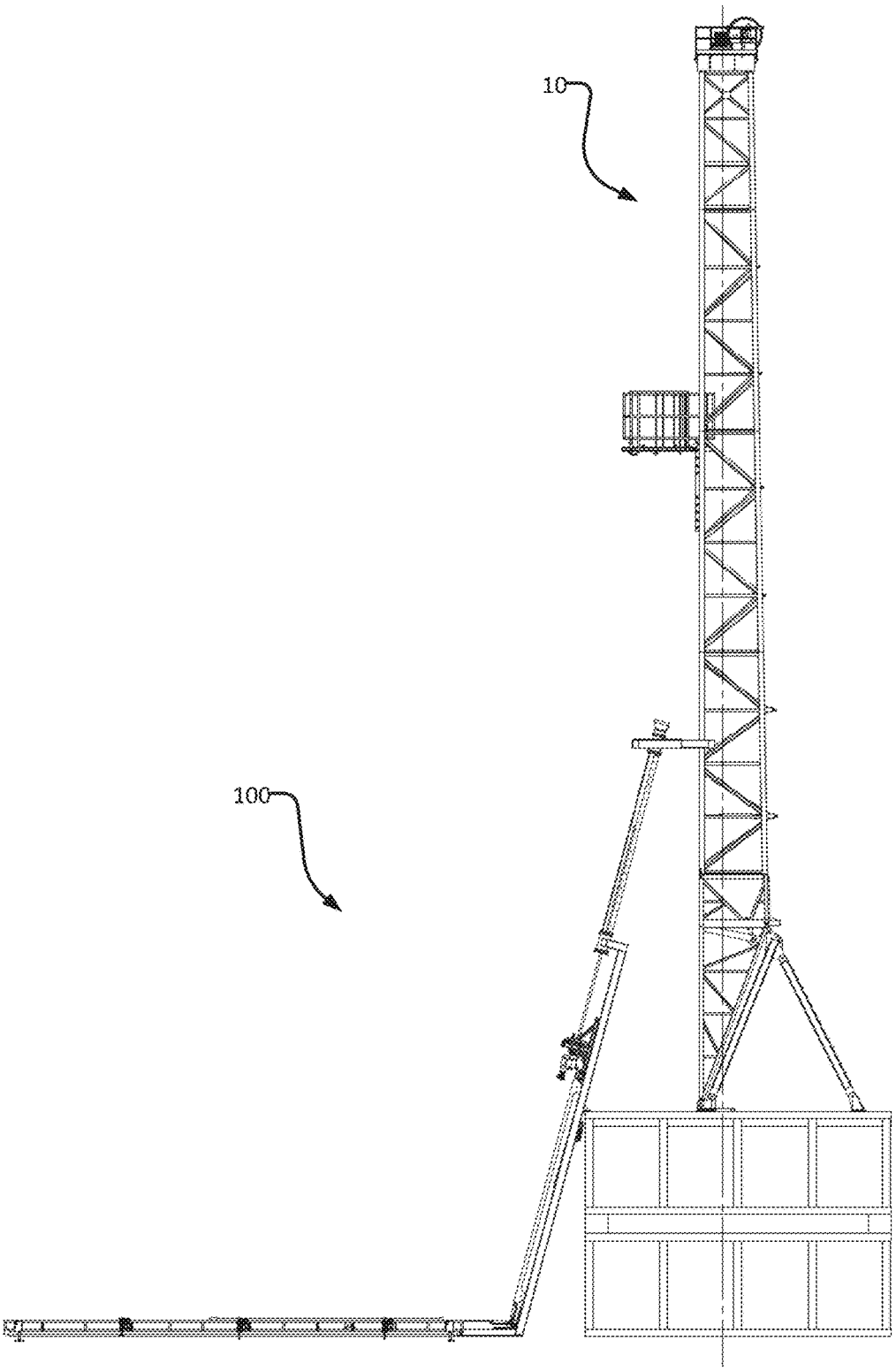
Figure 11E:
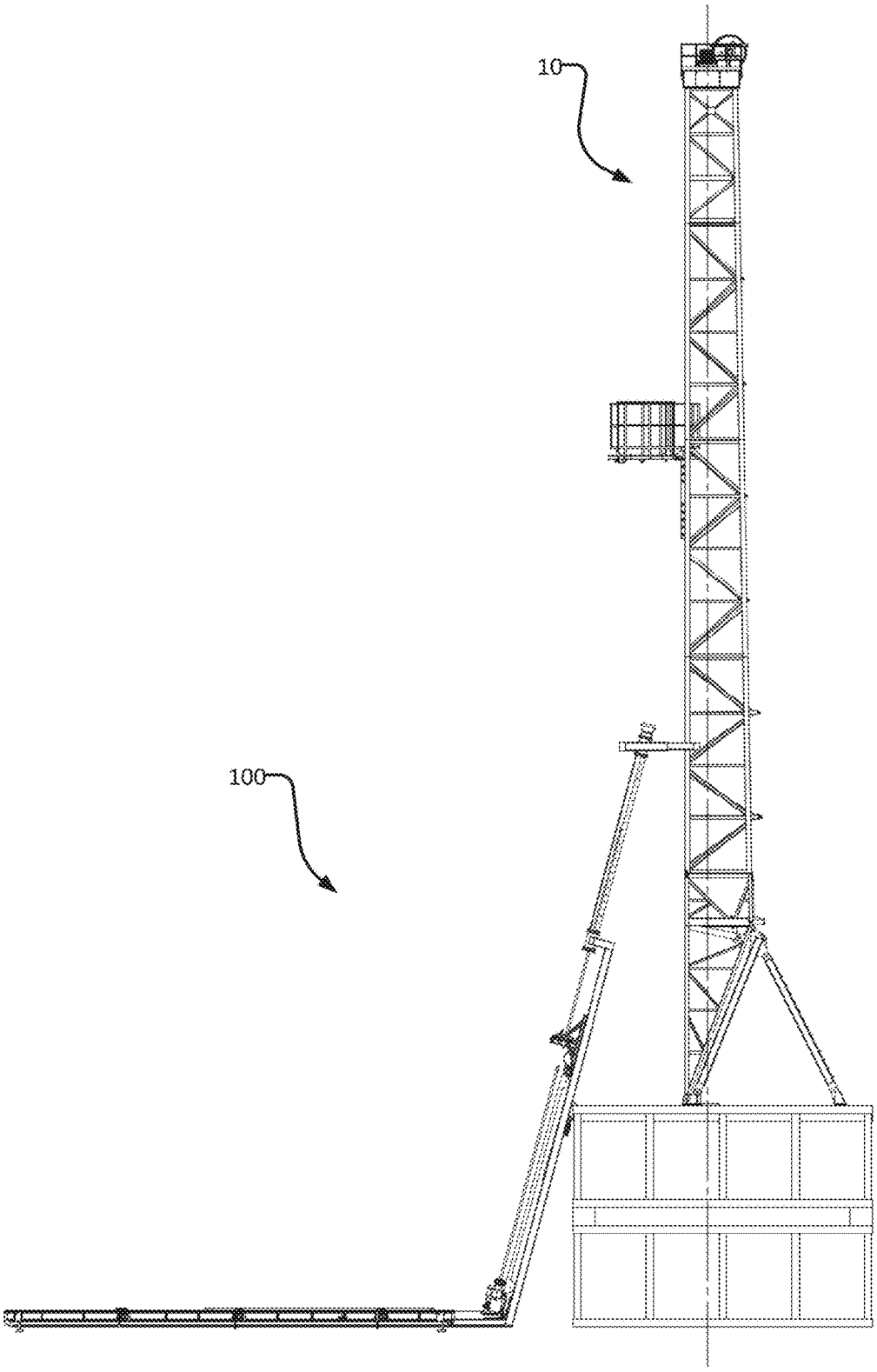
Figure 11F:
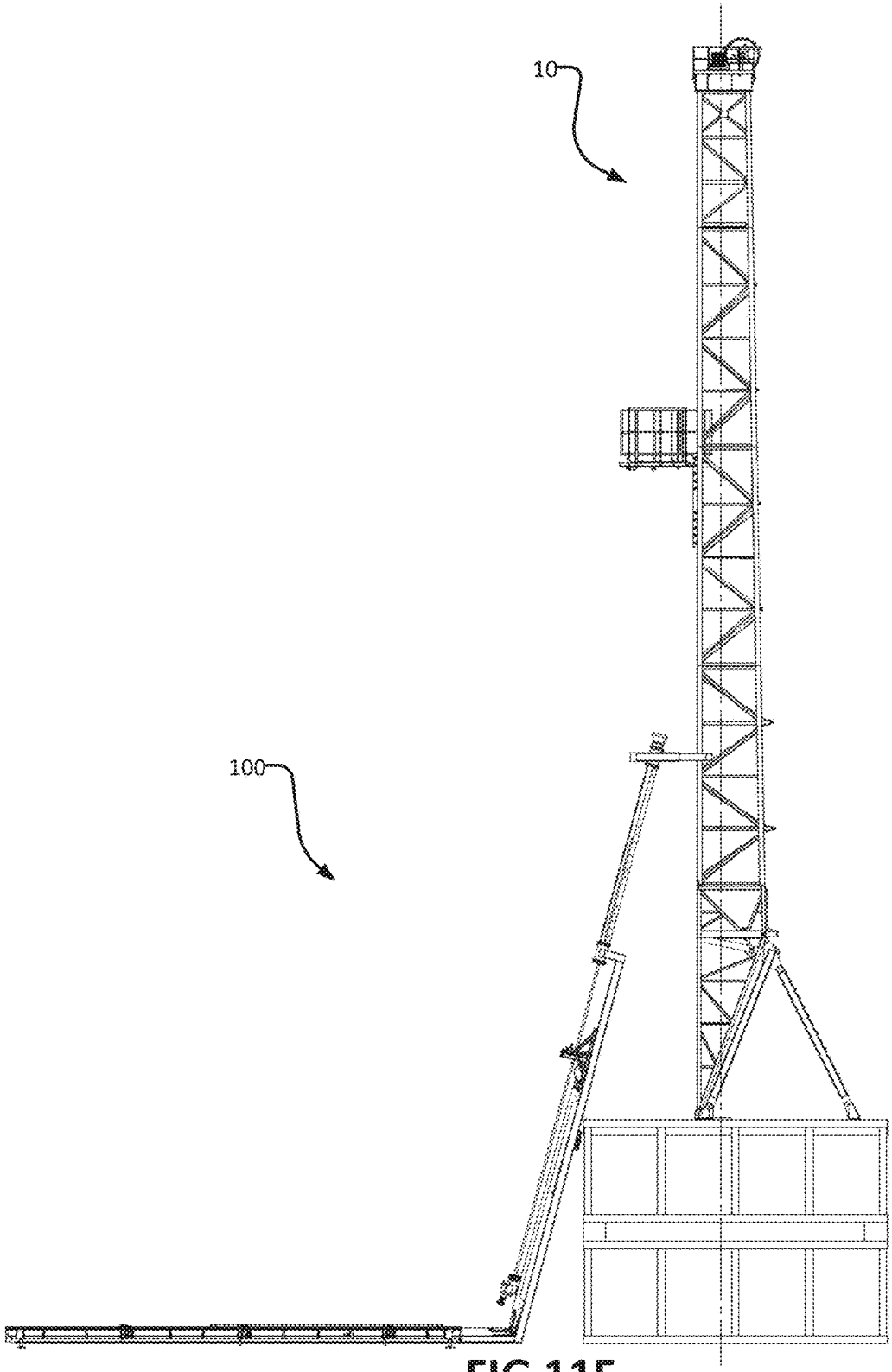
Figure 11G:
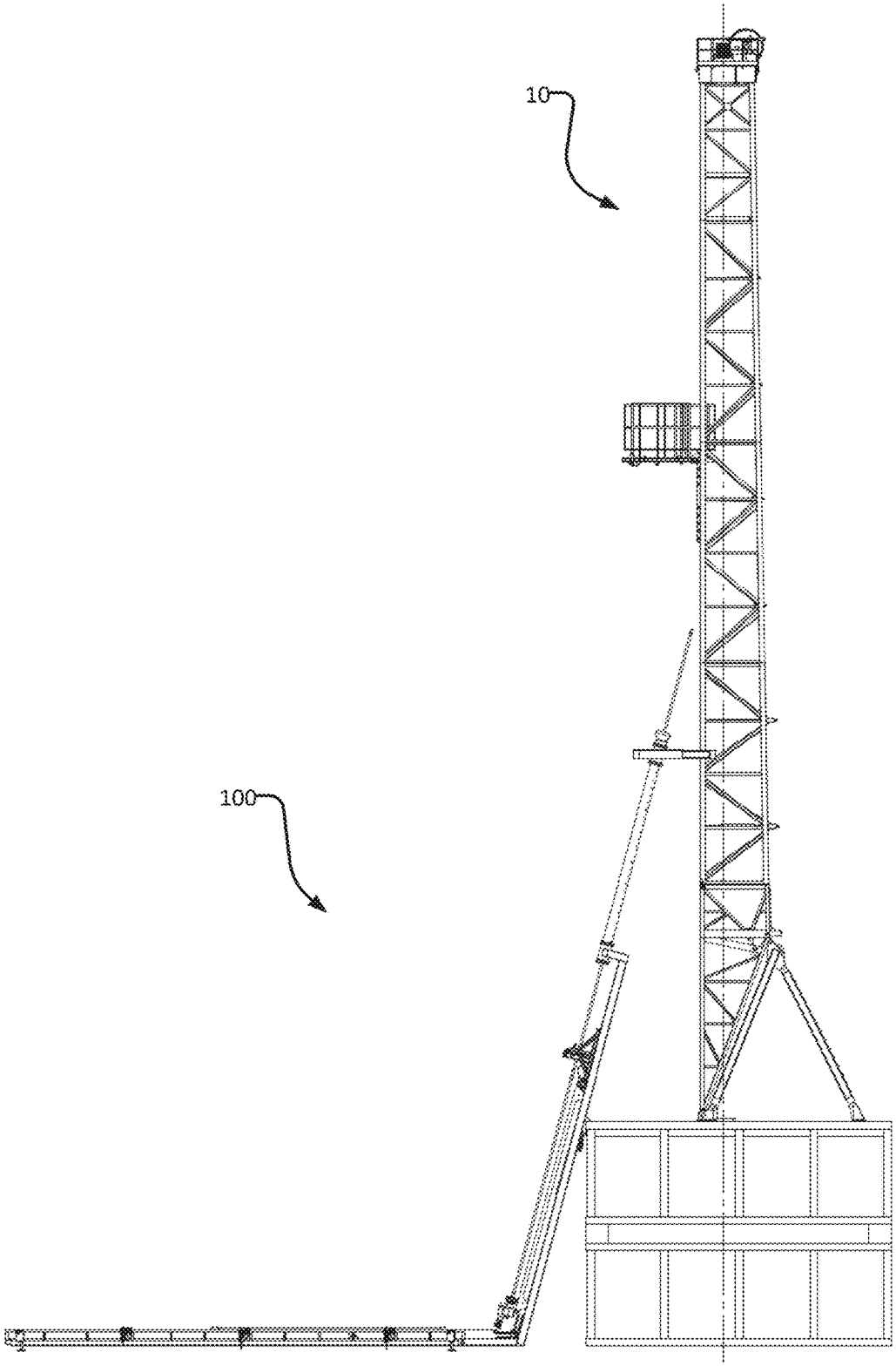
Figure 11H:
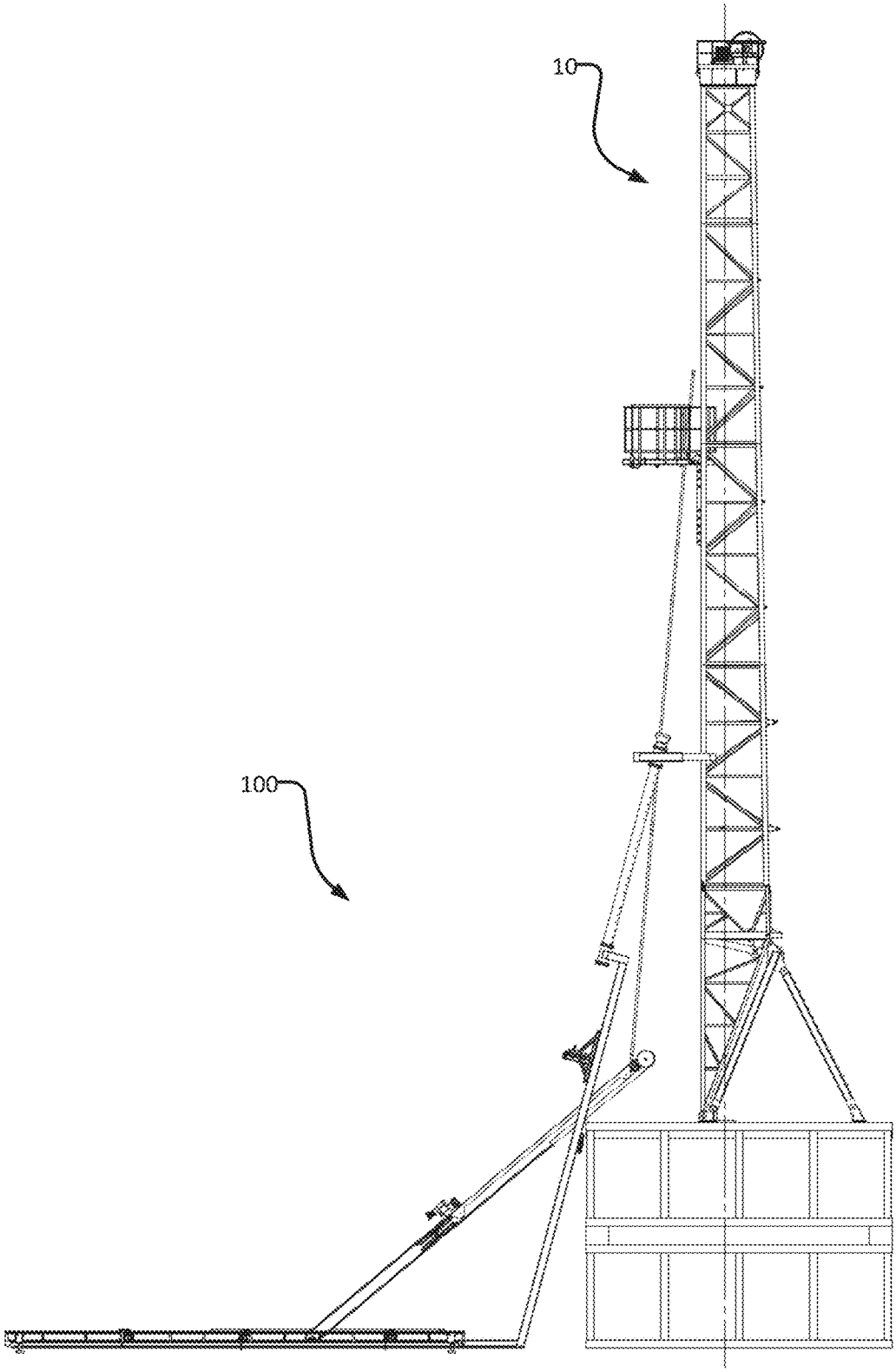
Figure 11I:
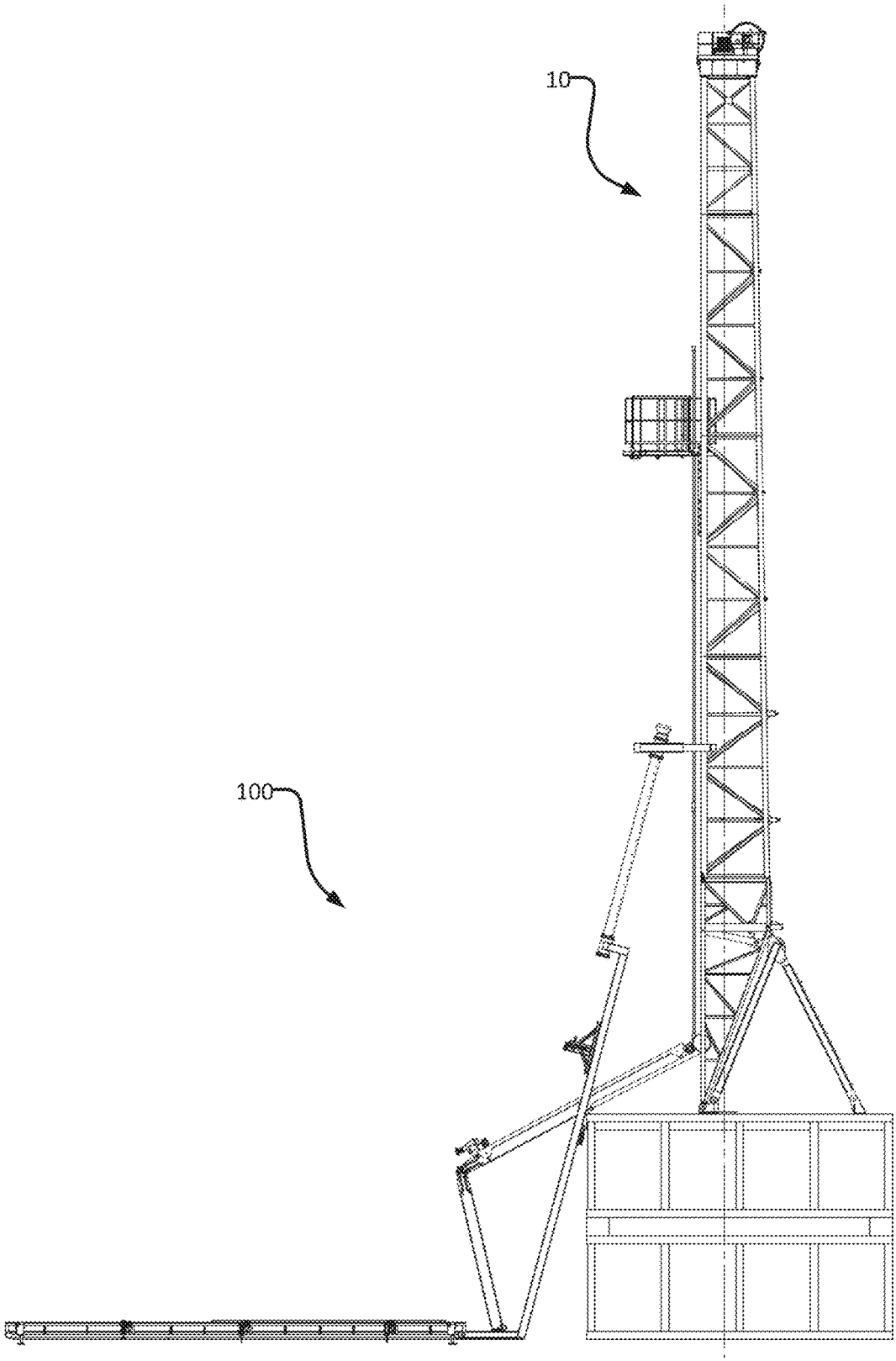
Figure 11J:
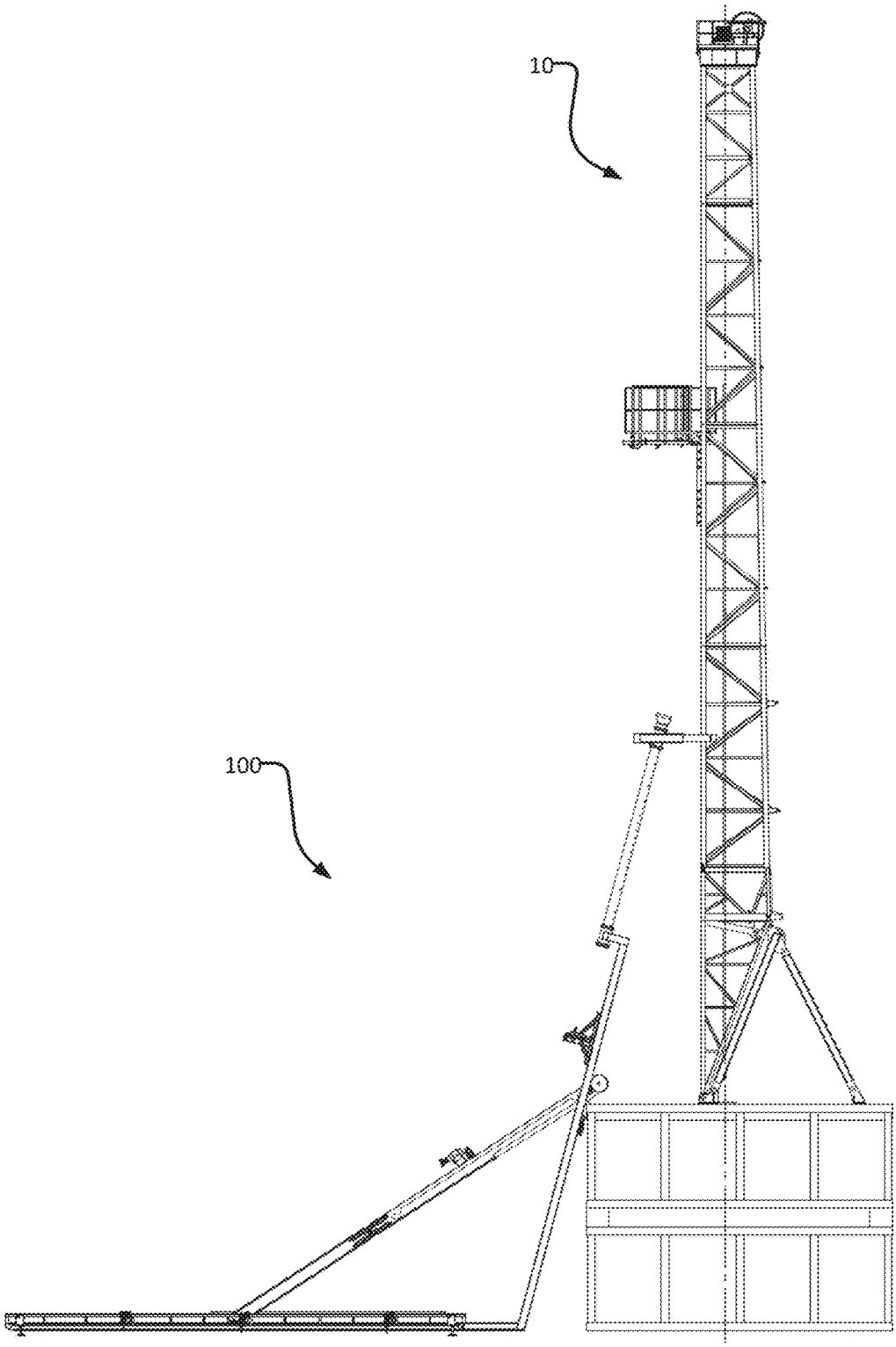

FIGS. 11A to 11I illustrate configurations of apparatus 100 in a sequence of steps for building a stand and delivering the stand to a drill ring. FIG. 11A shows apparatus 100 in a transport configuration. FIG. 11B shows the apparatus erected for use. FIG. 11C shows a first tubular aligned with a backup jaw and being readied to be advanced through the backup jaw. FIG. 11D shows the first tubular being advanced through the backup jaw. FIG. 11E shows a second tubular aligned with the first tubular. FIG. 11F shows the second tubular engaged with the first tubular which is being held by the backup jaw. FIG. 11G shows a third tubular engaged with the second tubular which is held by the backup jaw. FIG. 11H shows a stand made of a number of tubulars being hoisted into the drill rig while the tail end of the tubular is being controlled by a carriage. FIG. 11I shows how the carriage may be moved to deliver the tail end of a stand near well center. FIG. 11J shows the carriage being retracted away from well center.

Figure 12A:
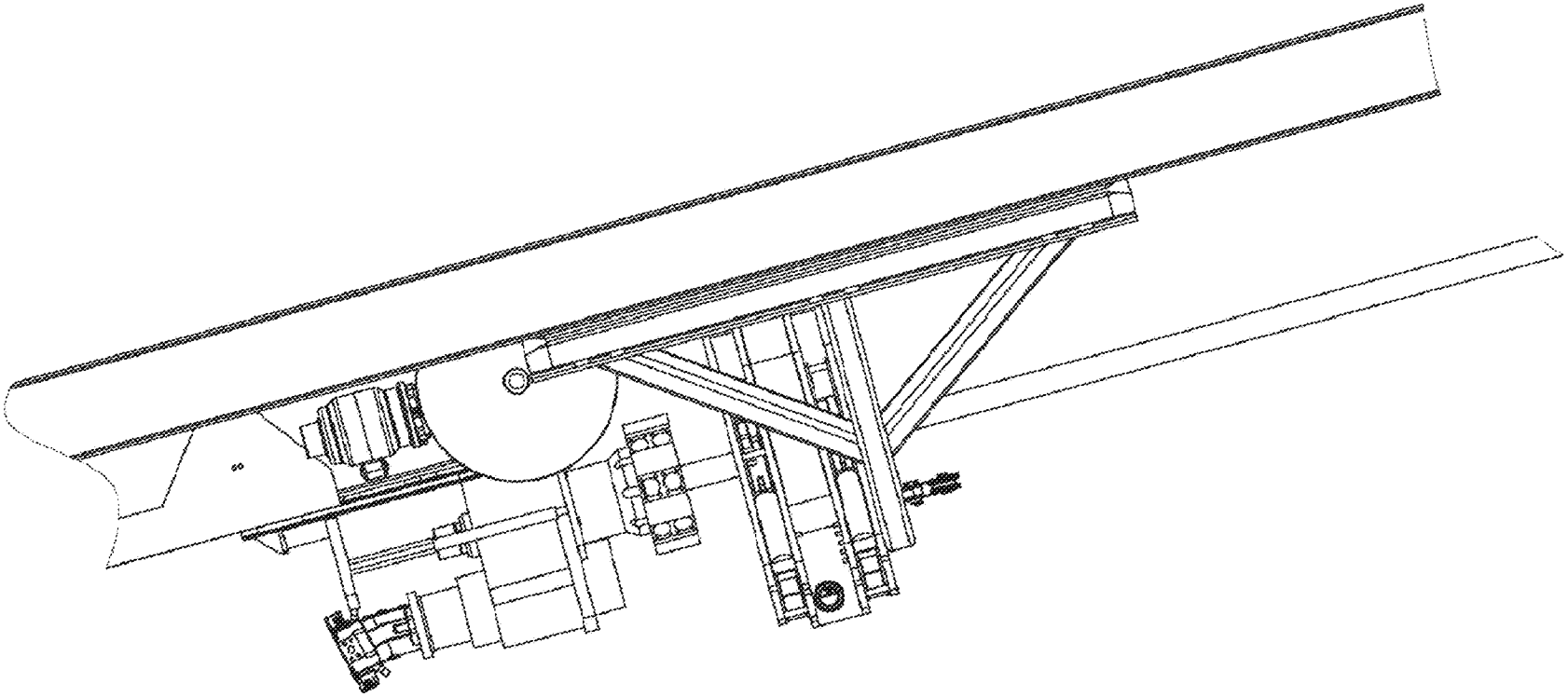
FIGS. 12A and 12B illustrate passing off of a tubular from a chuck to a backup jaw.
Figure 12B:
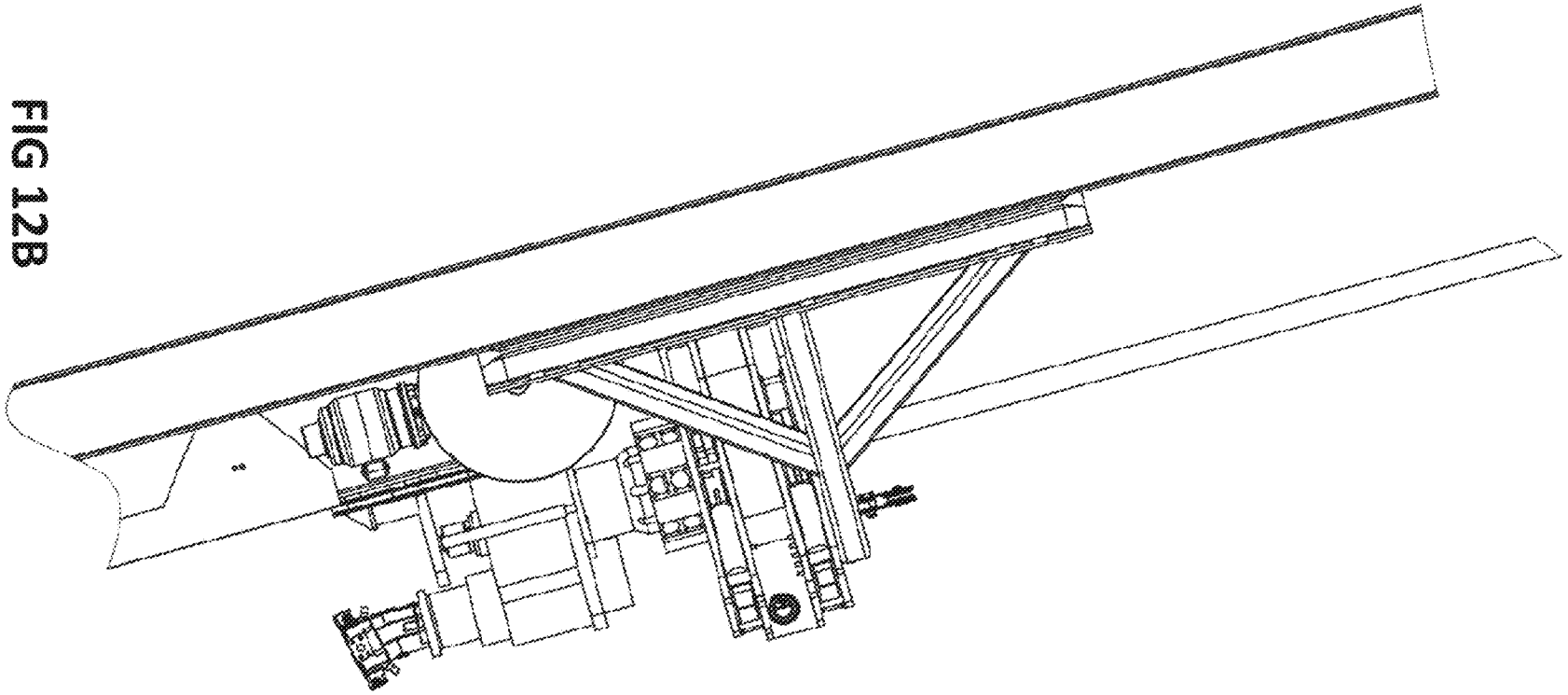

FIGS. 12A and 12B illustrate an example construction of a chuck and backup jaw and the passing of a tubular from the chuck to the backup jaw.

Figure 13A:
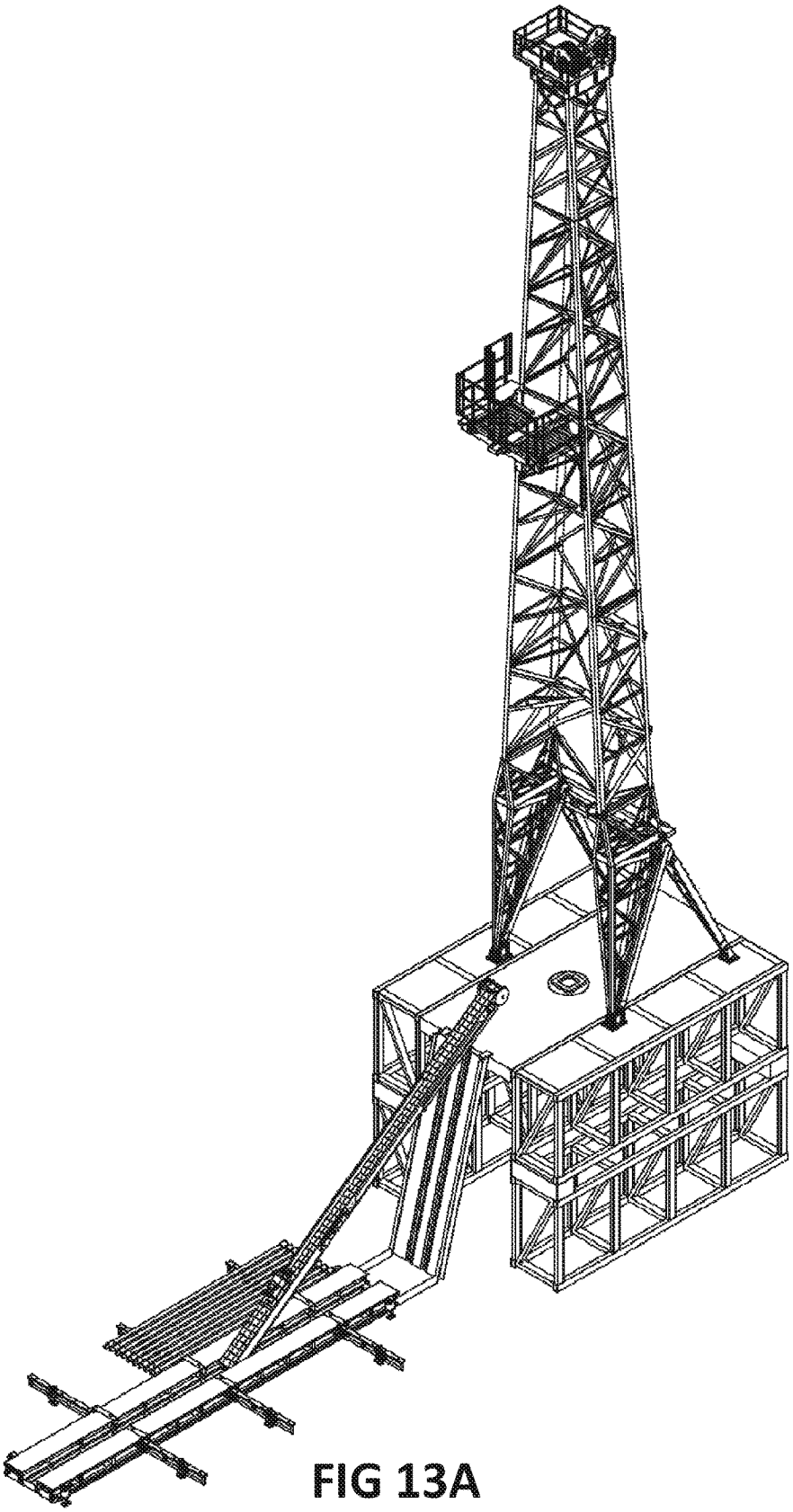
FIGS. 13A and 13B show a high floor catwalk having an actuated kink according to an example embodiment.
Figure 13B:
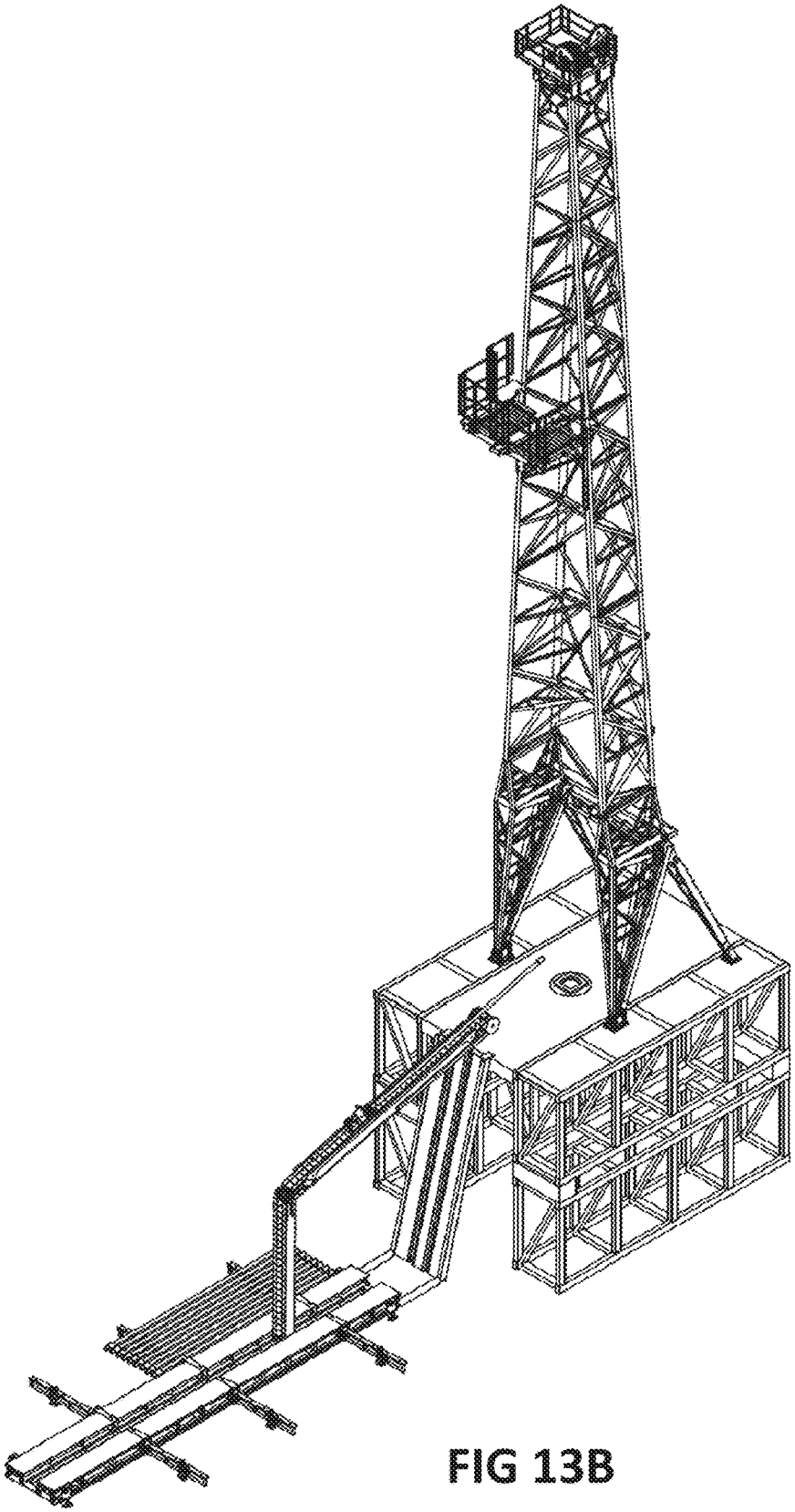

FIGS. 13A and 13B show apparatus that includes a carriage. The carriage is in a neutral (straight) position in FIG. 13A. The carriage has been controlled to provide a positive kink in FIG. 13B. The apparatus of FIGS. 13A and 13B lacks a stand-building mast. The apparatus may optionally be provided with a conveyor or other live surface as described above and/or with an actuator to directly control the angle of kink. The actuator may be arranged to selectively set the kink angle to any of a positive, neutral or negative kink in some embodiments.

Apparatus as described herein (e.g. apparatus 20 or apparatus 60 or apparatus 100 or any other apparatus as described herein) may be constructed so that it can telescope or fold for transportation.

Various control systems may be provided for a live surface such as a conveyor. In some embodiments motion of a live surface is manually controlled. In some embodiments motion of the live surface is at least semi-automated. A manually controlled embodiment may, for example, provide a control which allows a user to vary a speed of a live surface such as a conveyor 70. In some embodiments apparatus is provided to assist a user to control the live surface in such a manner that the tail end of a tubular or stand is brought to a stop just before the tubular is lifted off of the live surface.

One examples of an assistive device is a camera located to view an elevator that is lifting the tubular and a monitor connected to display images acquired by the camera to an operator. The operator may operate the speed control to push the tubular faster until the user sees that the tubular has pushed through the elevator by a suitable distance. The operator may then slow the live surface as the orientation of the tubular is nearing vertical.

Another example of an assistive construction is the provision of markings along side live surface 26. An operator may view the progress of the tail end of a tubular along the live surface with reference to the markings to determine when to vary the speed of the live surface in order to control swinging of the tubular. In some embodiments the markings are movable to adjust the markings to provide proper control over tubulars of a particular length. Markings may be provided by lamps such as LEDs, projected lights, protrusions, painted strips, or the like.

In some embodiments a controller is configured to automatically or semi-automatically control motion of a tail end of a tubular. The controller may base such control on any of or any combination of a wide range of inputs that are relevant to the position and orientation of the tubular. These inputs can include, for example:

- Output of a weight sensor that measures a force applied by the tail end of the tubular on the live surface. As the tubular is advanced by the live surface and is lifted up relative to the elevator the applied force would be expected to increase;
- Output of a position sensor that detects a location of the tail end of the tubular along the live surface. An example of a position sensor is an optical sensor or proximity sensor. A number of sensors may be provided along the live surface. Pressure sensors under or incorporated into the live surface may also or in the alternative provide signals that indicate detect the position of the tail end of the tubular by determining where pressure is being applied to the live surface;
- Output of control systems for a hoist and/or top drive that indicate parameters such as top drive elevation, hoisting speed, top drive elevator link tilt angle etc. that affect the orientation and position of the tubular;
- Output of a sensor that indicates the weight being supported by the elevator;
- Output of a sensor that indicates a position of a top end of the tubular (e.g. how far the top end of the tubular is projecting past the elevator). The sensor may provide an analog output and/or provide signals indicative of whether or not the tubular is projecting past one or more trip points.
- Output of a sensor that indicates a length of the tubular (a tubular may be measured, for example, while it is being transferred to a rig floor or stand builder as described above, for example by detecting a position of a backstop or chuck when the backstop or chuck has advanced the tubular to a known position or detecting a position of an end of a tubular using sensors when the other end of the tubular is in a known position or detecting positions of both ends of a tubular using position sensors or reading a RFID or other marker that is associated with a previously-recorded length for the tubular).

In some embodiments the controller is configured to vary the speed of the conveyor or other live surface in coordination with the position of the top end of the tubular and the rate at which the top end of the tubular is being raised or lowered. In some such embodiments the controller is configured to compute an angle of the tubular relative to an axis (e.g. a vertical axis) and to vary the speed of the conveyor based at least in part on the determined angle. For example, the controller may cause the live surface to reduce a speed of the tail end of the tubular when the tubular is nearly vertical.

In some embodiments the controller uses a known geometry resulting from a length of a tubular, the position and path taken by the live surface and the position and height of the elevator lifting the tubular to advance the tubular along the live surface at a rate sufficient to lift the top end of the tubular relative to the elevator. This may be done 'blind'—based on the geometry alone. For example, if the live surface is flat then, using the law of cosines, the length of a tubular and the location of the elevator relative to the live surface, one can compute the position that the tail end of the tubular will have along the live surface when there is no slack between the tubular and the elevator. The controller may calculate this position and advance the live surface so that the tail end of the tubular is advanced toward the well center relative to the calculated position. In some simpler embodiments the controller simply operates the live surface to move the tail end of the tubular toward well center at a speed sufficient to cause slack at the elevator for a current known or expected hoisting speed.

In some embodiments the controller monitors sensors to detect slack between the tubular and the elevator. Slack may be detected by any one or more of: measuring weight on the elevator (which goes down when there is slack); measuring weight on the live surface (which goes up when the elevator is slack); detecting that the tubular projects more than a threshold amount above the elevator by a proximity sensor, electric eye or the like or image processing an image obtained by a camera having a view of the elevator and tubular, for example. In some cases the controller may also measure an amount of slack created by the tubular being pushed up relative to the elevator.

After slack has been detected, the controller may operate the live surface to carry the tail end of the tubular toward a release zone from which the tubular will be lifted off of the live surface. On approaching the release zone the controller may automatically reduce speed of the tail end of the tubular such that the tubular has zero or only a very small angular velocity when it arrives in the release zone. For example, the linear speed of the tail end of the tubular along the live surface may be reduced to 10 inches per second (about 25 cm/sec) or less.

In order to track the position of the tail end of the tubular along the live surface the controller may use calculation (e.g. based on a controlled speed of the live surface and/or feedback from a motion control driving the live surface) and/or output from one or more sensors. The sensors may directly detect the position of the tail end of the tubular using optical or other means such as electric eyes, proximity sensors, cameras, or the like. In addition or in the alternative the sensors may sense the location of pressure exerted by the tubular on the live surface.

In some embodiments a controller is configured to warn an operator and/or to perform an emergency stop if the stickout of a tubular past an elevator 13A exceeds some predetermined safe threshold. Such a system may prevent a tubular from spearing a top drive 13, for example.

In some embodiments, the controller is configured to drive a conveyor to move faster during tripping out and to drive the conveyor more slowly when drilling or tripping in.

A controller may be formed from any suitable processing system, such as a custom configured device, such as a micrologic controller, field programmable gate array (FPGA), programmable logic controller (PLC), or a suitably programmed PC, or the like. Control systems may additionally or in the alternative comprise hard-wired logic such as ASICS or dedicated logic circuits.

The control methods described herein may be implemented by computers comprising one or more processors and/or by one or more suitable processors, which may, in some embodiments, comprise components of suitable computer systems. By way of non-limiting example, such processors could comprise part of a computer-based control system which also controls other components of apparatus as described herein or as a stand-alone control system. In general, such processors may comprise any suitable processor, such as, for example, a suitably configured computer, microprocessor, microcontroller, digital signal processor, field-programmable gate array (FPGA), PLC, other type of programmable logic device, pluralities of the foregoing, combinations of the foregoing, and/or the like. Such a processor may have access to software which may be stored in computer-readable memory accessible to the processor and/or in computer-readable memory that is integral to the processor. The processor may be configured to read and execute such software instructions and, when executed by the processor, such software may cause the processor to implement some of the functionalities described herein.

Certain implementations of the invention comprise computer processors which execute software instructions which cause the processors to perform a method of the invention. For example, one or more processors in a computer system or industrial control system may implement data processing steps in the methods described herein by executing software instructions retrieved from a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical (non-transitory) media such as magnetic data storage media including floppy diskettes, hard disk drives, optical data storage media including CD ROMs, DVDs, electronic data storage media including ROMs, flash RAM, or the like. The instructions may be present on the program product in encrypted and/or compressed formats.

Figure 14A:
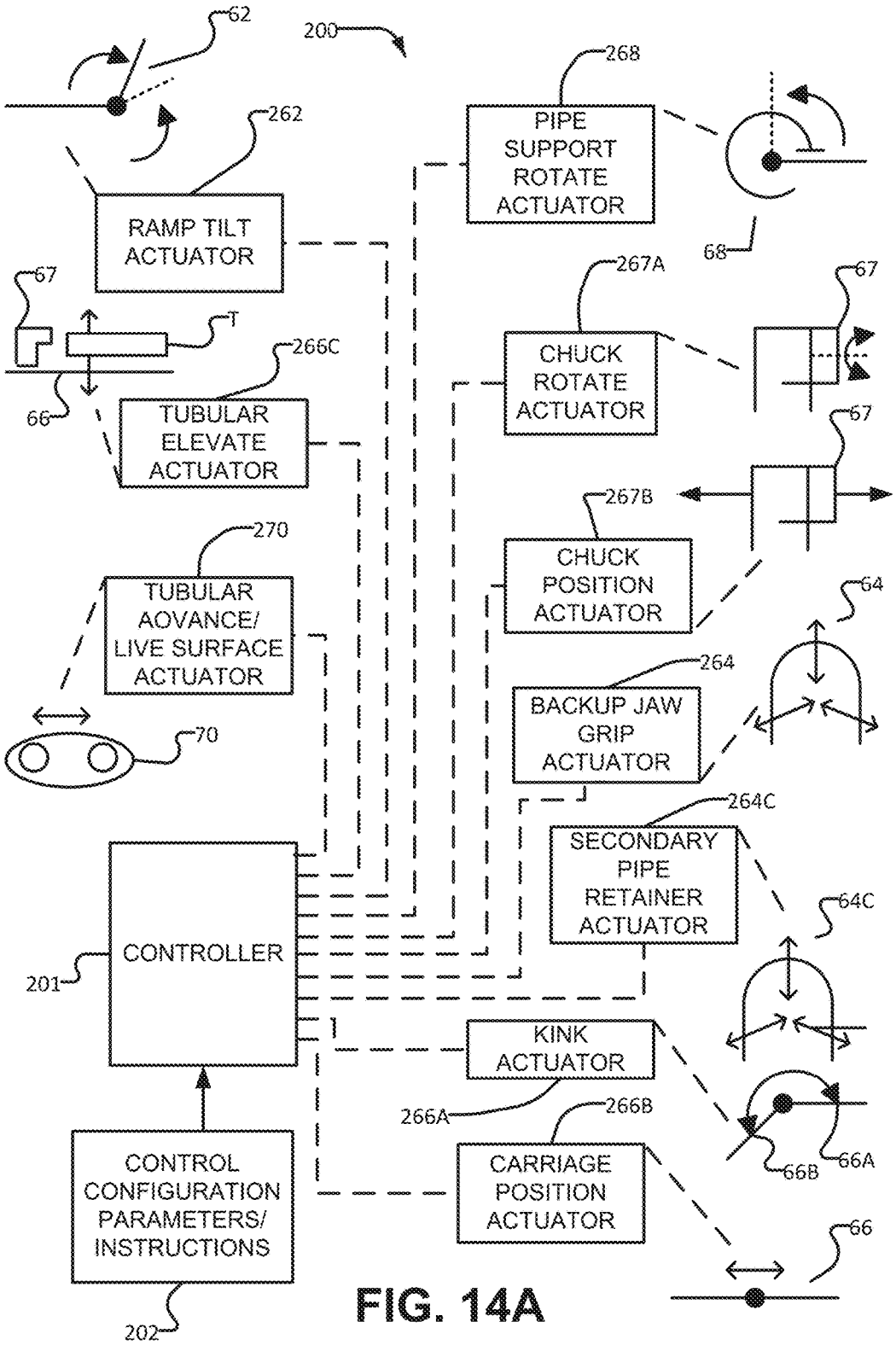
FIGS. 14A and 14B respectively illustrate example control systems for a stand builder and for a live surface/tailing controller. Control systems like these may be combined in some embodiments.

FIG. 14A shows an example control system 200 for a stand builder as described herein. Control system 200 comprises a controller 201 which has access to a data store 202 containing parameters and/or instructions for execution by controller 201. Controller 201 is connected to control actuators for a stand builder apparatus (e.g. an apparatus like apparatus 60). In the illustrated embodiment controller 201 is connected to control: a ramp tilt actuator 262; a backup jaw grip actuator 264; a secondary pipe retainer actuator 264C (the secondary pipe retainer may comprise a second backup jaw, a set of rollers capable of gripping a tubular, a clamp, or other mechanism capable of holding a tubular in place temporarily as described above); a kink actuator 266A; a carriage position actuator 266B; a tubular elevate actuator 266C; a chuck rotation actuator 267A; a pipe support rotate actuator 268; a chuck position actuator 267B; and a live surface actuator 270. Instructions in data store 202 may coordinate operation of the stand building apparatus to build or unbuild a stand as described herein and/or to pass the stand to or receive the stand from a drill rig also as described herein.

Figure 14B:
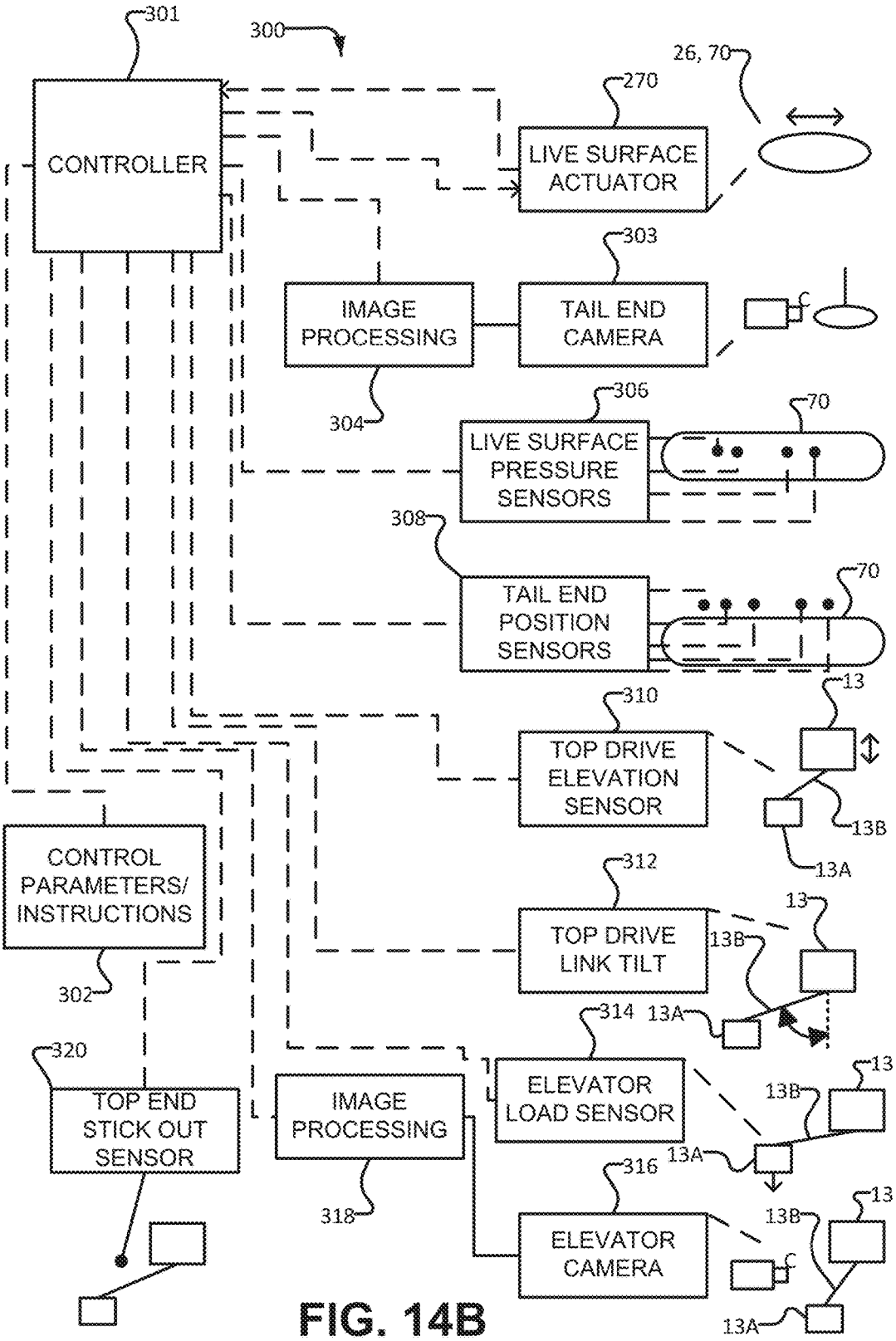

FIG. 14B illustrates an example live surface control system 300. Control system 300 includes a controller 301 that is in communication with a data store 302 containing control parameters and instructions. Where an apparatus also includes a control system 200 for stand building, controller 301 may use the same hardware or different hardware from controller 201. FIG. 14B receives input from a number of sensors and controls a live surface actuator 270 based on that input or inputs. Live surface actuator 270 may comprise a variable frequency drive system or a servo control system for example. It is not mandatory that control system 300 include all of the sensors illustrated in FIG. 14B. Those of skill in the art will understand that suitable control may be achieved using some subset of the disclosed sensors alone or in combination with other suitable sensors. FIG. 14B shows a tail end camera 303 and image processing 304. Image processing 304 processes images from tail end camera 303 to track a location of a tail end of a tubular. System 300 also includes live surface pressure sensor(s) 306; tail end position sensors 308 (which may, for example be electric eyes, proximity sensors etc.). System 300 receives a top drive elevation signal 310; a top drive link tilt signal 312; an elevator load signal 314 (these signals may be derived from a top drive control system and/or from additional sensors added to the top drive or other hoisting system being used). System 300 also includes an elevator camera 316 and image processing 318. Image processing 318 processes images from elevator camera 316 (which may, for example, be located on a top drive 13) to determine a degree of stickout, if any, of a tubular past elevator 13A. System 300 also includes a top end stick out sensor 320 which directly measures stickout of a tubular at elevator 13A.

A simple example control scheme uses signals indicating whether or not the tubular projects past two threshold positions above the elevator. These positions may, for example, correspond to two optical beams or two positions in the field of view of a camera, for example. The controller may operate the live surface in a way that attempts to keep the top of the tubular between the two threshold positions. For example, the controller may accelerate the live surface until the first threshold position is reached and slow the live surface if the second threshold position is reached by the top of the tubular. This relatively crude control may be sufficient to maintain a desired amount of slack between the tubular and the elevator to facilitate stopping travel of the tail end of the tubular before the elevator lifts the tubular off of the live surface.

In one alternative embodiment, instead of or in addition to providing a live surface that is movable relative to a catwalk, the catwalk or carriage is itself moved to control position of the tail end of a tubular up to, or almost up to, the point where the tubular leaves the catwalk. Where a live surface is provided in the form of a conveyor, it is not mandatory that the conveyor have the detailed structure as described herein. Other forms of conveyor comprising flexible belts or chains suitably robust for the demands of the application may also be used as live surfaces and controlled as described herein. A live surface need not be large. A live surface may be provided in the form of a socket or platform just large enough to receive and support the tail end of a tubular as the tubular is transferred to or from a drill rig and controllable to move as described herein.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

For example, while processes or blocks are presented in a given order, alternative examples may perform methods having steps occurring in a different order, and some steps or processes may be deleted, moved, added, subdivided, combined, and/or modified to provide alternative or subcombinations. Each of these processes may be implemented in a variety of different ways. Also, while processes or steps are at times shown as being performed in series, these processes or steps may instead be performed in parallel, or may be performed at different times.

Where a component (e.g. a member, actuator, controller, assembly, device, seal, motor, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Some non-limiting enumerated example embodiments of the technology described herein are as follows:

1. A pipe handling system comprising:
   a carriage having an upper surface adapted to support a tubular, the carriage comprising a first section at a leading end thereof and a second section, the first and second sections pivotally coupled together for rotation about a pivot axis extending in a direction transverse to the carriage, the carriage supported by a base and movable relative to the base to advance the leading end of the carriage in a forward direction or withdraw the leading end of the carriage with respect to the base, the carriage and base configured such that the leading end of the carriage is elevated as the carriage is advanced;
   an actuator coupled between the first and second sections, the actuator operable to pivot the second section relative to the first section about the pivot axis between at least a first configuration wherein the first and second sections are aligned with one another and a second configuration wherein the carriage has a kink at the pivot axis.
2. A pipe handling system according to enumerated example embodiment 1 wherein the base comprises a ramp and moving the carriage to advance the leading end of the carriage drives the leading end of the carriage up the ramp.
3. A pipe handling system according to enumerated example embodiment 2 or 3 wherein, the carriage is movable to an extended configuration wherein the first section of the carriage projects over and is pivotal about a top end of the ramp such that an angle of the first section of the carriage relative to the ramp is adjustable by controlling the actuator.
4. A pipe handling system according to enumerated example embodiment 3 wherein, in the extended configuration the leading end of the carriage is cantilevered and projects past the ramp.
5. A pipe handling system according to any one of enumerated example embodiments 1 to 4 wherein the carriage is formed to provide a trough extending longitudinally along the carriage, the trough dimensioned to receive a tubular.
6. A pipe handling system according to any one of enumerated example embodiments 1 to 4 wherein the carriage comprises a conveyor or skate operable to move the tubular along the carriage.
7. A pipe handling system according to any one of enumerated example embodiments 1 to 4 wherein the carriage comprises a conveyor operable to move the tubular along the carriage wherein the conveyor is formed to provide a trough extending along the length of the conveyor, the trough dimensioned to receive a tubular.
8. A pipe handling system according to enumerated example embodiment 7 wherein the conveyor comprises a plurality of segments connected to form a flexible conveyor band.
9. A pipe handling system according to enumerated example embodiment 8 wherein edges of adjacent ones of the segments are shaped to have interdigitating projections.
10. A pipe handling system according to any one of enumerated example embodiments 7 to 9 wherein the conveyor segments comprise one or more keels that project inwardly and include transversely-projecting features configured to engage rails or guides.
11. A pipe handling system according to enumerated example embodiment 10 wherein the transversely-projecting features comprise rollers.
12. A pipe handling system according to any one of enumerated example embodiments 1 to 11 wherein the actuator is operable to selectively kink the carriage to have a positive kink wherein an upper surface of the carriage forms a reflex angle or a negative kink wherein the upper surface of the carriage forms an obtuse angle.
13. A pipe handling system according to enumerated example embodiment 12 wherein the actuator comprises a link extending radially relative to the pivot axis and pivotal about the pivot axis, the actuator comprising a first linear actuator coupled between the first section and the link and a second linear actuator coupled between the second section and the link, the first and second linear actuators each coupled to the link at a location radially spaced from the pivot axis.

14. A pipe handling system according to enumerated example embodiment 12 or 13 comprising a stand builder, the stand builder comprising a backup jaw configured to hold a one tubular against rotation and a make/break tool configured to grip and rotate another tubular relative to the backup jaw.

15. A pipe handling system according to enumerated example embodiment 14 wherein the make/break tool comprises a rotatable chuck configured to grasp an end of a tubular.

16. A pipe handling system according to enumerated example embodiment 15 comprising an elevator operable to lift the tubular relative to the carriage into alignment with a centerline of the chuck.

17. A pipe handling system according to enumerated example embodiment 16 wherein the elevator is under the live surface and is operable to elevate a portion of the live surface.

18. A pipe handling system according to enumerated example embodiment 17 wherein the portion of the live surface is at least 3 meters long.

19. A pipe handling system according to any one of enumerated example embodiments 15 to 18 wherein the chuck is resiliently biased in a direction toward the leading end of the carriage.

20. A pipe handling system according to enumerated example embodiment 19 comprising a probe aligned with a bore of the chuck, the probe projecting through the bore of the chuck when the chuck is resiliently displaced away from the leading end of the carriage against the resilient bias.

21. A pipe handling system according to enumerated example embodiment 20 comprising a basket configured to receive an end of a tubular on an end of the probe.

22. A pipe handling system according to any one of enumerated example embodiments 19 to 21 wherein the resilient bias is provided by a gas spring.

23. A pipe handling system according to enumerated example embodiment 14 wherein the make/break tool comprises a rotatable chuck configured to grasp an end of a tubular, the chuck comprises a plurality of jaws arranged to grip a tubular and a pushing surface connected between the jaws such that retraction of the jaws axially advances the pushing surface.

24. A pipe handling system according to any one of enumerated example embodiments 14 to 23 wherein the stand builder comprises a mast arranged to support a stand comprising a plurality of tubulars at an angle that is inclined with respect to vertical.

25. A pipe handling system according to enumerated example embodiment 24 wherein the angle is in the range of 5 to 25 degrees.

26. A pipe handling system according to any one of enumerated example embodiments 14 to 25 comprising a pipe support located above the make/break tool, the pipe support having a longitudinally-extending opening, the pipe support mounted for rotation such that the opening is orientable to face in the forward direction or to face in a direction other than the forward direction.

27. A pipe handling system according to enumerated example embodiment 26 wherein the pipe support comprises a tube wherein the opening comprises a slit extending longitudinally along the tube.

28. A subsurface drilling system comprising:

a drill rig having a floor;

a pipe handling system comprising a live surface extending across the floor of the drill rig toward a well center;

a drive system connected to drive the live surface at a variable speed such that the speed is controlled when a tail end of a tubular is proximal to an end of the live surface closest to the well center.

29. A system according to enumerated example embodiment 28 wherein the drive system is reversible and is operable to move the live surface to either draw the tail end of the tubular away from the well center or to advance the tail end of the tubular toward the well center.

30. A system according to enumerated example embodiment 28 or 29 wherein the live surface is inclined and increases in elevation toward the well center.

31. A system according to any one of enumerated example embodiments 28 to 30 wherein the live surface comprises a conveyor.

32. A system according to any one of enumerated example embodiments 28 to 31 wherein the live surface is cantilevered over the floor of the drill rig.

33. A system according to enumerated example embodiment 32 wherein the end of the live surface closest to the well center is not more than 6 feet from the well center.

34. A system according to any one of enumerated example embodiments 28 to 33 comprising a controller connected to control the drive system for the live surface wherein the controller is configured to vary the speed of the live surface in coordination with one or more inputs indicative of a position of the tail end of a tubular along the live surface.

35. A system according to enumerated example embodiment 34 wherein the inputs comprise a position of a top end of the tubular.

35A. A system according to enumerated example embodiment 35 wherein the inputs comprise signals indicating whether the top end of the tubular projects past each of a plurality of threshold positions above the elevator.

35B. A system according to enumerated example embodiment 35A wherein the controller is configured to control the live surface based on the inputs to move the tail end of the tubular with a speed such that the top end of the tubular projects past a first one of the threshold positions during a first period.

35C. A system according to claim 35 wherein the inputs comprise a signal encoding a measurement indicating an amount of slack between the elevator and the top end of the tubular.

36. A system according to enumerated example embodiment 34 wherein the drill rig comprises a top drive equipped with an elevator and the controller is configured to compute the position of the top end of the tubular based on an elevation of the top drive and a position of the elevator relative to the top drive.

37. A system according to any one of enumerated example embodiments 34 to 36 wherein the inputs comprise a rate at which the top end of the tubular is being raised or lowered.

38. A system according to any one of enumerated example embodiments 34 to 37 wherein the controller is configured to compute an angle of the tubular relative to an axis and to vary the speed of the live surface based at least in part on the determined angle.

39. A system according to any one of enumerated example embodiments 34 to 38 comprising a scale coupled to measure a force exerted by a tubular on the live surface wherein the inputs comprise the force sensed by the scale.
40. A system according to any one of enumerated example embodiments 34 to 39 comprising a position sensor arranged to detect a position of the tail end of the tubular wherein the inputs comprise an output signal of the position sensor.
41. A system according to any one of enumerated example embodiments 34 to 40 wherein the controller is configured to determine a first relative position of the tail end of the tubular relative to a location directly below the elevator and the controller is configured to control the drive system to vary the speed of the live surface based at least in part on the first relative position.
42. A system according to any one of enumerated example embodiments 34 to 40 wherein the controller is configured to, in a first period operate the drive to move the live surface at a first speed sufficient to create slack between a top end of the tubular and an elevator hoisting the tubular and, in a second period subsequent to the first period, decelerate the tail end of the tubular such that, at the end of the second period the tail end of the tubular is stopped or almost stopped.
43. A system according to enumerated example embodiment 42 wherein the controller is configured to control a speed of the live surface to be 25 cm/sec or less at the end of the second period.
44. A system according to enumerated example embodiment 42 wherein the second period is timed such that the tubular is vertical at the end of the second period.
45. A system according to any one of enumerated example embodiments 28 to 45 comprising a backstop coupled to move together with the live surface.
46. A system according to enumerated example embodiment 45 wherein the backstop comprises a stop surface projecting from the live surface.
47. A system according to enumerated example embodiment 45 wherein the backstop comprises a member engageable in a bore of the tubular.
48. A system according to enumerated example embodiment 45 wherein the backstop is supported by cantilever arms attached to the live surface and extending away from the well center.
49. A system according to any one of enumerated example embodiments 28 to 45 wherein the live surface comprises a conveyor and the conveyor is formed to provide a trough extending along the length of the conveyor, the trough dimensioned to receive a tubular.
50. A system according to enumerated example embodiment 49 wherein the conveyor comprises a plurality of segments connected to form a flexible conveyor band.
51. A system according to enumerated example embodiment 50 wherein edges of adjacent ones of the segments are shaped to have interdigitating projections.
52. A system according to any one of enumerated example embodiments 49 to 51 wherein the conveyor segments comprise one or more keels that project inwardly and include transversely-projecting features configured to engage rails or guides.
53. A system according to enumerated example embodiment 52 wherein the transversely-projecting features comprise rollers.
54. A system according to any one of 28 to 53 wherein the live surface is supported on a carriage having first and second sections and an actuator operable to selectively kink the carriage to have a positive kink wherein an upper surface of the carriage forms a reflex angle or a negative kink wherein the upper surface of the carriage forms an obtuse angle.
54A. A system according to enumerated example embodiment 54 wherein the live surface comprises a conveyor and the conveyor forms a loop that extends around both the first section of the carriage and the second section of the carriage.
55. A system according to enumerated example embodiment 54 or 54A wherein the actuator comprises a link extending radially relative to pivot axis about which the first and second sections are rotatable relative to one another, the link being pivotal about the pivot axis, the actuator comprising a first linear actuator coupled between the first section and the link and a second linear actuator coupled between the second section and the link, the first and second linear actuators each coupled to the link at a location radially spaced from the pivot axis.
56. A method for presenting a tubular to a drill rig floor, the method comprising:
   placing a tubular on a carriage comprising first and second sections pivotally coupled together for rotation about a generally horizontal pivot axis;
   advancing the carriage toward the drill rig floor while raising a leading edge of the carriage to an elevation above the drill rig floor;
   before, during or after advancing the carriage, operating an actuator coupled between the first and second sections of the carriage to pivot the first section of the carriage about the pivot axis relative to the second section of the carriage such that the first section of the carriage is more nearly horizontal than the second section of the carriage, thereby setting an angle of presentation of the tubular at the drill rig floor.
57. A method according to enumerated example embodiment 56 wherein placing the tubular on the carriage comprises placing at least part of the tubular to be supported by the second section of the carriage and the method comprises, before operating the actuator to pivot the first section of the carriage about the pivot axis relative to the second section of the carriage, advancing the tubular along the carriage such that the tubular is supported entirely by the first section of the carriage.
58. A method according to enumerated example embodiment 56 or 57 wherein the drill rig floor has a height of at least 18 feet above an elevation of the tubular when the tubular is placed on the carriage.
59. A method according to any one of enumerated example embodiments 56 to 58 comprising operating the actuator to set the angle of presentation of the tubular to less than 20 degrees to horizontal.
60. A method according to any one of enumerated example embodiments 56 to 59 comprising, after placing the tubular on the carriage, operating a live surface of the carriage to move a leading end the tubular to project past a leading end of the carriage into contact with a stop surface.
61. A method according to enumerated example embodiment 60 comprising, contacting a trailing end of the tubular with a backstop while the leading end of the tubular is in contact with the stop surface, determining a position of the backstop and recording a length of the tubular based on the position of the backstop.

62. A method for pipe handling in drilling, the method comprising:
grasping a first end of a tubular with an elevator;
changing an elevation of the first end of the tubular by moving the elevator;
while changing the elevation of the first end of the tubular, allowing a second end of the tubular to rest on a live surface and operating the live surface to control motion of the second end of the tubular relative to a well center.

63. A method according to enumerated example embodiment 62 wherein moving the elevator comprises hoisting the elevator and the method comprises operating the live surface to reduce a velocity of the second end of the tubular to a velocity of less than 25 cm/sec when the tubular becomes vertical.

64. A method according to enumerated example embodiment 63 wherein operating the live surface comprises, in a first period operating the drive to move the live surface at a first speed sufficient to create slack between a top end of the tubular and an elevator hoisting the tubular and, in a second period subsequent to the first period, decelerate the tail end of the tubular such that, at the end of the second period the tail end of the tubular is stopped or almost stopped.

65. A method according to enumerated example embodiment 64 comprising hoisting the elevator during the first and second periods.

66. A method according to any one of enumerated example embodiments 62 to 65 wherein the elevator is associated with a top drive and the method comprises maintaining the elevator in a side tilted configuration while moving the first end of the tubular.

67. A method for pipe handling in drilling, the method comprising:
assembling a plurality of tubulars to provide a stand inclined at an angle to vertical;
passing an upper end of the stand upwardly through a pipe support having one side formed to provide a longitudinally extending opening wide enough to pass the stand such that an upper end of the stand projects out of a top end of the pipe support;
engaging the upper end of the stand with an elevator on a drill rig;
rotating the pipe support until the opening faces toward a well center;
raising the upper end of the stand using the elevator until the stand is vertical 68. A method according to enumerated example embodiment 67 comprising, while raising the upper end of the stand, allowing a lower end of the stand to rest on a live surface and operating the live surface to control motion of the lower end of the stand toward the well center.

69. Apparatus having any new and inventive feature, combination of features, or sub-combination of features as described herein.

70. Methods having any new and inventive steps, acts, combination of steps and/or acts or sub-combination of steps and/or acts as described herein.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A subsurface drilling system comprising:
a drill rig having a floor;
a pipe handling system comprising a live surface extending across a portion of the floor of the drill rig toward a well center;
a drive system connected to drive the live surface at a variable speed such that the speed is controlled when a tail end of a tubular is proximal to an end of the live surface closest to the well center; and
a controller connected to control the drive system for the live surface wherein the controller is configured to vary the speed of the live surface in coordination with one or more inputs indicative of a position of the tail end of a tubular along the live surface.

2. The system according to claim 1 wherein the drive system is reversible and is operable to move the live surface to either draw the tail end of the tubular away from the well center or to advance the tail end of the tubular toward the well center.

3. The system according to claim 1 wherein the live surface is inclined and increases in elevation toward the well center.

4. The system according claim 1 wherein the live surface comprises a conveyor.

5. The system according claim 1 wherein the live surface is cantilevered over the floor of the drill rig.

6. The system according to claim 1 wherein the end of the live surface closest to the well center is not more than 6 feet from the well center.

7. The system according to claim 1 wherein the inputs comprise a position of a top end of the tubular.

8. The system according to claim 7 wherein the inputs comprise signals indicating whether the top end of the tubular projects past each of a plurality of threshold positions above an elevator.

9. The system according to claim 8 wherein the controller is configured to control the live surface based on the inputs to move the tail end of the tubular with a speed such that the top end of the tubular projects past a first one of the threshold positions during a first period.

10. The system according to claim 7 wherein the inputs comprise a signal encoding a measurement indicating an amount of slack between the elevator and the top end of the tubular.

11. The system according to claim 1 wherein the drill rig comprises a top drive equipped with an elevator and the controller is configured to compute the position of the top end of the tubular based on an elevation of the top drive and a position of the elevator relative to the top drive.

12. The system according claim 1 wherein the inputs comprise a rate at which the top end of the tubular is being raised or lowered.

13. The system according claim 1 wherein the controller is configured to compute an angle of the tubular relative to an axis and to vary the speed of the live surface based at least in part on the determined angle.

14. The system according claim 1 comprising a scale coupled to measure a force exerted by a tubular on the live surface wherein the inputs comprise the force sensed by the scale.

15. The system according claim 1 comprising a position sensor arranged to detect a position of the tail end of the tubular wherein the inputs comprise an output signal of the position sensor.

16. The system according claim 1 wherein the controller is configured to determine a first relative position of the tail end of the tubular relative to a location directly below an elevator and the controller is configured to control the drive system to vary the speed of the live surface based at least in part on the first relative position.

17. The system according claim 1 wherein the controller is configured to, in a first period operate the drive to move the live surface at a first speed sufficient to create slack between a top end of the tubular and an elevator hoisting the tubular and, in a second period subsequent to the first period, decelerate the tail end of the tubular such that, at the end of the second period the tail end of the tubular is stopped or almost stopped.

18. The system according to claim 17 wherein the controller is configured to control a speed of the live surface to be 25 cm/sec or less at the end of the second period.

19. The system according to claim 18 wherein the second period is timed such that the tubular is vertical at the end of the second period.

20. The system according claim 1 comprising a backstop coupled to move together with the live surface.

21. The system according to claim 20 wherein the backstop comprises a stop surface projecting from the live surface.

22. The system according to claim 20 wherein the backstop comprises a member engageable in a bore of the tubular.

23. The system according to claim 20 wherein the backstop is supported by cantilever arms attached to the live surface and extending away from the well center.

24. A subsurface drilling system comprising:

a drill rig having a floor;

a pipe handling system comprising a live surface extending across a portion of the floor of the drill rig toward a well center;

a drive system connected to drive the live surface at a variable speed such that the speed is controlled when a tail end of a tubular is proximal to an end of the live surface closest to the well center;

wherein:

the live surface comprises a conveyor and the conveyor comprises a plurality of segments connected to form a flexible conveyor band and edges of adjacent ones of the segments are shaped to have interdigitating projections; and the conveyor segments comprise one or more keels that project inwardly and include transversely-projecting features configured to engage rails or guides.

25. The system according claim 24 wherein the conveyor is formed to provide a trough extending along the length of the conveyor, the trough dimensioned to receive a tubular.

26. The system according to claim 24 wherein the transversely-projecting features comprise rollers.

27. A subsurface drilling system comprising:

a drill rig having a floor;

a pipe handling system comprising a live surface extending across a portion of the floor of the drill rig toward a well center; and a drive system connected to drive the live surface at a variable speed such that the speed is controlled when a tail end of a tubular is proximal to an end of the live surface closest to the well center;

wherein the live surface is supported on a carriage having first and second sections and an actuator operable to selectively kink the carriage to have a positive kink wherein an upper surface of the carriage forms a reflex angle or a negative kink wherein the upper surface of the carriage forms an obtuse angle.

28. The system according to claim 27 wherein the live surface comprises conveyor and the conveyor forms a loop that extends around both the first section of the carriage and the second section of the carriage.

29. The system according to claim 27 wherein the actuator comprises a link extending radially relative to pivot axis about which the first and second sections are rotatable relative to one another, the link being pivotal about the pivot axis, the actuator comprising a first linear actuator coupled between the first section and the link and a second linear actuator coupled between the second section and the link, the first and second linear actuators each coupled to the link at a location radially spaced from the pivot axis.

* * * * *